US010262671B2

(12) United States Patent
Wang

(10) Patent No.: US 10,262,671 B2
(45) Date of Patent: Apr. 16, 2019

(54) AUDIO CODING METHOD AND RELATED APPARATUS

(71) Applicant: HUAWEI TECHNOLOGIES CO., LTD., Shenzhen, Guangdong (CN)

(72) Inventor: Zhe Wang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/337,927

(22) Filed: Oct. 28, 2016

(65) Prior Publication Data

US 2017/0047078 A1 Feb. 16, 2017

Related U.S. Application Data

(63) Continuation of application No. PCT/CN2014/090369, filed on Nov. 5, 2014.

(30) Foreign Application Priority Data

Apr. 29, 2014 (CN) ..... 2014 1 0177838

(51) Int. Cl.
*G10L 19/00* (2013.01)
*G10L 21/00* (2013.01)
(Continued)

(52) U.S. Cl.
CPC ..... *G10L 19/22* (2013.01); *G10L 19/02* (2013.01); *G10L 19/04* (2013.01); *G10L 19/12* (2013.01); *G10L 19/20* (2013.01)

(58) Field of Classification Search
CPC ..... G10L 19/12; G10L 19/18; G10L 19/09; G10L 19/08; G10L 19/083; G10L 19/10;
(Continued)

(56) References Cited

U.S. PATENT DOCUMENTS 5,546,498 A * 8/1996 Sereno ..... G10L 19/06 704/216
5,664,055 A * 9/1997 Kroon ..... G10L 19/083 704/208
(Continued)

FOREIGN PATENT DOCUMENTS

CL 200501138 8/2006
CN 101123091 A 2/2008
(Continued)

OTHER PUBLICATIONS

Takehiro Moriya, Speech Coding, Japan, The Institute of Electronics, Information and Communication Engineers, Oct. 20, 1998, First Edition, 15 pages.

*Primary Examiner* — Michael Ortiz-Sanchez
(74) *Attorney, Agent, or Firm* — Womble Bond Dickinson (US) LLP

(57) ABSTRACT

An audio coding method and a related apparatus are disclosed. The audio coding method includes: estimating reference linear prediction efficiency of a current audio frame; determining an audio coding scheme that matches the reference linear prediction efficiency of the foregoing current audio frame; and performing audio coding on the foregoing current audio frame according to the audio coding scheme that matches the reference linear prediction efficiency of the foregoing current audio frame. The technical solutions provided in embodiments of the present disclosure help reduce overheads of audio coding.

18 Claims, 10 Drawing Sheets

(51) Int. Cl.

| | |
|---|---|
| ***G10L 21/04*** | (2013.01) |
| ***G10L 19/22*** | (2013.01) |
| ***G10L 19/02*** | (2013.01) |
| ***G10L 19/04*** | (2013.01) |
| ***G10L 19/12*** | (2013.01) |
| ***G10L 19/20*** | (2013.01) |

(58) Field of Classification Search

CPC ..... G10L 2019/0016; G10L 2009/0002; G10L 19/04; G10L 19/06; G10L 19/07; G10L 25/06; G10L 25/48; G10L 19/02; G10L 25/12; G10L 19/20; G10L 19/22; G10L 19/0212; G10L 19/005; G10L 19/002; G10L 19/008; G10L 19/24; G10L 19/00; G10L 2019/0002; G10L 21/038; G10L 19/012; G10L 19/107; G10L 19/26; G10L 19/0204; G10L 2019/0011; G10L 19/03; G10L 25/78; G10L 19/032; G10L 19/087; G10L 19/025; G10L 19/038; G10L 21/0216; G10L 21/0232; G10L 19/018; G10L 19/022; G10L 19/028; G10L 19/125; G10L 25/72; G10L 19/0017; G10L 19/0208; G10L 19/093; G10L 25/90; G10L 25/93; G10L 19/167; G10L 2019/0008; G10L 2025/937; G10L 21/0208; G10L 21/0388; G10L 25/21; G10L 25/60; G10L 19/16; G10L 19/173; G10L 19/265; G10L 2019/0001; G10L 2019/0003; G10L 2025/932; G10L 21/00; G10L 21/0316; G10L 21/0324; G10L 21/0364; G10L 25/15; G10L 25/18; G10L 25/30; G10L 25/69; G10L 21/0224; H04L 1/0014; H04L 1/0009; H04L 65/607; H04M 3/2236; H04M 7/0072

See application file for complete search history.

(56) References Cited

U.S. PATENT DOCUMENTS

| | | | | |
|---|---|---|---|---|
| 5,778,335 | A * | 7/1998 | Ubale | G10H 1/125 704/219 |
| 5,787,389 | A | 7/1998 | Taumi et al. | |
| 5,839,098 | A * | 11/1998 | Laroia | G10L 19/0212 704/203 |
| 5,890,109 | A * | 3/1999 | Walker | G10L 25/78 704/215 |
| 5,950,155 | A * | 9/1999 | Nishiguchi | G10L 19/07 704/219 |
| 5,963,898 | A * | 10/1999 | Navarro | G10L 19/083 704/219 |
| 5,974,377 | A * | 10/1999 | Navarro | G10L 19/09 704/201 |
| 5,978,756 | A * | 11/1999 | Walker | G10L 19/012 704/206 |
| 6,006,178 | A * | 12/1999 | Taumi | G10L 19/083 704/219 |
| 6,640,209 | B1 * | 10/2003 | Das | G10L 19/18 704/207 |
| 6,823,303 | B1 * | 11/2004 | Su | G10L 19/005 704/201 |
| 8,515,744 | B2 * | 8/2013 | Zhang | G10L 19/09 704/207 |
| 2002/0099548 | A1 | 7/2002 | Manjunath et al. | |
| 2002/0147582 | A1 | 10/2002 | Tasaki | |
| 2003/0009325 | A1 | 1/2003 | Kirchherr et al. | |
| 2003/0101050 | A1 | 5/2003 | Khalil et al. | |
| 2004/0002856 | A1 | 1/2004 | Bhaskar et al. | |
| 2004/0093205 | A1 * | 5/2004 | Ashley | G10L 19/083 704/220 |
| 2004/0113906 | A1 * | 6/2004 | Lew | G09G 3/3406 345/211 |
| 2005/0075867 | A1 * | 4/2005 | Ansorge | G10L 19/12 704/219 |
| 2005/0256701 | A1 | 11/2005 | Makinen et al. | |
| 2006/0149538 | A1 | 7/2006 | Lee et al. | |
| 2006/0165237 | A1 | 7/2006 | Villemoes et al. | |
| 2006/0210180 | A1 | 9/2006 | Geiger et al. | |
| 2007/0106502 | A1 | 5/2007 | Kim et al. | |
| 2007/0174051 | A1 | 7/2007 | Oh et al. | |
| 2007/0174502 | A1 | 7/2007 | Lin et al. | |
| 2008/0040104 | A1 * | 2/2008 | Ide | G10L 19/087 704/219 |
| 2008/0147414 | A1 | 6/2008 | Son et al. | |
| 2010/0070284 | A1 | 3/2010 | Oh et al. | |
| 2011/0119055 | A1 * | 5/2011 | Lee | G10L 19/008 704/205 |
| 2011/0305272 | A1 * | 12/2011 | Moriya | H03M 7/18 375/240 |
| 2012/0095756 | A1 * | 4/2012 | Sung | G10L 19/06 704/219 |
| 2012/0226496 | A1 | 9/2012 | Yoon et al. | |
| 2012/0239408 | A1 * | 9/2012 | Oh | G10L 19/18 704/500 |
| 2013/0090929 | A1 * | 4/2013 | Ishikawa | G10L 19/0212 704/262 |
| 2013/0132099 | A1 | 5/2013 | Oshikiri et al. | |
| 2015/0179190 | A1 * | 6/2015 | Nagle | G10L 19/06 704/210 |
| 2015/0317994 | A1 * | 11/2015 | Ramadas | G10L 19/24 704/226 |
| 2017/0047074 | A1 | 2/2017 | Wang et al. | |
| 2017/0352358 | A1 | 12/2017 | Wang et al. | |

FOREIGN PATENT DOCUMENTS

| | | | |
|---|---|---|---|
| CN | 101145343 | A | 3/2008 |
| CN | 101145345 | A | 3/2008 |
| CN | 101965612 | A | 2/2011 |
| CN | 102934161 | A | 2/2013 |
| CN | 107452391 | A | 12/2017 |
| JP | H08194499 | A | 7/1996 |
| JP | 2000298500 | A | 10/2000 |
| JP | 2001175295 | A | 6/2001 |
| JP | 2002258896 | A | 9/2002 |
| JP | 2006189836 | | 7/2006 |
| JP | 2009524846 | A | 7/2009 |
| RU | 2325708 | C2 | 5/2008 |
| RU | 2369917 | C2 | 10/2009 |
| WO | 2005078706 | A1 | 8/2005 |
| WO | 2010003521 | A1 | 1/2010 |
| WO | 2012081166 | A1 | 6/2012 |
| WO | 2014118136 | A1 | 8/2014 |

* cited by examiner

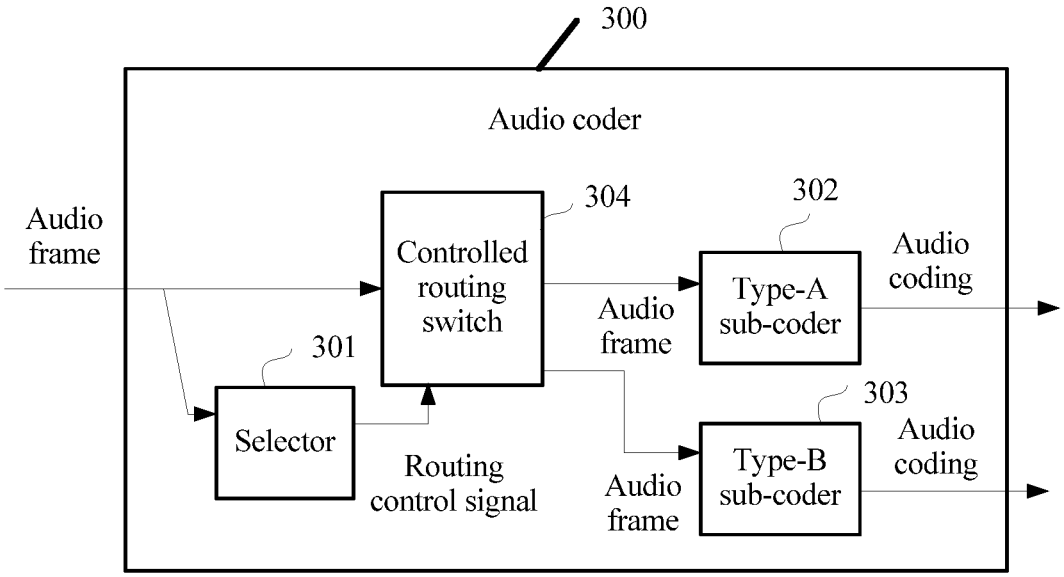
FIG. 3-a
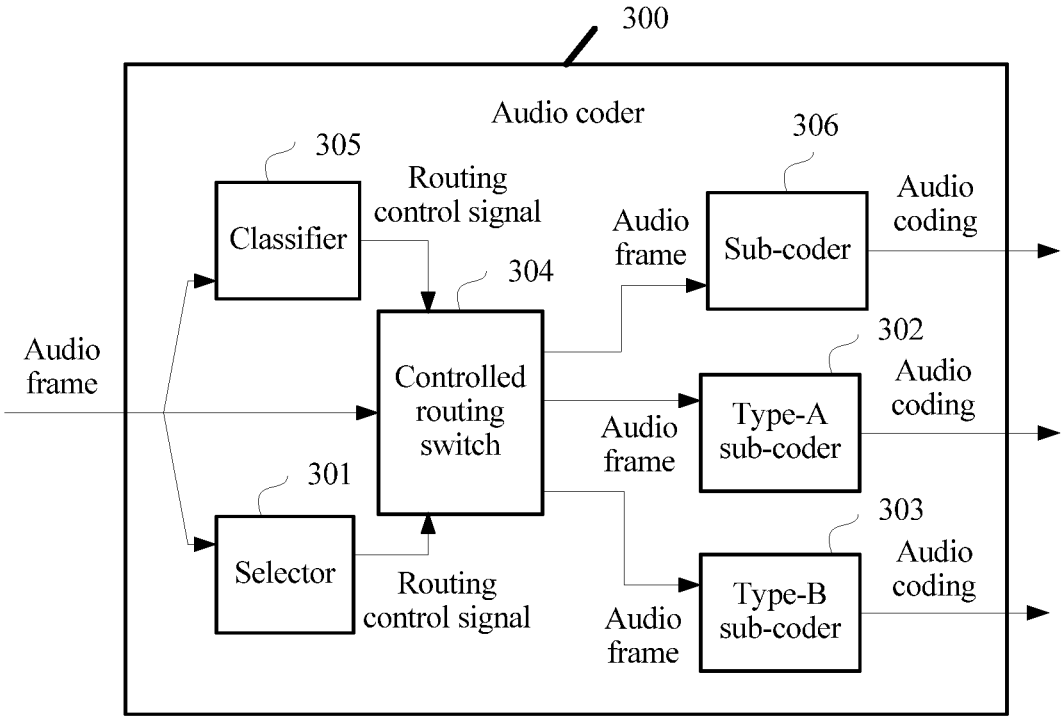
FIG. 3-b

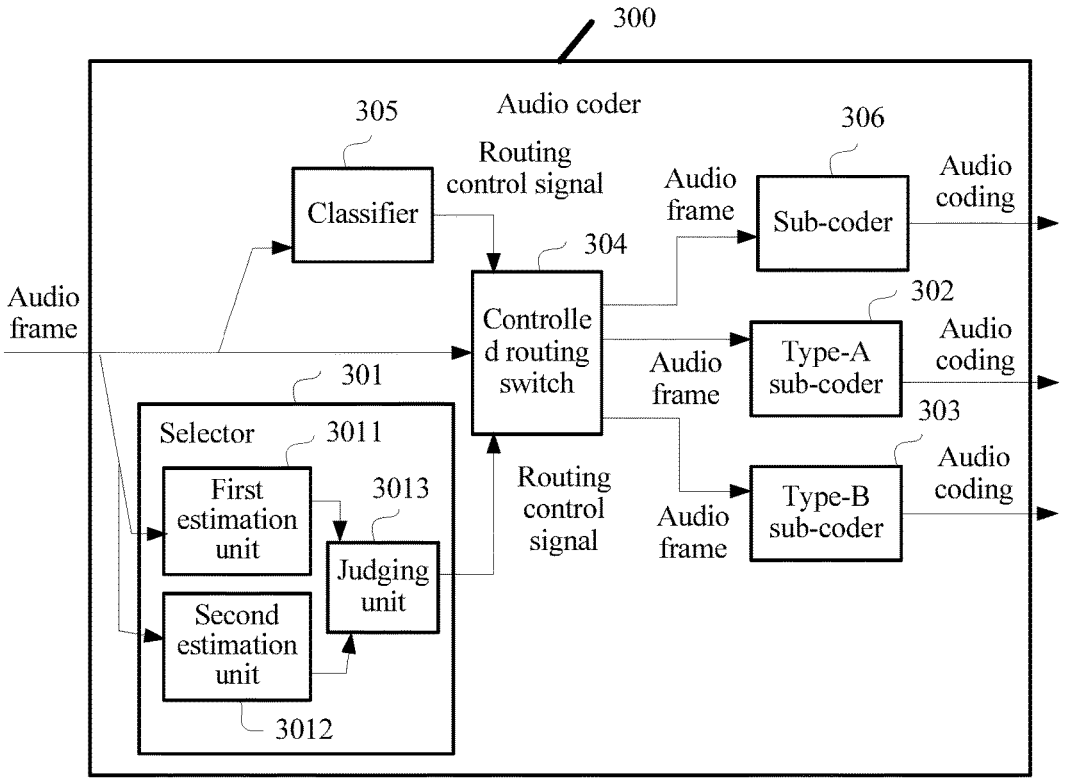
FIG. 3-c

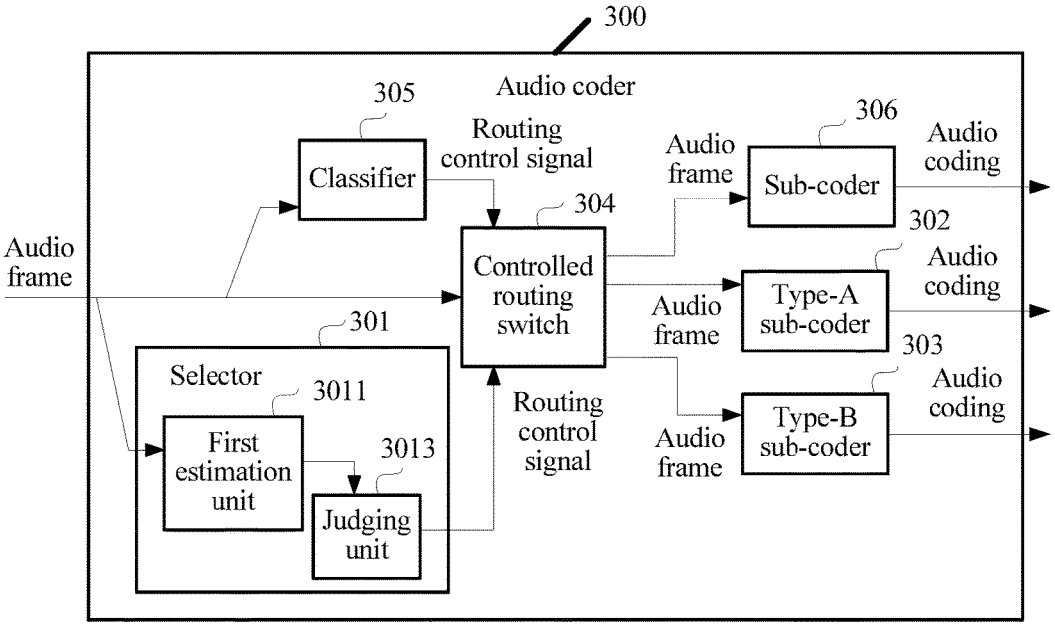
FIG. 3-d
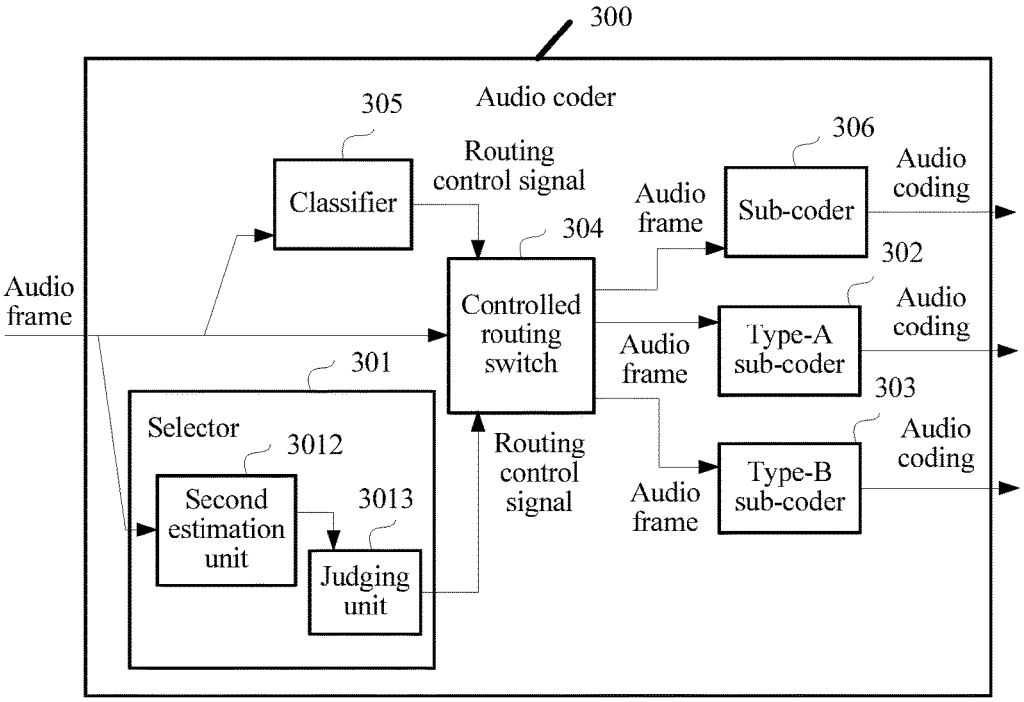
FIG. 3-e

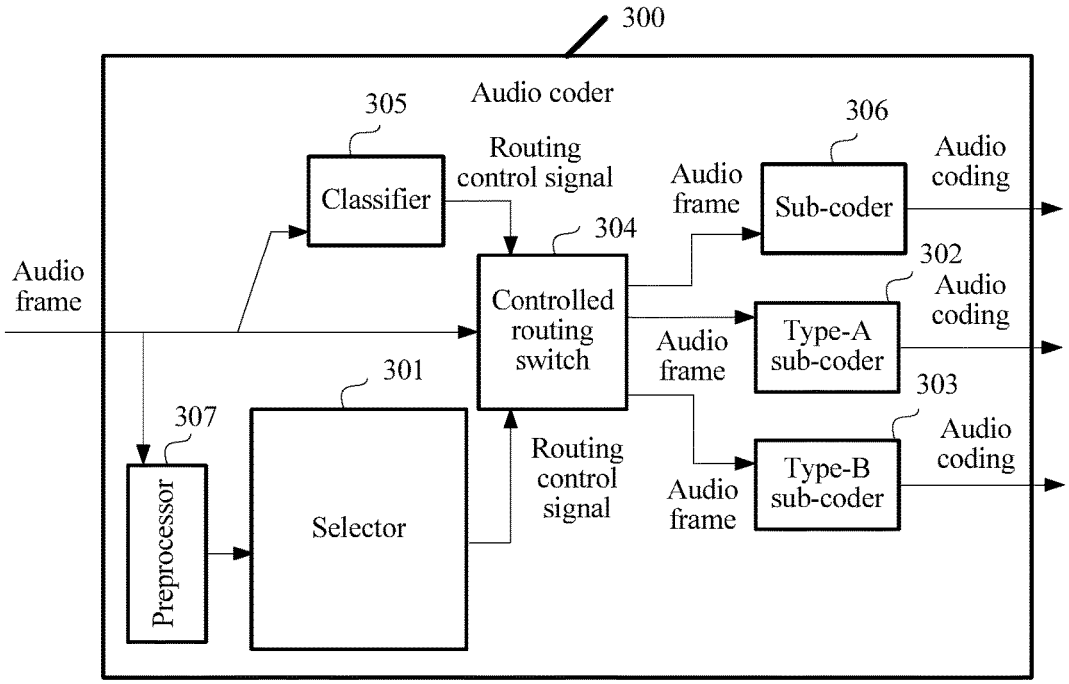
FIG. 3-f

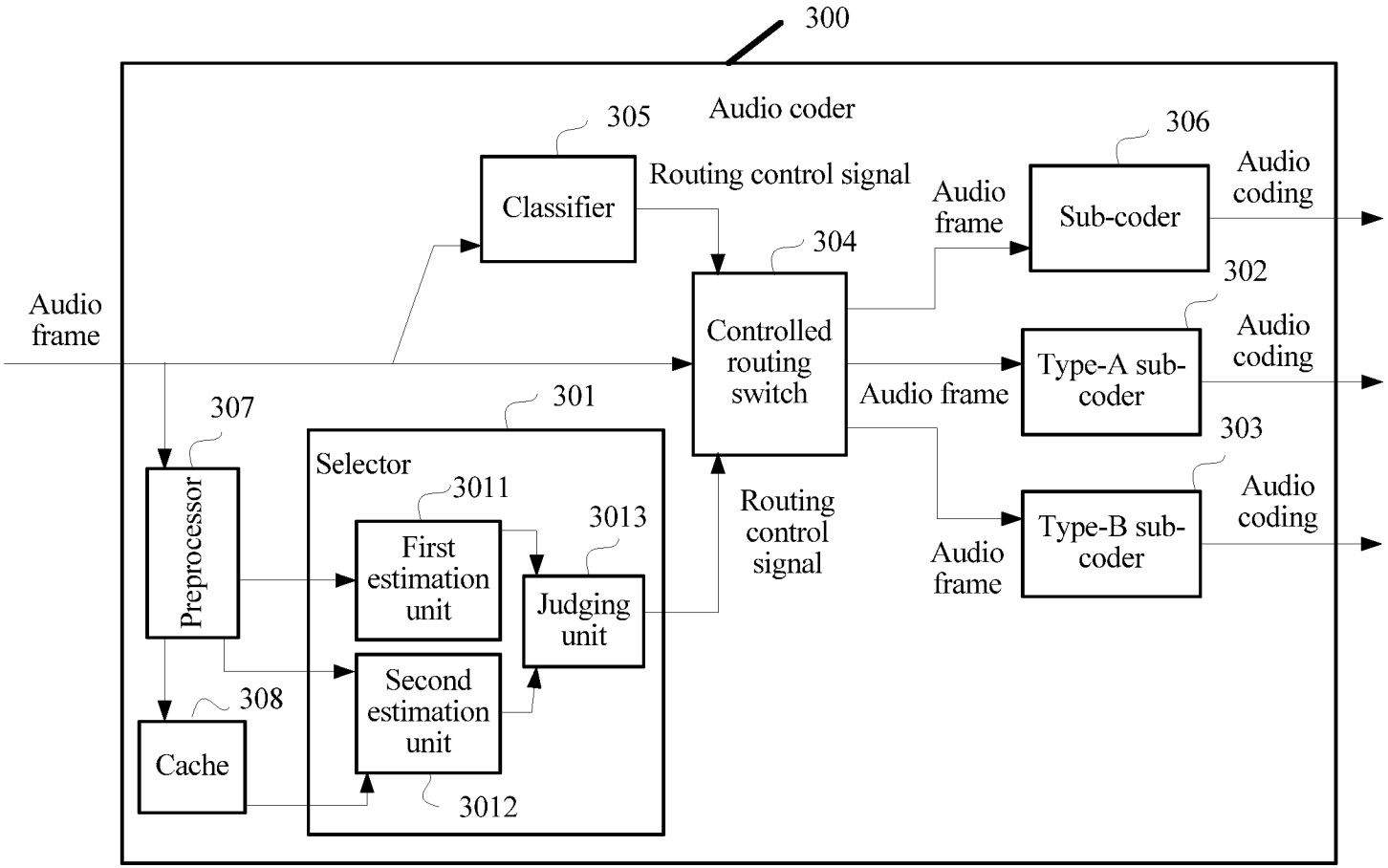
FIG. 3-g

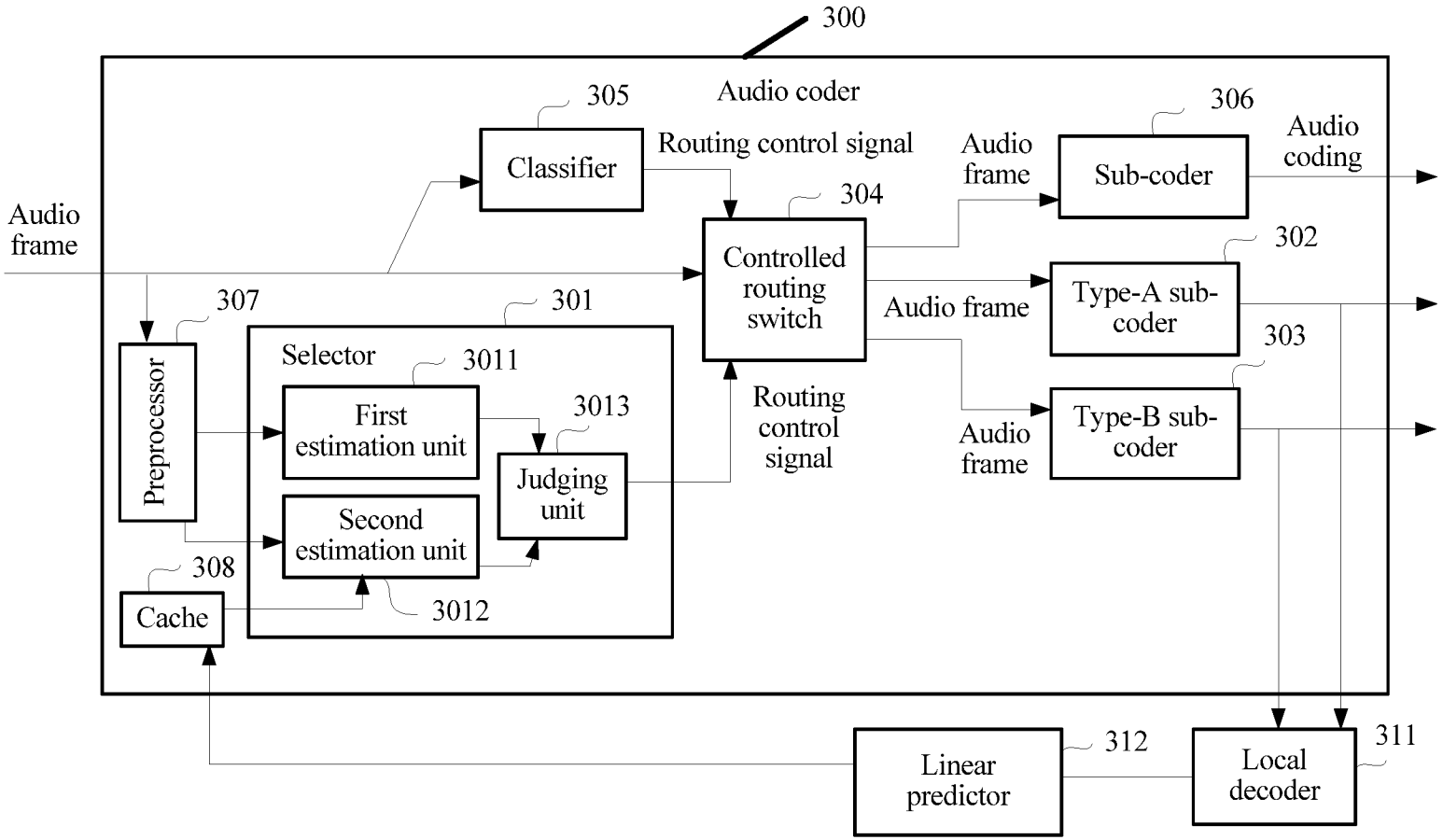
FIG. 3-h

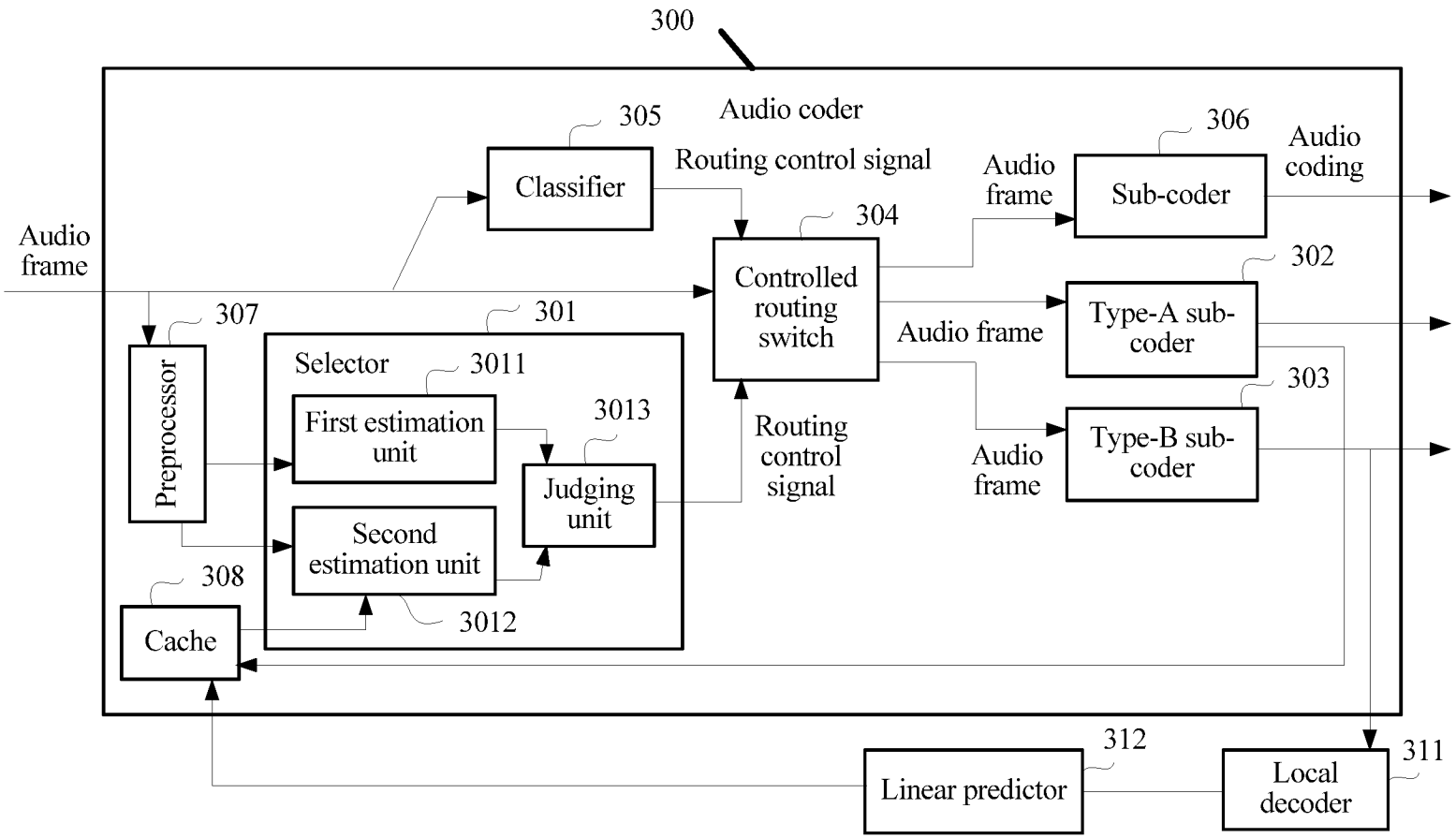
FIG. 3-i

AUDIO CODING METHOD AND RELATED APPARATUS

CROSS-REFERENCE TO RELATED APPLICATIONS

This application is a continuation of International Application No. PCT/CN2014/090369, filed on Nov. 5, 2014, which claims priority to Chinese Patent Application No. 201410177838.8, filed on Apr. 29, 2014, The disclosures of the aforementioned applications are hereby incorporated by reference in their entireties.

TECHNICAL FIELD

The present disclosure relates to audio coding technologies, and specifically, to an audio coding method and a related apparatus.

BACKGROUND

During a quite long time period in the past, speech signal coding is relatively independent from non-speech signal (for example, music) coding, that is, speech signal coding is implemented by a dedicated speech coder, and non-speech signal coding is implemented by a dedicated non-speech coder (where the non-speech coder may also be referred to as a generic audio coder).

Generally, a speech coder is not used to code a non-speech signal, and a non-speech coder is not used to code a speech signal, not only because speech coding is relatively independent from non-speech signal coding in a coding theory, but also because the two types of signals are relatively independent in an actual application generally. For example, in a voice communications network, because during a quite long time period in the past, voices are all or main signal sources, and bandwidth is strictly limited, various speech coders with low rates are widely used in the voice communications network. In applications such as video and entertainment, because non-speech signals are a majority of signal sources and these applications impose a relatively high requirement on audio quality and a relatively low requirement on a bit rate, non-speech coders are widely used in these scenarios.

In recent years, increasing multimedia signal sources such as a customized ring back tone appear in a conventional voice communications network, which imposes a higher requirement on coding quality of a coder. A dedicated speech coder cannot provide relatively high coding quality required by these multimedia signals, and a new coding technology such as a mix-audio coder emerges as the times require.

The mix-audio coder is an audio coder that includes a sub-coder suitable for coding a speech signal and that further includes a sub-coder suitable for coding a non-speech signal. The mix-audio coder always attempts to dynamically select a most suitable sub-coder from all sub-coders to code an input audio signal. How to select the most suitable sub-coder from all the sub-coders to code an input current audio frame is an important function and requirement of the mix coder, and sub-coder selection is also referred to as mode selection, which directly relates to coding quality of the mix coder.

In the prior art, a sub-coder is generally selected in a closed-loop mode, that is, each sub-coder is used to code an input current audio fame once, and an optimal sub-coder is selected by directly comparing quality of the coded current audio frame. However, a disadvantage of the closed-loop mode is that coding operation complexity is relatively high (because each sub-coder is used to code the input current audio frame once), and further actual overheads of audio coding are relatively large.

SUMMARY

Embodiments of the present disclosure provide an audio coding method and a related apparatus, to reduce overheads of audio coding.

A first aspect of the embodiments of the present disclosure provides an audio coding method, including:

estimating reference linear prediction efficiency of a current audio frame;

determining an audio coding scheme that matches the reference linear prediction efficiency of the current audio frame; and performing audio coding on the current audio frame according to the audio coding scheme that matches the reference linear prediction efficiency of the current audio frame.

With reference to the first aspect, in a first possible implementation manner of the first aspect, the reference linear prediction efficiency includes at least one of the following linear prediction efficiency: reference long-term linear prediction efficiency, reference short-term linear prediction efficiency, and reference integrated linear prediction efficiency.

With reference to the first possible implementation manner of the first aspect, in a second possible implementation manner of the first aspect, the reference integrated linear prediction efficiency is a sum value, a weighted sum value, or an average value of the reference long-term linear prediction efficiency and the reference short-term linear prediction efficiency.

With reference to the first possible implementation manner of the first aspect, in a third possible implementation manner of the first aspect, if the reference linear prediction efficiency of the current audio frame includes reference long-term linear prediction efficiency of the current audio frame and reference short-term linear prediction efficiency of the current audio frame, the determining an audio coding scheme that matches the reference linear prediction efficiency of the current audio frame includes:

if the reference long-term linear prediction efficiency of the current audio frame is less than a first threshold and/or the reference short-term linear prediction efficiency of the current audio frame is less than a second threshold, determining that the audio coding scheme that matches the reference linear prediction efficiency of the current audio frame is an audio coding scheme not based on linear prediction;

and/or if the reference long-term linear prediction efficiency of the current audio frame is greater than or equal to a first threshold and/or the reference short-term linear prediction efficiency of the current audio frame is greater than or equal to a second threshold, determining that the audio coding scheme that matches the reference linear prediction efficiency of the current audio frame is a linear prediction based audio coding scheme.

With reference to the first possible implementation manner of the first aspect, in a fourth possible implementation manner of the first aspect, if the reference linear prediction efficiency of the current audio frame includes reference long-term linear prediction efficiency of the current audio frame, the determining an audio coding scheme that matches the reference linear prediction efficiency of the current audio frame includes:

if the reference long-term linear prediction efficiency of the current audio frame is greater than or equal to a third threshold, determining that the audio coding scheme that matches the reference linear prediction efficiency of the current audio frame is a linear prediction based audio coding scheme; and/or if the reference long-term linear prediction efficiency of the current audio frame is less than a fourth threshold, determining that the audio coding scheme that matches the reference linear prediction efficiency of the current audio frame is an audio coding scheme not based on linear prediction.

With reference to the first possible implementation manner of the first aspect, in a fifth possible implementation manner of the first aspect, if the reference linear prediction efficiency of the current audio frame includes reference long-term linear prediction efficiency of the current audio frame, the determining an audio coding scheme that matches the reference linear prediction efficiency of the current audio frame includes: determining a first linear prediction efficiency interval within which the reference long-term linear prediction efficiency of the current audio frame falls, and determining, according to a mapping relationship between a linear prediction efficiency interval and a linear prediction based audio coding scheme, a first audio coding scheme that is in a mapping relationship with the first linear prediction efficiency interval, where the first audio coding scheme is an audio coding scheme that matches the reference linear prediction efficiency of the current audio frame, and the first audio coding scheme is a linear prediction based audio coding scheme or an audio coding scheme not based on linear prediction.

With reference to the first possible implementation manner of the first aspect, in a sixth possible implementation manner of the first aspect, if the reference linear prediction efficiency of the current audio frame includes reference short-term linear prediction efficiency of the current audio frame, the determining an audio coding scheme that matches the reference linear prediction efficiency of the current audio frame includes:

if the reference short-term linear prediction efficiency of the current audio frame is greater than or equal to a fifth threshold, determining that the audio coding scheme that matches the reference linear prediction efficiency of the current audio frame is a linear prediction based audio coding scheme; and/or if the reference short-term linear prediction efficiency of the current audio frame is less than a fifth threshold, determining that the audio coding scheme that matches the reference linear prediction efficiency of the current audio frame is an audio coding scheme not based on linear prediction.

With reference to the first possible implementation manner of the first aspect, in a seventh possible implementation manner of the first aspect, if the reference linear prediction efficiency of the current audio frame includes reference short-term linear prediction efficiency of the current audio frame, the determining an audio coding scheme that matches the reference linear prediction efficiency of the current audio frame includes: determining a second linear prediction efficiency interval within which the reference short-term linear prediction efficiency of the current audio frame falls, and determining, according to a mapping relationship between a linear prediction efficiency interval and a linear prediction based audio coding scheme, a second audio coding scheme that is in a mapping relationship with the second linear prediction efficiency interval, where the second audio coding scheme is an audio coding scheme that matches the reference linear prediction efficiency of the current audio frame, and the second audio coding scheme is a linear prediction based audio coding scheme or an audio coding scheme not based on linear prediction.

With reference to the first possible implementation manner of the first aspect or the second possible implementation manner of the first aspect, in an eighth possible implementation manner of the first aspect, if the reference linear prediction efficiency of the current audio frame includes reference integrated linear prediction efficiency of the current audio frame, the determining an audio coding scheme that matches the reference linear prediction efficiency of the current audio frame includes:

if the reference integrated linear prediction efficiency of the current audio frame is greater than or equal to a sixth threshold, determining that the audio coding scheme that matches the reference linear prediction efficiency of the current audio frame is a linear prediction based audio coding scheme; and/or if the reference integrated linear prediction efficiency of the current audio frame is less than a sixth threshold, determining that the audio coding scheme that matches the reference linear prediction efficiency of the current audio frame is an audio coding scheme not based on linear prediction.

With reference to the first possible implementation manner of the first aspect or the second possible implementation manner of the first aspect, in a ninth possible implementation manner of the first aspect, if the reference linear prediction efficiency of the current audio frame includes reference integrated linear prediction efficiency of the current audio frame, the determining an audio coding scheme that matches the reference linear prediction efficiency of the current audio frame includes: determining a third linear prediction efficiency interval within which the reference integrated linear prediction efficiency of the current audio frame falls, and determining, according to a mapping relationship between a linear prediction efficiency interval and a linear prediction based audio coding scheme, a third audio coding scheme that is in a mapping relationship with the third linear prediction efficiency interval, where the third audio coding scheme is an audio coding scheme that matches the reference linear prediction efficiency of the current audio frame, and the third audio coding scheme is a linear prediction based audio coding scheme or an audio coding scheme not based on linear prediction.

With reference to the first to the ninth possible implementation manners of the first aspect, in a tenth possible implementation manner of the first aspect, the reference long-term linear prediction efficiency of the current audio frame is obtained by means of estimation in the following manner: estimating long-term linear prediction efficiency of the current audio frame, where the long-term linear prediction efficiency of the current audio frame is the reference long-term linear prediction efficiency of the current audio frame; or the reference long-term linear prediction efficiency of the current audio frame is obtained by means of estimation in the following manner: obtaining long-term linear prediction efficiency of the current audio frame by means of estimation; acquiring linear prediction efficiency of N1 history audio frames of the current audio frame; and calculating a first statistical value of the linear prediction efficiency of the N1 history audio frames and the long-term linear prediction efficiency of the current audio frame, where N1 is a positive integer, the first statistical value is the reference long-term linear prediction efficiency of the current audio frame, linear prediction efficiency of each history audio frame of N1 history audio frames is at least one of the following linear prediction efficiency: long-term linear prediction efficiency, short-term linear prediction efficiency, and integrated linear prediction efficiency, and the N1 history audio frames are a subset of the N1 history audio frames; or the reference long-term linear prediction efficiency of the current audio frame is obtained by means of estimation in the following manner: obtaining long-term linear prediction efficiency of the current audio frame by means of estimation; acquiring reference linear prediction efficiency of N2 history audio frames of the current audio frame; and calculating a second statistical value of the reference linear prediction efficiency of the N2 history audio frames and the long-term linear prediction efficiency of the current audio frame, where N2 is a positive integer, the second statistical value is the reference long-term linear prediction efficiency of the current audio frame, reference linear prediction efficiency of each history audio frame of N1 history audio frames is at least one of the following linear prediction efficiency: reference long-term linear prediction efficiency, reference short-term linear prediction efficiency, and reference integrated linear prediction efficiency, and the N1 history audio frames are a subset of the N2 history audio frames; or the reference long-term linear prediction efficiency of the current audio frame is obtained by means of estimation in the following manner: obtaining long-term linear prediction efficiency of the current audio frame by means of estimation; acquiring reference linear prediction efficiency of N4 history audio frames of the current audio frame; acquiring linear prediction efficiency of N3 history audio frames of the current audio frame; and calculating a third statistical value of the linear prediction efficiency of the N3 history audio frames, the reference linear prediction efficiency of the N4 history audio frames, and the long-term linear prediction efficiency of the current audio frame, where N3 and N4 are positive integers, the third statistical value is the reference long-term linear prediction efficiency of the current audio frame, linear prediction efficiency of each history audio frame of N1 history audio frames is at least one of the following linear prediction efficiency: long-term linear prediction efficiency, short-term linear prediction efficiency, and integrated linear prediction efficiency, reference linear prediction efficiency of each history audio frame of N41 history audio frames is at least one of the following linear prediction efficiency: reference long-term linear prediction efficiency, reference short-term linear prediction efficiency, and reference integrated linear prediction efficiency, the N31 history audio frames are a subset of the N3 history audio frames, and the N41 history audio frames are a subset of the N4 history audio frames.

With reference to the first to the ninth possible implementation manners of the first aspect, in an eleventh possible implementation manner of the first aspect, the reference short-term linear prediction efficiency of the current audio frame is obtained by means of estimation in the following manner: estimating short-term linear prediction efficiency of the current audio frame, where the short-term linear prediction efficiency of the current audio frame is the reference short-term linear prediction efficiency of the current audio frame; or the reference short-term linear prediction efficiency of the current audio frame is obtained by means of estimation in the following manner: obtaining short-term linear prediction efficiency of the current audio frame by means of estimation; acquiring linear prediction efficiency of N5 history audio frames of the current audio frame; and calculating a fourth statistical value of the linear prediction efficiency of the N5 history audio frames and the short-term linear prediction efficiency of the current audio frame, where N5 is a positive integer, the fourth statistical value is the reference short-term linear prediction efficiency of the current audio frame, linear prediction efficiency of each history audio frame of N51 history audio frames is at least one of the following linear prediction efficiency: long-term linear prediction efficiency, short-term linear prediction efficiency, and integrated linear prediction efficiency, and the N51 history audio frames are a subset of the N5 history audio frames; or the reference short-term linear prediction efficiency of the current audio frame is obtained by means of estimation in the following manner: obtaining short-term linear prediction efficiency of the current audio frame by means of estimation; acquiring reference linear prediction efficiency of N6 history audio frames of the current audio frame; and calculating a fifth statistical value of the reference linear prediction efficiency of the N6 history audio frames and the short-term linear prediction efficiency of the current audio frame, where N6 is a positive integer, the fifth statistical value is the reference short-term linear prediction efficiency of the current audio frame, reference linear prediction efficiency of each history audio frame of N61 history audio frames is at least one of the following linear prediction efficiency: reference long-term linear prediction efficiency, reference short-term linear prediction efficiency, and reference integrated linear prediction efficiency, and the N61 history audio frames are a subset of the N6 history audio frames; or the reference short-term linear prediction efficiency of the current audio frame is obtained by means of estimation in the following manner: obtaining short-term linear prediction efficiency of the current audio frame by means of estimation; acquiring reference linear prediction efficiency of N8 history audio frames of the current audio frame; acquiring linear prediction efficiency of N7 history audio frames of the current audio frame; and calculating a sixth statistical value of the linear prediction efficiency of the N7 history audio frames, the reference linear prediction efficiency of the N8 history audio frames, and the short-term linear prediction efficiency of the current audio frame, where N7 and N8 are positive integers, the sixth statistical value is the reference short-term linear prediction efficiency of the current audio frame, linear prediction efficiency of each history audio frame of N71 history audio frames is at least one of the following linear prediction efficiency: long-term linear prediction efficiency, short-term linear prediction efficiency, and integrated linear prediction efficiency, reference linear prediction efficiency of each history audio frame of N81 history audio frames is at least one of the following linear prediction efficiency: reference long-term linear prediction efficiency, reference short-term linear prediction efficiency, and reference integrated linear prediction efficiency, the N71 history audio frames are a subset of the N7 history audio frames, and the N81 history audio frames are a subset of the N8 history audio frames.

With reference to the eleventh possible implementation manner of the first aspect, in a twelfth possible implementation manner of the first aspect, the obtaining short-term linear prediction efficiency of the current audio frame by means of estimation includes: obtaining the short-term linear prediction efficiency of the current audio frame based on a linear-prediction residual of the current audio frame.

With reference to the twelfth possible implementation manner of the first aspect, in a thirteenth possible implementation manner of the first aspect, the obtaining the short-term linear prediction efficiency of the current audio frame based on a linear-prediction residual of the current audio frame includes:

calculating a change rate of energy that are of the current audio frame and obtained before and after short-term linear prediction is performed on the current audio frame, where the energy change rate is the short-term linear prediction efficiency of the current audio frame, or the short-term linear prediction efficiency of the current audio frame is obtained by means of transformation based on the energy change rate, and the energy that is of the current audio frame and obtained after the short-term linear prediction is performed on the current audio frame is energy of the linear-prediction residual of the current audio frame.

With reference to the thirteenth possible implementation manner of the first aspect, in a fourteenth possible implementation manner of the first aspect, the change rate of the energy that are of the current audio frame and obtained before and after the short-term linear prediction is performed on the current audio frame is a ratio of the energy that is of the current audio frame and obtained before the short-term linear prediction is performed on the current audio frame to the energy of the linear-prediction residual of the current audio frame.

With reference to the tenth possible implementation manner of the first aspect, in a fifteenth possible implementation manner of the first aspect, the obtaining long-term linear prediction efficiency of the current audio frame by means of estimation includes: obtaining a correlation between a linear-prediction residual of the current audio frame and a first history linear prediction signal according to the linear-prediction residual of the current audio frame and the first history linear prediction signal, where the correlation is the long-term linear prediction efficiency of the current audio frame, or the long-term linear prediction efficiency of the current audio frame is obtained based on the correlation, the first history linear prediction signal is first history linear prediction excitation or a first history linear-prediction residual, the first history linear-prediction residual is a linear-prediction residual of a history audio frame of the current audio frame, and the first history linear prediction excitation is linear prediction excitation of the history audio frame of the current audio frame.

With reference to the fifteenth possible implementation manner of the first aspect, in a sixteenth possible implementation manner of the first aspect, the obtaining a correlation between a linear-prediction residual of the current audio frame and a first history linear prediction signal according to the linear-prediction residual of the current audio frame and the first history linear prediction signal includes:

calculating the correlation between the linear-prediction residual of the current audio frame and the first history linear prediction signal;

or multiplying the linear-prediction residual of the current audio frame by a gain factor to obtain a gained linear-prediction residual of the current audio frame, and obtaining a correlation between the gained linear-prediction residual of the current audio frame and the first history linear prediction signal by means of calculation, where the correlation, obtained by means of calculation, between the gained linear-prediction residual of the current audio frame and the first history linear prediction signal is the correlation between the linear-prediction residual of the current audio frame and the first history linear prediction signal; or multiplying the first history linear prediction signal by a gain factor to obtain a gained first history linear prediction signal, and obtaining a correlation between the linear-prediction residual of the current audio frame and the gained first history linear prediction signal by means of calculation, where the correlation, obtained by means of calculation, between the linear-prediction residual of the current audio frame and the gained first history linear prediction signal is the correlation between the linear-prediction residual of the current audio frame and the first history linear prediction signal.

With reference to the fifteenth possible implementation manner of the first aspect or the sixteenth possible implementation manner of the first aspect, in a seventeenth possible implementation manner of the first aspect, the first history linear prediction excitation or the first history linear-prediction residual is determined based on a pitch of the current audio frame.

With reference to the fifteenth to the seventeenth possible implementation manners of the first aspect, in an eighteenth possible implementation manner of the first aspect, a time-domain correlation between the first history linear prediction excitation and the linear-prediction residual of the current audio frame is greater than or equal to a time-domain correlation between other history linear prediction excitation and the linear-prediction residual of the current audio frame; or a time-domain correlation between the first history linear-prediction residual and the linear-prediction residual of the current audio frame is greater than or equal to a time-domain correlation between another history linear-prediction residual and the linear-prediction residual of the current audio frame.

With reference to the fifteenth to the eighteenth possible implementation manners of the first aspect, in a nineteenth possible implementation manner of the first aspect, the first history linear prediction excitation is linear prediction excitation generated by performing audio coding on the history audio frame of the current audio frame by using a linear prediction based coding scheme.

With reference to the fifteenth to the nineteenth possible implementation manners of the first aspect, in a twentieth possible implementation manner of the first aspect, the first history linear-prediction residual is obtained based on a time-domain signal of a first history audio frame of the current audio frame and a linear prediction coefficient of the first history audio frame, where a linear prediction coefficient of the first history audio frame is a quantized linear prediction coefficient or an unquantized linear prediction coefficient.

With reference to the fifteenth to the twentieth possible implementation manners of the first aspect, in a twenty-first possible implementation manner of the first aspect, the linear-prediction residual of the current audio frame is obtained based on a time-domain signal of the current audio frame and a linear prediction coefficient of the current audio frame, where the linear prediction coefficient of the current audio frame is a quantized linear prediction coefficient or an unquantized linear prediction coefficient.

With reference to the fifteenth to the twenty-first possible implementation manners of the first aspect, in a twenty-second possible implementation manner of the first aspect, the first history linear prediction excitation is superposed excitation of adaptive codebook excitation and fixed codebook excitation, or the first history linear prediction excitation is adaptive codebook excitation.

With reference to the fifteenth to the twenty-second possible implementation manners of the first aspect, in a twenty-third possible implementation manner of the first aspect, the correlation is a function value of a cross correlation in the time domain and/or a function value of a cross correlation in the frequency domain, or the correlation is time-domain distortion and/or frequency-domain distortion.

With reference to the twenty-third possible implementation manner of the first aspect, in a twenty-fourth possible implementation manner of the first aspect, the frequency-domain distortion is a sum value or a weighted sum value of distortion of K1 frequency bins in the frequency domain, or the frequency-domain distortion is a sum value or a weighted sum value of distortion of K2 sub-bands in the frequency domain, where K1 and K2 are positive integers.

With reference to the twenty-fourth possible implementation manner of the first aspect, in a twenty-fifth possible implementation manner of the first aspect, a weighting coefficient corresponding to the weighted sum value of the distortion is a perceptual weighting coefficient that reflects a psychoacoustic model.

A second aspect of the embodiments of the present disclosure provides an audio coder, including:

an estimation unit, configured to estimate reference linear prediction efficiency of a current audio frame;

a determining unit, configured to determine an audio coding scheme that matches the reference linear prediction efficiency of the current audio frame that is estimated by the estimation unit; and a coding unit, configured to perform audio coding on the current audio frame according to the audio coding scheme that matches the reference linear prediction efficiency of the current audio frame and that is determined by the determining unit.

With reference to the second aspect, in a first possible implementation manner of the second aspect, the reference linear prediction efficiency includes at least one of the following linear prediction efficiency: reference long-term linear prediction efficiency, reference short-term linear prediction efficiency, and reference integrated linear prediction efficiency.

With reference to the first possible implementation manner of the second aspect, in a second possible implementation manner of the second aspect, the reference integrated linear prediction efficiency is a sum value, a weighted sum value, or an average value of the reference long-term linear prediction efficiency and the reference short-term linear prediction efficiency.

With reference to the first possible implementation manner of the second aspect, in a third possible implementation manner of the second aspect, if the reference linear prediction efficiency of the current audio frame includes reference long-term linear prediction efficiency of the current audio frame and reference short-term linear prediction efficiency of the current audio frame, the determining unit is specifically configured to:

if the reference long-term linear prediction efficiency of the current audio frame is less than a first threshold and/or the reference short-term linear prediction efficiency of the current audio frame is less than a second threshold, determine that the audio coding scheme that matches the reference linear prediction efficiency of the current audio frame is an audio coding scheme not based on linear prediction;

and/or if the reference long-term linear prediction efficiency of the current audio frame is greater than or equal to a first threshold and/or the reference short-term linear prediction efficiency of the current audio frame is greater than or equal to a second threshold, determine that the audio coding scheme that matches the reference linear prediction efficiency of the current audio frame is a linear prediction based audio coding scheme.

With reference to the first possible implementation manner of the second aspect, in a fourth possible implementation manner of the second aspect, if the reference linear prediction efficiency of the current audio frame includes reference long-term linear prediction efficiency of the current audio frame, the determining unit is specifically configured to:

if the reference long-term linear prediction efficiency of the current audio frame is greater than or equal to a third threshold, determine that the audio coding scheme that matches the reference linear prediction efficiency of the current audio frame is a linear prediction based audio coding scheme; and/or if the reference long-term linear prediction efficiency of the current audio frame is less than a fourth threshold, determine that the audio coding scheme that matches the reference linear prediction efficiency of the current audio frame is an audio coding scheme not based on linear prediction.

With reference to the first possible implementation manner of the second aspect, in a fifth possible implementation manner of the second aspect, if the reference linear prediction efficiency of the current audio frame includes reference long-term linear prediction efficiency of the current audio frame, the determining unit is specifically configured to: determine a first linear prediction efficiency interval within which the reference long-term linear prediction efficiency of the current audio frame falls, and determine, according to a mapping relationship between a linear prediction efficiency interval and a linear prediction based audio coding scheme, a first audio coding scheme that is in a mapping relationship with the first linear prediction efficiency interval, where the first audio coding scheme is an audio coding scheme that matches the reference linear prediction efficiency of the current audio frame, and the first audio coding scheme is a linear prediction based audio coding scheme or an audio coding scheme not based on linear prediction.

With reference to the first possible implementation manner of the second aspect, in a sixth possible implementation manner of the second aspect, if the reference linear prediction efficiency of the current audio frame includes reference short-term linear prediction efficiency of the current audio frame, the determining unit is specifically configured to:

if the reference short-term linear prediction efficiency of the current audio frame is greater than or equal to a fifth threshold, determine that the audio coding scheme that matches the reference linear prediction efficiency of the current audio frame is a linear prediction based audio coding scheme; and/or if the reference short-term linear prediction efficiency of the current audio frame is less than a fifth threshold, determine that the audio coding scheme that matches the reference linear prediction efficiency of the current audio frame is an audio coding scheme not based on linear prediction.

With reference to the first possible implementation manner of the second aspect, in a seventh possible implementation manner of the second aspect, if the reference linear prediction efficiency of the current audio frame includes reference short-term linear prediction efficiency of the current audio frame, the determining unit is specifically configured to: determine a second linear prediction efficiency interval within which the reference short-term linear prediction efficiency of the current audio frame falls, and determine, according to a mapping relationship between a linear prediction efficiency interval and a linear prediction based audio coding scheme, a second audio coding scheme that is in a mapping relationship with the second linear prediction efficiency interval, where the second audio coding scheme is an audio coding scheme that matches the reference linear prediction efficiency of the current audio frame, and the second audio coding scheme is a linear prediction based audio coding scheme or an audio coding scheme not based on linear prediction.

With reference to the first possible implementation manner of the second aspect or the second possible implementation manner of the second aspect, in an eighth possible implementation manner of the second aspect, if the reference linear prediction efficiency of the current audio frame includes reference integrated linear prediction efficiency of the current audio frame, the determining unit is specifically configured to:

if the reference integrated linear prediction efficiency of the current audio frame is greater than or equal to a sixth threshold, determine that the audio coding scheme that matches the reference linear prediction efficiency of the current audio frame is a linear prediction based audio coding scheme; and/or if the reference integrated linear prediction efficiency of the current audio frame is less than a sixth threshold, determine that the audio coding scheme that matches the reference linear prediction efficiency of the current audio frame is an audio coding scheme not based on linear prediction.

With reference to the first possible implementation manner of the second aspect or the second possible implementation manner of the second aspect, in a ninth possible implementation manner of the second aspect, if the reference linear prediction efficiency of the current audio frame includes reference integrated linear prediction efficiency of the current audio frame, the determining unit is specifically configured to: determine a third linear prediction efficiency interval within which the reference integrated linear prediction efficiency of the current audio frame falls, and determine, according to a mapping relationship between a linear prediction efficiency interval and a linear prediction based audio coding scheme, a third audio coding scheme that is in a mapping relationship with the third linear prediction efficiency interval, where the third audio coding scheme is an audio coding scheme that matches the reference linear prediction efficiency of the current audio frame, and the third audio coding scheme is a linear prediction based audio coding scheme or an audio coding scheme not based on linear prediction.

With reference to the first to the ninth possible implementation manners of the second aspect, in a tenth possible implementation manner of the second aspect, in an aspect of estimating the reference long-term linear prediction efficiency of the current audio frame, the estimation unit is specifically configured to: estimate long-term linear prediction efficiency of the current audio frame, where the long-term linear prediction efficiency of the current audio frame is the reference long-term linear prediction efficiency of the current audio frame; or in an aspect of estimating the reference long-term linear prediction efficiency of the current audio frame, the estimation unit is specifically configured to: obtain long-term linear prediction efficiency of the current audio frame by means of estimation; acquire linear prediction efficiency of N1 history audio frames of the current audio frame; and calculate a first statistical value of the linear prediction efficiency of the N1 history audio frames and the long-term linear prediction efficiency of the current audio frame, where N1 is a positive integer, the first statistical value is the reference long-term linear prediction efficiency of the current audio frame, linear prediction efficiency of each history audio frame of N1 history audio frames is at least one of the following linear prediction efficiency: long-term linear prediction efficiency, short-term linear prediction efficiency, and integrated linear prediction efficiency, and the N1 history audio frames are a subset of the N1 history audio frames; or in an aspect of estimating the reference long-term linear prediction efficiency of the current audio frame, the estimation unit is specifically configured to: obtain long-term linear prediction efficiency of the current audio frame by means of estimation; acquire reference linear prediction efficiency of N2 history audio frames of the current audio frame; and calculate a second statistical value of the reference linear prediction efficiency of the N2 history audio frames and the long-term linear prediction efficiency of the current audio frame, where N2 is a positive integer, the second statistical value is the reference long-term linear prediction efficiency of the current audio frame, reference linear prediction efficiency of each history audio frame of N1 history audio frames is at least one of the following linear prediction efficiency: reference long-term linear prediction efficiency, reference short-term linear prediction efficiency, and reference integrated linear prediction efficiency, and the N1 history audio frames are a subset of the N2 history audio frames; or in an aspect of estimating the reference long-term linear prediction efficiency of the current audio frame, the estimation unit is specifically configured to: obtain long-term linear prediction efficiency of the current audio frame by means of estimation; acquire reference linear prediction efficiency of N4 history audio frames of the current audio frame; acquire linear prediction efficiency of N3 history audio frames of the current audio frame; and calculate a third statistical value of the linear prediction efficiency of the N3 history audio frames, the reference linear prediction efficiency of the N4 history audio frames, and the long-term linear prediction efficiency of the current audio frame, where N3 and N4 are positive integers, the third statistical value is the reference long-term linear prediction efficiency of the current audio frame, linear prediction efficiency of each history audio frame of N1 history audio frames is at least one of the following linear prediction efficiency: long-term linear prediction efficiency, short-term linear prediction efficiency, and integrated linear prediction efficiency, reference linear prediction efficiency of each history audio frame of N41 history audio frames is at least one of the following linear prediction efficiency: reference long-term linear prediction efficiency, reference short-term linear prediction efficiency, and reference integrated linear prediction efficiency, the N1 history audio frames are a subset of the N3 history audio frames, and the N41 history audio frames are a subset of the N4 history audio frames.

With reference to the first to the ninth possible implementation manners of the second aspect, in an eleventh possible implementation manner of the second aspect, in an aspect of estimating the reference short-term linear prediction efficiency of the current audio frame, the estimation unit is specifically configured to: estimate short-term linear prediction efficiency of the current audio frame, where the short-term linear prediction efficiency of the current audio frame is the reference short-term linear prediction efficiency of the current audio frame;

or in an aspect of estimating the reference short-term linear prediction efficiency of the current audio frame, the estimation unit is specifically configured to: obtain short-term linear prediction efficiency of the current audio frame by means of estimation; acquire linear prediction efficiency of N5 history audio frames of the current audio frame; and calculate a fourth statistical value of the linear prediction efficiency of the N5 history audio frames and the short-term linear prediction efficiency of the current audio frame, where N5 is a positive integer, the fourth statistical value is the reference short-term linear prediction efficiency of the current audio frame, linear prediction efficiency of each history audio frame of N51 history audio frames is at least one of the following linear prediction efficiency: long-term linear prediction efficiency, short-term linear prediction efficiency, and integrated linear prediction efficiency, and the N51 history audio frames are a subset of the N5 history audio frames; or in an aspect of estimating the reference short-term linear prediction efficiency of the current audio frame, the estimation unit is specifically configured to: obtain short-term linear prediction efficiency of the current audio frame by means of estimation; acquire reference linear prediction efficiency of N6history audio frames of the current audio frame; and calculate a fifth statistical value of the reference linear prediction efficiency of the N6 history audio frames and the short-term linear prediction efficiency of the current audio frame, where N6 is a positive integer, the fifth statistical value is the reference short-term linear prediction efficiency of the current audio frame, reference linear prediction efficiency of each history audio frame of N61 history audio frames is at least one of the following linear prediction efficiency: reference long-term linear prediction efficiency, reference short-term linear prediction efficiency, and reference integrated linear prediction efficiency, and the N61 history audio frames are a subset of the N6 history audio frames; or in an aspect of estimating the reference short-term linear prediction efficiency of the current audio frame, the estimation unit is specifically configured to: obtain short-term linear prediction efficiency of the current audio frame by means of estimation; acquire reference linear prediction efficiency of N8 history audio frames of the current audio frame; acquire linear prediction efficiency of N7 history audio frames of the current audio frame; and calculate a sixth statistical value of the linear prediction efficiency of the N7 history audio frames, the reference linear prediction efficiency of the N8 history audio frames, and the short-term linear prediction efficiency of the current audio frame, where N7 and N8 are positive integers, the sixth statistical value is the reference short-term linear prediction efficiency of the current audio frame, linear prediction efficiency of each history audio frame of N71 history audio frames is at least one of the following linear prediction efficiency: long-term linear prediction efficiency, short-term linear prediction efficiency, and integrated linear prediction efficiency, reference linear prediction efficiency of each history audio frame of N81 history audio frames is at least one of the following linear prediction efficiency: reference long-term linear prediction efficiency, reference short-term linear prediction efficiency, and reference integrated linear prediction efficiency, the N71 history audio frames are a subset of the N7 history audio frames, and the N81 history audio frames are a subset of the N8 history audio frames.

With reference to the eleventh possible implementation manner of the second aspect, in a twelfth possible implementation manner of the second aspect, in the aspect of obtaining short-term linear prediction efficiency of the current audio frame by means of estimation, the estimation unit is specifically configured to obtain the short-term linear prediction efficiency of the current audio frame based on a linear-prediction residual of the current audio frame.

With reference to the twelfth possible implementation manner of the second aspect, in a thirteenth possible implementation manner of the second aspect, in the aspect of obtaining the short-term linear prediction efficiency of the current audio frame based on a linear-prediction residual of the current audio frame, the estimation unit is specifically configured to calculate a change rate of energy that are of the current audio frame and obtained before and after short-term linear prediction is performed on the current audio frame, where the energy change rate is the short-term linear prediction efficiency of the current audio frame, or the short-term linear prediction efficiency of the current audio frame is obtained by means of transformation based on the energy change rate, and the energy that is of the current audio frame and obtained after the short-term linear prediction is performed on the current audio frame is energy of the linear-prediction residual of the current audio frame.

With reference to the thirteenth possible implementation manner of the second aspect, in a fourteenth possible implementation manner of the second aspect, the change rate of the energy that are of the current audio frame and obtained before and after the short-term linear prediction is performed on the current audio frame is a ratio of the energy that is of the current audio frame and obtained before the short-term linear prediction is performed on the current audio frame to the energy of the linear-prediction residual of the current audio frame.

With reference to the tenth possible implementation manner of the second aspect, in a fifteenth possible implementation manner of the second aspect, in the aspect of obtaining long-term linear prediction efficiency of the current audio frame by means of estimation, the estimation unit is specifically configured to: obtain a correlation between a linear-prediction residual of the current audio frame and a first history linear prediction signal according to calculating the linear-prediction residual of the current audio frame and the first history linear prediction signal, where the correlation is the long-term linear prediction efficiency of the current audio frame, or the long-term linear prediction efficiency of the current audio frame is obtained based on the correlation, the first history linear prediction signal is first history linear prediction excitation or a first history linear-prediction residual, the first history linear-prediction residual is a linear-prediction residual of a history audio frame of the current audio frame, and the first history linear prediction excitation is linear prediction excitation of the history audio frame of the current audio frame.

With reference to the fifteenth possible implementation manner of the second aspect, in a sixteenth possible implementation manner of the second aspect, in the aspect of obtaining a correlation between a linear-prediction residual of the current audio frame and a first history linear prediction signal according to calculating the linear-prediction residual of the current audio frame and the first history linear prediction signal, the estimation unit is specifically configured to: calculate the correlation between the linear-prediction residual of the current audio frame and the first history linear prediction signal; or multiply the linear-prediction residual of the current audio frame by a gain factor to obtain a gained linear-prediction residual of the current audio frame, and obtain a correlation between the gained linear-prediction residual of the current audio frame and the first history linear prediction signal by means of calculation, where the correlation, obtained by means of calculation, between the gained linear-prediction residual of the current audio frame and the first history linear prediction signal is the correlation between the linear-prediction residual of the current audio frame and the first history linear prediction signal; or multiply the first history linear prediction signal by a gain factor to obtain a gained first history linear prediction signal, and obtain a correlation between the linear-prediction residual of the current audio frame and the gained first history linear prediction signal by means of calculation, where the correlation, obtained by means of calculation, between the linear-prediction residual of the current audio frame and the gained first history linear prediction signal is the correlation between the linear-prediction residual of the current audio frame and the first history linear prediction signal.

With reference to the fifteenth possible implementation manner of the second aspect or the sixteenth possible implementation manner of the second aspect, in a seventeenth possible implementation manner of the second aspect, the first history linear prediction excitation or the first history linear-prediction residual is determined based on a pitch of the current audio frame.

With reference to the fifteenth to the seventeenth possible implementation manners of the second aspect, in an eighteenth possible implementation manner of the second aspect, a time-domain correlation between the first history linear prediction excitation and the linear-prediction residual of the current audio frame is greater than or equal to a time-domain correlation between other history linear prediction excitation and the linear-prediction residual of the current audio frame; or a time-domain correlation between the first history linear-prediction residual and the linear-prediction residual of the current audio frame is greater than or equal to a time-domain correlation between another history linear-prediction residual and the linear-prediction residual of the current audio frame.

With reference to the fifteenth to the eighteenth possible implementation manners of the second aspect, in a nineteenth possible implementation manner of the second aspect, the first history linear prediction excitation is linear prediction excitation generated by performing audio coding on the history audio frame of the current audio frame by using a linear prediction based coding scheme.

With reference to the fifteenth to the nineteenth possible implementation manners of the second aspect, in a twentieth possible implementation manner of the second aspect, the first history linear-prediction residual is obtained based on a time-domain signal of a first history audio frame of the current audio frame and a linear prediction coefficient of the first history audio frame, where a linear prediction coefficient of the first history audio frame is a quantized linear prediction coefficient or an unquantized linear prediction coefficient.

With reference to the fifteenth to the twentieth possible implementation manners of the second aspect, in a twenty-first possible implementation manner of the second aspect, the linear-prediction residual of the current audio frame is obtained based on a time-domain signal of the current audio frame and a linear prediction coefficient of the current audio frame, where the linear prediction coefficient of the current audio frame is a quantized linear prediction coefficient or an unquantized linear prediction coefficient.

With reference to the fifteenth to the twenty-first possible implementation manners of the second aspect, in a twenty-second possible implementation manner of the second aspect, the first history linear prediction excitation is superposed excitation of adaptive codebook excitation and fixed codebook excitation, or the first history linear prediction excitation is adaptive codebook excitation.

With reference to the fifteenth to the twenty-second possible implementation manners of the second aspect, in a twenty-third possible implementation manner of the second aspect, the correlation is a function value of a cross correlation in the time domain and/or a function value of a cross correlation in the frequency domain, or the correlation is time-domain distortion and/or frequency-domain distortion.

With reference to the twenty-third possible implementation manner of the second aspect, in a twenty-fourth possible implementation manner of the second aspect, the frequency-domain distortion is a sum value or a weighted sum value of distortion of K1 frequency bins in the frequency domain, or the frequency-domain distortion is a sum value or a weighted sum value of distortion of K2 sub-bands in the frequency domain, where K1 and K2 are positive integers.

With reference to the twenty-fourth possible implementation manner of the second aspect, in a twenty-fifth possible implementation manner of the second aspect, a weighting coefficient corresponding to the weighted sum value of the distortion is a perceptual weighting coefficient that reflects a psychoacoustic model.

It can be learned that in the technical solutions of some embodiments of the present disclosure, reference linear prediction efficiency of a current audio frame is first estimated; an audio coding scheme that matches the estimated reference linear prediction efficiency is determined by using the estimated reference linear prediction efficiency of the foregoing current audio frame; and audio coding is performed on the foregoing current audio frame according to the determined audio coding scheme that matches the estimated reference linear prediction efficiency. In a process of determining the audio coding scheme in the foregoing solution, an operation, required to be executed in an existing closed-loop selection mode, of performing complete coding on the current audio frame by using each audio coding scheme does not need to be executed; instead, the audio coding scheme that needs to be selected is determined by using the reference linear prediction efficiency of the current audio frame. Calculation complexity of estimating the reference linear prediction efficiency of the current audio frame is generally far less than calculation complexity of performing complete coding on the current audio frame by using each audio coding scheme. Therefore, compared with an existing mechanism, the foregoing technical solutions in the embodiments of the present disclosure help reduce operation complexity of audio coding, and further reduce overheads of audio coding.

BRIEF DESCRIPTION OF DRAWINGS

To describe the technical solutions in the embodiments of the present disclosure more clearly, the following briefly describes the accompanying drawings required for describing the embodiments. Apparently, the accompanying drawings in the following description show merely some embodiments of the present disclosure, and persons of ordinary skill in the art may still derive other drawings from these accompanying drawings without creative efforts.

FIG. 3-*a* is a schematic structural diagram of an audio coder according to an embodiment of the present disclosure;

FIG. 3-*b* is a schematic structural diagram of another audio coder according to another embodiment of the present disclosure;

FIG. 3-*c* is a schematic structural diagram of another audio coder according to another embodiment of the present disclosure;

FIG. 3-*d* is a schematic structural diagram of another audio coder according to another embodiment of the present disclosure;

FIG. 3-*e* is a schematic structural diagram of another audio coder according to another embodiment of the present disclosure;

FIG. 3-*f* is a schematic structural diagram of another audio coder according to another embodiment of the present disclosure;

FIG. 3-*g* is a schematic structural diagram of another audio coder according to another embodiment of the present disclosure;

FIG. 3-*h* is a schematic structural diagram of another audio coder according to another embodiment of the present disclosure;

FIG. 3-*i* is a schematic structural diagram of another audio coder according to another embodiment of the present disclosure;

DESCRIPTION OF EMBODIMENTS

Embodiments of the present disclosure provide an audio coding method and a related apparatus, to reduce overheads of audio coding.

To make persons skilled in the art understand the technical solutions in the present disclosure better, the following clearly describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by persons of ordinary skill in the art based on the embodiments of the present disclosure without creative efforts shall fall within the protection scope of the present disclosure.

Details are described in the following separately.

In the specification, claims, and accompanying drawings of the present disclosure, the terms "first", "second", "third", "fourth", and so on are intended to distinguish between different objects but do not indicate particular order. In addition, the terms "include", "have", and any other variants thereof are intended to cover a non-exclusive inclusion. For example, a process, a method, a system, a product, or a device that includes a series of steps or units is not limited to the listed steps or units, but optionally further includes an unlisted step or unit, or optionally further includes another inherent step or unit of the process, the method, the product, or the device.

The following first describes the audio coding method provided in the embodiments of the present disclosure. The audio coding method provided in the embodiments of the present disclosure may be executed by an audio coder, where the audio coder may be any apparatus that needs to collect, store, or transmit outwards an audio signal, for example, a mobile phone, a tablet computer, a personal computer, or a notebook computer.

In an embodiment of the audio coding method in the present disclosure, the audio coding method may include: estimating reference linear prediction efficiency of a current audio frame; determining an audio coding scheme that matches the reference linear prediction efficiency of the foregoing current audio frame; and performing audio coding on the foregoing current audio frame according to the audio coding scheme that matches the reference linear prediction efficiency of the foregoing current audio frame.

Figure 1:
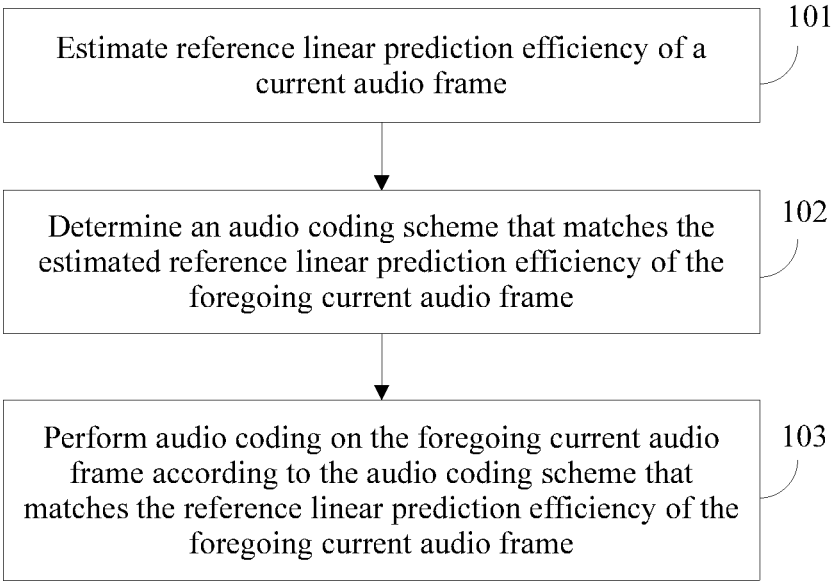
FIG. 1 is a schematic flowchart of an audio coding method according to an embodiment of the present disclosure.

First, referring to FIG. 1, FIG. 1 is a schematic flowchart of an audio coding method according to an embodiment of the present disclosure. As shown in FIG. 1, the audio coding method provided in this embodiment of the present disclosure may include the following content:

101. Estimate reference linear prediction efficiency of a current audio frame.

In an actual application, the reference linear prediction efficiency of the current audio frame may be estimated by using multiple available algorithms.

In the embodiments of the present disclosure, reference linear prediction efficiency of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher reference linear prediction efficiency of an audio frame (for example, a current audio frame or a history audio frame of a current audio frame) indicates a larger extent to which linear prediction can be performed on the audio frame.

In some embodiments of the present disclosure, the foregoing reference linear prediction efficiency includes at least one of the following linear prediction efficiency: reference long-term linear prediction efficiency, reference short-term linear prediction efficiency, and reference integrated linear prediction efficiency, where the foregoing reference integrated linear prediction efficiency is obtained based on the foregoing reference long-term linear prediction efficiency and the foregoing reference short-term linear prediction efficiency.

Reference long-term linear prediction efficiency of the current audio frame may be obtained based on long-term linear prediction efficiency of the current audio frame, reference short-term linear prediction efficiency of the current audio frame may be obtained based on short-term linear prediction efficiency of the current audio frame, and reference integrated linear prediction efficiency of the current audio frame may be obtained, for example, based on long-term linear prediction efficiency and short-term linear prediction efficiency of the current audio frame.

It may be understood that, a value range of the reference linear prediction efficiency may be 0-1 (that is, 0-100%), or a value range may be 0-x1 (where x1 is a positive number); a value range of the reference long-term linear prediction efficiency may be 0-1 (that is, 0-100%), or a value range may be 0-x2 (where x2 is a positive number); a value range of the reference short-term linear prediction efficiency may be 0-1 (that is, 0-100%), or a value range may be 0-x3 (where x3 is a positive number); a value range of the reference integrated linear prediction efficiency may be 0-1 (that is, 0-100%), or a value range may be 0-x4 (where x4 is a positive number); a value range of the long-term linear prediction efficiency may be 0-1 (that is, 0-100%), or a value range may be 0-x5 (where x5 is a positive number); and a value range of the short-term linear prediction efficiency may be 0-1 (that is, 0-100%), or a value range may be 0-x6 (where x6 is a positive number), where x1, x2, x3, x4, x5, or x6 may be, for example, 0.5, 0.8, 1.5, 2, 5, 10, 50, 100, or another positive number. For ease of description, an example in which a value range of linear prediction efficiency is 0-1 (that is, 0-100%) is mainly used in the following, and another value range may be deduced from this.

102. Determine an audio coding scheme that matches the estimated reference linear prediction efficiency of the foregoing current audio frame.

In some embodiments of the present disclosure, there may be a set mapping relationship between an audio coding scheme and reference linear prediction efficiency of an audio frame. For example, different audio coding schemes may be corresponding to different reference linear prediction efficiency, or different audio coding schemes may be corresponding to different reference linear prediction efficiency intervals. For example, the audio coding scheme that matches the estimated reference linear prediction efficiency of the foregoing current audio frame may be determined from at least two audio coding schemes.

103. Perform audio coding on the foregoing current audio frame according to the audio coding scheme that matches the reference linear prediction efficiency of the foregoing current audio frame.

In some embodiments of the present disclosure, before the reference linear prediction efficiency of the current audio frame is estimated, whether the current audio frame is a speech and audio frame may be first determined. For example, the estimating reference linear prediction efficiency of a current audio frame may include: estimating the reference linear prediction efficiency of the foregoing current audio frame when the current audio frame is a non-speech and audio frame. In addition, before the reference linear prediction efficiency of the current audio frame is estimated, whether the current audio frame is a speech and audio frame may not be distinguished, that is, step 101 to step 103 are executed regardless of whether the current audio frame is a speech and audio frame or a non-speech and audio frame.

It can be learned that in the technical solution in this embodiment, reference linear prediction efficiency of a current audio frame is first estimated; an audio coding scheme that matches the estimated reference linear prediction efficiency is determined by using the estimated reference linear prediction efficiency of the foregoing current audio frame; and audio coding is performed on the foregoing current audio frame according to the determined audio coding scheme that matches the estimated reference linear prediction efficiency. In a process of determining the audio coding scheme in the foregoing solution, an operation, required to be executed in an existing closed-loop selection mode, of performing complete coding on the current audio frame by using each audio coding scheme does not need to be executed; instead, the audio coding scheme that needs to be selected is determined by using the reference linear prediction efficiency of the current audio frame. Calculation complexity of estimating the reference linear prediction efficiency of the current audio frame is generally far less than calculation complexity of performing complete coding on the current audio frame by using each audio coding scheme. Therefore, compared with an existing mechanism, the foregoing solution in this embodiment of the present disclosure helps reduce operation complexity of audio coding, and further reduce overheads of audio coding.

In some embodiments of the present disclosure, reference integrated linear prediction efficiency of an audio frame (for example, a current audio frame or another audio frame) is obtained based on reference long-term linear prediction efficiency of the audio frame and reference short-term linear prediction efficiency of the audio frame. For example, the reference integrated linear prediction efficiency of the foregoing current audio frame may be, for example, a sum value, a weighted sum value (where a weighted value corresponding to the weighted sum value herein may be set according to an actual requirement, and a weighted value may be, for example, 0.5, 1, 2, 3, 5, 10, or another value), or an average value of the reference long-term linear prediction efficiency of the foregoing current audio frame and the reference short-term linear prediction efficiency of the current audio frame. Certainly, the reference integrated linear prediction efficiency of the foregoing current audio frame may also be obtained, by using another algorithm, based on the reference long-term linear prediction efficiency of the foregoing current audio frame and the reference short-term linear prediction efficiency of the current audio frame.

In some embodiments of the present disclosure, a linear prediction based audio coding scheme may include algebraic code excited linear prediction (ACELP) coding, transform coded excitation (TCX), and the like; an audio coding scheme not based on linear prediction may include generic audio coding (GAC), where the GAC may include, for example, modified discrete cosine transform (MDCT) coding or discrete cosine transform (DCT) coding.

It may be understood that because the reference linear prediction efficiency of the foregoing current audio frame includes different types of linear prediction efficiency, there may be different specific manners of determining the audio coding scheme that matches the reference linear prediction efficiency of the foregoing current audio frame. The following illustrates some possible implementation manners by using examples.

For example, in some embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining an audio coding scheme that matches the reference linear prediction efficiency of the foregoing current audio frame may include: if the reference long-term linear prediction efficiency of the foregoing current audio frame is less than a first threshold and/or the reference short-term linear prediction efficiency of the foregoing current audio frame is less than a second threshold, determining that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining an audio coding scheme that matches the reference linear prediction efficiency of the foregoing current audio frame may include: if the reference long-term linear prediction efficiency of the foregoing current audio frame is greater than or equal to a first threshold and/or the reference short-term linear prediction efficiency of the foregoing current audio frame is greater than or equal to a second threshold, determining that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining an audio coding scheme that matches the reference linear prediction efficiency of the foregoing current audio frame may include: if the reference long-term linear prediction efficiency of the foregoing current audio frame is less than a first threshold and/or the reference short-term linear prediction efficiency of the foregoing current audio frame is less than a second threshold, determining that the audio coding scheme that matches the reference linear prediction efficiency of the foregoing current audio frame is an audio coding scheme not based on linear prediction; or if the reference long-term linear prediction efficiency of the foregoing current audio frame is greater than or equal to a first threshold and/or the reference short-term linear prediction efficiency of the foregoing current audio frame is greater than or equal to a second threshold, determining that the audio coding scheme that matches the reference linear prediction efficiency of the foregoing current audio frame is a linear prediction based audio coding scheme.

For another example, in some embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: if the reference long-term linear prediction efficiency of the foregoing current audio frame is greater than or equal to a third threshold, determining that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: if the reference long-term linear prediction efficiency of the foregoing current audio frame is less than a fourth threshold, determining that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: if the reference long-term linear prediction efficiency of the foregoing current audio frame is greater than or equal to a third threshold, determining that the audio coding scheme that matches the reference linear prediction efficiency of the foregoing current audio frame is a linear prediction based audio coding scheme; or if the reference long-term linear prediction efficiency of the foregoing current audio frame is less than a fourth threshold, determining that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: determining a first linear prediction efficiency interval within which the reference long-term linear prediction efficiency of the foregoing current audio frame falls, and determining, according to a mapping relationship between a linear prediction efficiency interval and a linear prediction based audio coding scheme, a first audio coding scheme that is in a mapping relationship with the foregoing first linear prediction efficiency interval, where the foregoing first audio coding scheme is an audio coding scheme that matches the reference linear prediction efficiency of the foregoing current audio frame, and the foregoing first audio coding scheme is a linear prediction based audio coding scheme or an audio coding scheme not based on linear prediction. Different linear prediction efficiency intervals are corresponding to different audio coding schemes. For example, it is assumed that there are three linear prediction efficiency intervals, which may be 0-30% GAC, 30-70% TCX, and 70-100% ACELP respectively. If the reference long-term linear prediction efficiency of the foregoing current audio frame falls within the linear prediction efficiency interval 0-30% (that is, the first linear prediction efficiency interval is the linear prediction efficiency interval 0-30%), it may be determined that an audio coding scheme corresponding to the linear prediction efficiency interval 0-30% is the audio coding scheme (for example, GAC) that matches the reference linear prediction efficiency of the foregoing current audio frame. If the reference long-term linear prediction efficiency of the foregoing current audio frame falls within the linear prediction efficiency interval 30-70% (that is, the first linear prediction efficiency interval is the linear prediction efficiency interval 30-70%), it may be determined that an audio coding scheme (for example, TCX) corresponding to the linear prediction efficiency interval 30-70% is the audio coding scheme that matches the reference linear prediction efficiency of the foregoing current audio frame. If the reference long-term linear prediction efficiency of the foregoing current audio frame falls within the linear prediction efficiency interval 70-100% (that is, the first linear prediction efficiency interval is the linear prediction efficiency interval 70-100%), it may be determined that an audio coding scheme (for example, ACELP coding) corresponding to the linear prediction efficiency interval 70-100% is the audio coding scheme that matches the reference linear prediction efficiency of the foregoing current audio frame, and another scenario may be deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame may include: if the reference short-term linear prediction efficiency of the foregoing current audio frame is greater than or equal to a fifth threshold, determining that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame may include: if the reference short-term linear prediction efficiency of the foregoing current audio frame is less than a fifth threshold, determining that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame may include: if the reference short-term linear prediction efficiency of the foregoing current audio frame is greater than or equal to a fifth threshold, determining that the audio coding scheme that matches the reference linear prediction efficiency of the foregoing current audio frame is a linear prediction based audio coding scheme; or if the reference short-term linear prediction efficiency of the foregoing current audio frame is less than a fifth threshold, determining that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame includes: determining a second linear prediction efficiency interval within which the reference short-term linear prediction efficiency of the foregoing current audio frame falls, and determining, according to a mapping relationship between a linear prediction efficiency interval and a linear prediction based audio coding scheme, a second audio coding scheme that is in a mapping relationship with the foregoing second linear prediction efficiency interval or an audio coding scheme not based on linear prediction, where the foregoing second audio coding scheme is an audio coding scheme that matches the reference linear prediction efficiency of the foregoing current audio frame, and the foregoing second audio coding scheme is a linear prediction based audio coding scheme. For example, it is assumed that there are three linear prediction efficiency intervals, which may be 0-40%, 40-60%, and 60-100% respectively. If the reference short-term linear prediction efficiency of the foregoing current audio frame falls within the linear prediction efficiency interval 0-40% (that is, the second linear prediction efficiency interval is the linear prediction efficiency interval 0-40%), it may be determined that an audio coding scheme (for example, GAC) corresponding to the linear prediction efficiency interval 0-40% is the audio coding scheme that matches the reference linear prediction efficiency of the foregoing current audio frame. If the reference short-term linear prediction efficiency of the foregoing current audio frame falls within the linear prediction efficiency interval 40-60% (that is, the second linear prediction efficiency interval is the linear prediction efficiency interval 40-60%), it is determined that an audio coding scheme (for example, TCX) corresponding to the linear prediction efficiency interval 40-60% is the audio coding scheme that matches the reference linear prediction efficiency of the foregoing current audio frame. If the reference short-term linear prediction efficiency of the foregoing current audio frame falls within the linear prediction efficiency interval 60-100% (that is, the second linear prediction efficiency interval is the linear prediction efficiency interval 60-100%), it is determined that an audio coding scheme (for example, ACELP coding) corresponding to the linear prediction efficiency interval 60-100% is the audio coding scheme that matches the reference linear prediction efficiency of the foregoing current audio frame, and another scenario may be deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame may include: if the reference integrated linear prediction efficiency of the foregoing current audio frame is greater than or equal to a sixth threshold, determining that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame may include: if the reference integrated linear prediction efficiency of the foregoing current audio frame is less than a sixth threshold, determining that the audio coding scheme that matches the reference linear prediction efficiency of the foregoing current audio frame is an audio coding scheme not based on linear prediction.

For another example, in still other embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame may include: if the reference integrated linear prediction efficiency of the foregoing current audio frame is greater than or equal to a sixth threshold, determining that the audio coding scheme that matches the reference linear prediction efficiency of the foregoing current audio frame is a linear prediction based audio coding scheme; or if the reference integrated linear prediction efficiency of the foregoing current audio frame is less than a sixth threshold, determining that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame includes: determining a third linear prediction efficiency interval within which the reference integrated linear prediction efficiency of the foregoing current audio frame falls, and determining, according to a mapping relationship between a linear prediction efficiency interval and a linear prediction based audio coding scheme, a third audio coding scheme that is in a mapping relationship with the foregoing third linear prediction efficiency interval or an audio coding scheme not based on linear prediction, where the foregoing third audio coding scheme is an audio coding scheme that matches the reference linear prediction efficiency of the foregoing current audio frame, and the foregoing third audio coding scheme is a linear prediction based audio coding scheme. For example, it is assumed that there are three linear prediction efficiency intervals, which may be 0-50%, 50-80%, and 80-100% respectively. If the reference integrated linear prediction efficiency of the foregoing current audio frame falls within the linear prediction efficiency interval 0-50% (that is, the third linear prediction efficiency interval is the linear prediction efficiency interval 0-50%), it may be determined that an audio coding scheme (for example, GAC) corresponding to the linear prediction efficiency interval 0-50% is the audio coding scheme that matches the reference linear prediction efficiency of the foregoing current audio frame. If the reference integrated-term linear prediction efficiency of the foregoing current audio frame falls within the linear prediction efficiency interval 50-80% (that is, the third linear prediction efficiency interval is the linear prediction efficiency interval 50-80%), it is determined that an audio coding scheme (for example, TCX) corresponding to the linear prediction efficiency interval 50-80% is the audio coding scheme that matches the reference linear prediction efficiency of the foregoing current audio frame. If the reference integrated-term linear prediction efficiency of the foregoing current audio frame falls within the linear prediction efficiency interval 80-100% (that is, the third linear prediction efficiency interval is the linear prediction efficiency interval 80-100%), it is determined that an audio coding scheme (for example, ACELP coding) corresponding to the linear prediction efficiency interval 80-100% is the audio coding scheme that matches the reference linear prediction efficiency of the foregoing current audio frame, and another scenario may be deduced from this. The mapping relationship between a linear prediction efficiency interval and a linear prediction based audio coding scheme may be set according to requirements of different application scenarios.

It may be understood that specific values of the thresholds (for example, the first threshold, the second threshold, the third threshold, the fourth threshold, the fifth threshold, and the sixth threshold) mentioned in the foregoing examples may be set according to a requirement or according to an application environment and an application scenario. For example, if a value range of the reference long-term linear prediction efficiency of the foregoing current audio frame is 0-1, a value of the first threshold may be 0.2, 0.5, 0.6, 0.8, 0.9, or the like, if a value range of the reference short-term linear prediction efficiency of the foregoing current audio frame is 0-1, a value of the second threshold may be 0.3, 0.3, 0.6, 0.8, 0.9, or the like, and another scenario is deduced from this. Further, values of the thresholds may further be adjusted in a dynamic and adaptive manner according to a requirement. For example, if a linear prediction based audio coding scheme (for example, TCX or ACELP coding) is preferably selected to code an audio frame, a corresponding threshold (for example, the first threshold, the second threshold, the third threshold, the fourth threshold, the fifth threshold, or the sixth threshold) may be set to be relatively small. If an audio coding scheme not based on linear prediction (for example, GAC coding) is preferably selected to code an audio frame, a corresponding threshold (for example, the first threshold, the second threshold, the third threshold, the fourth threshold, the fifth threshold, or the sixth threshold) may be set to be relatively large, and so on.

It may be understood that different types of linear prediction efficiency included in the reference linear prediction efficiency of the foregoing current audio frame may be specifically estimated in different manners. The following uses some possible embodiment manners as examples to perform description.

For example, in some embodiments of the present disclosure, the reference long-term linear prediction efficiency of the current audio frame may be obtained by means of estimation in the following manner: estimating the long-term linear prediction efficiency of the current audio frame, where the long-term linear prediction efficiency of the foregoing current audio frame is the reference long-term linear prediction efficiency of the foregoing current audio frame.

Alternatively, the reference long-term linear prediction efficiency of the foregoing current audio frame is obtained by means of estimation in the following manner: obtaining the long-term linear prediction efficiency of the current audio frame by means of estimation; acquiring linear prediction efficiency of N1 history audio frames of the foregoing current audio frame; and calculating a first statistical value of the linear prediction efficiency of the foregoing N1 history audio frames and the long-term linear prediction efficiency of the foregoing current audio frame, where N1 is a positive integer (for example, N1 may be equal to 1, 2, 3, or another value), the foregoing first statistical value is the reference long-term linear prediction efficiency of the foregoing current audio frame, linear prediction efficiency of each history audio frame of N11 history audio frames is at least one of the following linear prediction efficiency: long-term linear prediction efficiency, short-term linear prediction efficiency, and integrated linear prediction efficiency, integrated linear prediction efficiency of each history audio frame may be obtained based on long-term linear prediction efficiency and short-term linear prediction efficiency of each history audio frame (for example, if the foregoing N11 history audio frames are audio frames F1, F2, and F3, linear prediction efficiency of the audio frame F1 is at least one of the following linear prediction efficiency of the audio frame F1: long-term linear prediction efficiency, short-term linear prediction efficiency, and integrated linear prediction efficiency, linear prediction efficiency of the audio frame F2 is at least one of the following linear prediction efficiency of the audio frame F2: long-term linear prediction efficiency, short-term linear prediction efficiency, and integrated linear prediction efficiency, and linear prediction efficiency of the audio frame F3 is at least one of the following linear prediction efficiency of the audio frame F3: long-term linear prediction efficiency, short-term linear prediction efficiency, and integrated linear prediction efficiency, where integrated linear prediction efficiency of the audio frame F1 may be obtained based on long-term linear prediction efficiency and short-term linear prediction efficiency of the foregoing audio frame F1, integrated linear prediction efficiency of the audio frame F2 may be obtained based on long-term linear prediction efficiency and short-term linear prediction efficiency of the foregoing audio frame F2, integrated linear prediction efficiency of the audio frame F3 may be obtained based on long-term linear prediction efficiency and short-term linear prediction efficiency of the foregoing audio frame F3, and a scenario in which N11 is another value is deduced from this), and the foregoing N11 history audio frames are a subset of the foregoing N1 history audio frames (where N11 is less than or equal to N1). The foregoing N1 history audio frames may be any N1 history audio frames of the foregoing current audio frame, or may be N1 history audio frames adjacent to the foregoing current audio frame in the time domain. Linear prediction efficiency of a remaining history audio frame, except the foregoing N11 history audio frames, in the foregoing N1 history audio frames may be another type of linear prediction efficiency that is different from linear prediction efficiency of the foregoing N11 history audio frames, and no details are further provided herein. The first statistical value, obtained by means of calculation, of the linear prediction efficiency of the foregoing N1 history audio frames and the long-term linear prediction efficiency of the foregoing current audio frame may be, for example, a sum value, a weighted sum value, a geometric average value, an arithmetic average value, a moving average value, or a weighted average value of the linear prediction efficiency of the foregoing N1 history audio frames and the long-term linear prediction efficiency of the foregoing current audio frame.

Alternatively, the reference long-term linear prediction efficiency of the foregoing current audio frame may be obtained by means of estimation, for example, in the following manner: obtaining the long-term linear prediction efficiency of the current audio frame by means of estimation; acquiring reference linear prediction efficiency of N2 history audio frames of the foregoing current audio frame; and calculating a second statistical value of the reference linear prediction efficiency of the foregoing N2 history audio frames and the long-term linear prediction efficiency of the foregoing current audio frame, where N2 is a positive integer (for example, N2 may be equal to 1, 2, 3, or another value), the foregoing second statistical value is the reference long-term linear prediction efficiency of the foregoing current audio frame, reference linear prediction efficiency of each history audio frame of N21 history audio frames is at least one of the following linear prediction efficiency: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N21 history audio frames are a subset of the foregoing N2 history audio frames (where N21 is less than or equal to N2). The foregoing N2 history audio frames may be any N2 history audio frames of the foregoing current audio frame, or may be N2 history audio frames adjacent to the foregoing current audio frame in the time domain. Linear prediction efficiency of a remaining history audio frame, except the foregoing N21 history audio frames, in the foregoing N2 history audio frames may be another type of linear prediction efficiency that is different from linear prediction efficiency of the foregoing N21 history audio frames, and no details are further provided herein. The second statistical value, obtained by means of calculation, of the reference linear prediction efficiency of the foregoing N2 history audio frames and the long-term linear prediction efficiency of the foregoing current audio frame is, for example, a sum value, a weighted sum value, a geometric average value, an arithmetic average value, a moving average value, or a weighted average value of the reference linear prediction efficiency of the foregoing N2 history audio frames and the long-term linear prediction efficiency of the foregoing current audio frame.

Alternatively, the reference long-term linear prediction efficiency of the foregoing current audio frame may be obtained by means of estimation, for example, in the following manner: obtaining the long-term linear prediction efficiency of the current audio frame by means of estimation; acquiring reference linear prediction efficiency of N4 history audio frames of the foregoing current audio frame; acquiring linear prediction efficiency of N3 history audio frames of the foregoing current audio frame; and calculating a third statistical value of the linear prediction efficiency of the foregoing N3 history audio frames, the reference linear prediction efficiency of the foregoing N4 history audio frames, and the long-term linear prediction efficiency of the foregoing current audio frame, where N3 and N4 are positive integers (for example, N3 and N4 may be equal to 1, 2, 3, or another value), the foregoing third statistical value is the reference long-term linear prediction efficiency of the foregoing current audio frame, linear prediction efficiency of each history audio frame of N31 history audio frames is at least one of the following linear prediction efficiency: long-term linear prediction efficiency, short-term linear prediction efficiency, and integrated linear prediction efficiency, reference linear prediction efficiency of each history audio frame of N41 history audio frames is at least one of the following linear prediction efficiency: reference long-term linear prediction efficiency, reference short-term linear prediction efficiency, and reference integrated linear prediction efficiency, the foregoing N31 history audio frames are a subset of the foregoing N3 history audio frames, and N31 is less than or equal to N3. The foregoing N3 history audio frames may be any N3 history audio frames of the foregoing current audio frame, or may be N3 history audio frames adjacent to the foregoing current audio frame in the time domain. Linear prediction efficiency of a remaining history audio frame, except the foregoing N31 history audio frames, in the foregoing N3 history audio frames may be another type of linear prediction efficiency that is different from linear prediction efficiency of the foregoing N31 history audio frames, and no details are further provided herein. The foregoing N41 history audio frames are a subset of the foregoing N4 history audio frames, and N41 is less than or equal to N4, where the foregoing N4 history audio frames may be any N4 history audio frames of the foregoing current audio frame, or may be N4 history audio frames adjacent to the foregoing current audio frame in the time domain. Linear prediction efficiency of a remaining history audio frame, except the foregoing N41 history audio frames, in the foregoing N4 history audio frames may be another type of linear prediction efficiency that is different from linear prediction efficiency of the foregoing N41 history audio frames, and no details are further provided herein. Integrated linear prediction efficiency of each history audio frame is obtained based on long-term linear prediction efficiency and short-term linear prediction efficiency of each history audio frame, and reference integrated linear prediction efficiency of each history audio frame is obtained based on reference long-term linear prediction efficiency and reference short-term linear prediction efficiency of each history audio frame. An intersection set of the foregoing N3 history audio frames and the foregoing N4 history audio frames may be an empty set or may not be an empty set. The third statistical value, obtained by means of calculation, of the linear prediction efficiency of the foregoing N3 history audio frames, the reference linear prediction efficiency of the foregoing N4 history audio frames, and the long-term linear prediction efficiency of the foregoing current audio frame is, for example, a sum value, a weighted sum value, a geometric average value, an arithmetic average value, a moving average value, or a weighted average value of the linear prediction efficiency of the foregoing N3 history audio frames, the reference linear prediction efficiency of the foregoing N4 history audio frames, and the long-term linear prediction efficiency of the foregoing current audio frame.

For example, in some embodiments of the present disclosure, the reference short-term linear prediction efficiency of the foregoing current audio frame is obtained by means of estimation, for example, in the following manner: estimating the short-term linear prediction efficiency of the current audio frame, where the short-term linear prediction efficiency of the foregoing current audio frame is the reference short-term linear prediction efficiency of the foregoing current audio frame.

Alternatively, the reference short-term linear prediction efficiency of the foregoing current audio frame may be obtained by means of estimation in the following manner: obtaining the short-term linear prediction efficiency of the current audio frame by means of estimation; acquiring linear prediction efficiency of N5 history audio frames of the foregoing current audio frame; and calculating a fourth statistical value of the linear prediction efficiency of the foregoing N5 history audio frames and the short-term linear prediction efficiency of the foregoing current audio frame, where N5 is a positive integer (for example, N5 may be equal to 1, 2, 3, or another value), the foregoing fourth statistical value is the reference short-term linear prediction efficiency of the foregoing current audio frame, linear prediction efficiency of each history audio frame of N51 history audio frames is at least one of the following linear prediction efficiency: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N51 history audio frames are a subset of the foregoing N5 history audio frames (where N51 is less than or equal to N5). The foregoing N5 history audio frames may be any N5 history audio frames of the foregoing current audio frame, or may be N5 history audio frames adjacent to the foregoing current audio frame in the time domain. Linear prediction efficiency of a remaining history audio frame, except the foregoing N51 history audio frames, in the foregoing N5 history audio frames may be another type of linear prediction efficiency that is different from linear prediction efficiency of the foregoing N51 history audio frames, and no details are further provided herein. The fourth statistical value, obtained by means of calculation, of the linear prediction efficiency of the foregoing N5 history audio frames and the short-term linear prediction efficiency of the foregoing current audio frame may be a sum value, a weighted sum value, a geometric average value, an arithmetic average value, a moving average value, or a weighted average value of the linear prediction efficiency of the foregoing N5 history audio frames and the short-term linear prediction efficiency of the foregoing current audio frame.

Alternatively, the reference short-term linear prediction efficiency of the foregoing current audio frame may be obtained by means of estimation in the following manner: obtaining the short-term linear prediction efficiency of the current audio frame by means of estimation; acquiring reference linear prediction efficiency of N6 history audio frames of the foregoing current audio frame; and calculating a fifth statistical value of the reference linear prediction efficiency of the foregoing N6 history audio frames and the short-term linear prediction efficiency of the foregoing current audio frame, where N6 is a positive integer (for example, N6 may be equal to 1, 2, 3, or another value), the foregoing fifth statistical value is the reference short-term linear prediction efficiency of the foregoing current audio frame, reference linear prediction efficiency of each history audio frame of N61 history audio frames is at least one of the following linear prediction efficiency: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N61 history audio frames are a subset of the foregoing N6 history audio frames (where N61 is less than or equal to N6). The foregoing N6 history audio frames may be any N6 history audio frames of the foregoing current audio frame, or may be N6 history audio frames adjacent to the foregoing current audio frame in the time domain. Linear prediction efficiency of a remaining history audio frame, except the foregoing N61 history audio frames, in the foregoing N6 history audio frames may be another type of linear prediction efficiency that is different from linear prediction efficiency of the foregoing N61 history audio frames, and no details are further provided herein. The fifth statistical value, obtained by means of calculation, of the reference linear prediction efficiency of the foregoing N6 history audio frames and the short-term linear prediction efficiency of the foregoing current audio frame may be a sum value, a weighted sum value, a geometric average value, an arithmetic average value, a moving average value, or a weighted average value of the reference linear prediction efficiency of the foregoing N6 history audio frames and the short-term linear prediction efficiency of the foregoing current audio frame.

Alternatively, the reference short-term linear prediction efficiency of the foregoing current audio frame may be obtained by means of estimation in the following manner: obtaining the short-term linear prediction efficiency of the current audio frame by means of estimation; acquiring reference linear prediction efficiency of N8 history audio frames of the foregoing current audio frame; acquiring linear prediction efficiency of N7 history audio frames of the foregoing current audio frame; and calculating a sixth statistical value of the linear prediction efficiency of the foregoing N7 history audio frames, the reference linear prediction efficiency of the foregoing N8 history audio frames, and the short-term linear prediction efficiency of the foregoing current audio frame, where N7 and N8 are positive integers (for example, N7 and N8 may be equal to 1, 2, 3, or another value), the foregoing sixth statistical value is the reference short-term linear prediction efficiency of the foregoing current audio frame, linear prediction efficiency of each history audio frame of N71 history audio frames is at least one of the following linear prediction efficiency: long-term linear prediction efficiency, short-term linear prediction efficiency, and integrated linear prediction efficiency, reference linear prediction efficiency of each history audio frame of N81 history audio frames is at least one of the following linear prediction efficiency: reference long-term linear prediction efficiency, reference short-term linear prediction efficiency, and reference integrated linear prediction efficiency, integrated linear prediction efficiency of each history audio frame is obtained based on long-term linear prediction efficiency and short-term linear prediction efficiency of each history audio frame, reference integrated linear prediction efficiency of each history audio frame is obtained based on reference long-term linear prediction efficiency and reference short-term linear prediction efficiency of each history audio frame, and the foregoing N71 history audio frames are a subset of the foregoing N7 history audio frames (where N71 is less than or equal to N7). The foregoing N7 history audio frames may be any N7 history audio frames of the foregoing current audio frame, or may be N7 history audio frames adjacent to the foregoing current audio frame in the time domain. Linear prediction efficiency of a remaining history audio frame, except the foregoing N71 history audio frames, in the foregoing N7 history audio frames may be another type of linear prediction efficiency that is different from linear prediction efficiency of the foregoing N71 history audio frames, and no details are further provided herein. The foregoing N81 history audio frames are a subset of the foregoing N8 history audio frames (where N81 is less than or equal to N8), where the foregoing N8 history audio frames may be any N8 history audio frames of the foregoing current audio frame, or may be N8 history audio frames adjacent to the foregoing current audio frame in the time domain. Linear prediction efficiency of a remaining history audio frame, except the foregoing N81 history audio frames, in the foregoing N8 history audio frames may be another type of linear prediction efficiency that is different from linear prediction efficiency of the foregoing N81 history audio frames, and no details are further provided herein. An intersection set of the foregoing N7 history audio frames and the foregoing N8 history audio frames may be an empty set or may not be an empty set. The sixth statistical value, obtained by means of calculation, of the linear prediction efficiency of the foregoing N7 history audio frames, the reference linear prediction efficiency of the foregoing N8 history audio frames, and the short-term linear prediction efficiency of the foregoing current audio frame may be a sum value, a weighted sum value, a geometric average value, an arithmetic average value, a moving average value, or a weighted average value of the linear prediction efficiency of the foregoing N7 history audio frames, the reference linear prediction efficiency of the foregoing N8 history audio frames, and the short-term linear prediction efficiency of the foregoing current audio frame.

In some embodiments of the present disclosure, linear prediction efficiency (for example, long-term linear prediction efficiency or short-term linear prediction efficiency) of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher linear prediction efficiency (for example, long-term linear prediction efficiency or short-term linear prediction efficiency) of an audio frame (for example, a current audio frame or a history audio frame of a current audio frame) indicates a larger extent to which linear prediction can be performed on the audio frame.

In some embodiments of the present disclosure, the obtaining the short-term linear prediction efficiency of the current audio frame by means of estimation may include: obtaining the short-term linear prediction efficiency of the current audio frame based on a linear-prediction residual of the current audio frame.

In some embodiments of the present disclosure, for example, the obtaining the short-term linear prediction efficiency of the current audio frame based on a linear-prediction residual of the current audio frame includes: calculating a change rate of energy that are of the current audio frame and obtained before and after short-term linear prediction is performed on the current audio frame, where the foregoing calculated energy change rate is the short-term linear prediction efficiency of the current audio frame, or the short-term linear prediction efficiency of the current audio frame is obtained by means of transformation based on the foregoing calculated energy change rate, and the energy that is of the foregoing current audio frame and obtained after the short-term linear prediction is performed on the current audio frame is energy of the linear-prediction residual of the foregoing current audio frame. For example, there may be a mapping relationship between the energy change rate and the short-term linear prediction efficiency of the current audio frame, and the short-term linear prediction efficiency that is of the current audio frame and is in the mapping relationship with the foregoing calculated energy change rate may be obtained based on the mapping relationship between the energy change rate and the short-term linear prediction efficiency of the current audio frame. Generally, a larger change rate of the energy that are of the current audio frame and obtained before and after the short-term linear prediction is performed on the current audio frame indicates higher short-term linear prediction efficiency of the current audio frame.

For example, the change rate of the energy that are of the foregoing current audio frame and obtained before and after the short-term linear prediction is performed on the current audio frame may be a ratio or a reciprocal of a ratio of the energy that is of the foregoing current audio frame and obtained before the short-term linear prediction is performed on the current audio frame to the energy of the linear-prediction residual of the foregoing current audio frame. Generally, a larger ratio obtained by dividing the energy that is of the foregoing current audio frame and obtained before the short-term linear prediction is performed on the current audio frame by the energy of the linear-prediction residual of the foregoing current audio frame indicates higher short-term linear prediction efficiency of the current audio frame.

In some embodiments of the present disclosure, the obtaining the long-term linear prediction efficiency of the current audio frame by means of estimation may include: obtaining a correlation between a linear-prediction residual of the current audio frame and a first history linear prediction signal according to the linear-prediction residual of the foregoing current audio frame and the foregoing first history linear prediction signal, where the foregoing correlation is the long-term linear prediction efficiency of the current audio frame, or the long-term linear prediction efficiency of the current audio frame is obtained based on the foregoing correlation. The foregoing first history linear prediction signal is first history linear prediction excitation or a first history linear-prediction residual, the foregoing first history linear-prediction residual is a linear-prediction residual of a history audio frame of the foregoing current audio frame (for example, the foregoing first history linear-prediction residual may be a linear-prediction residual of a history audio frame that is of the current audio frame and whose duration is the same as or similar to that of the foregoing current audio frame, or the foregoing first history linear-prediction residual may be linear-prediction residuals of some consecutive audio signals of two adjacent history audio frames that are of the foregoing current audio frame and whose duration is the same as or similar to that of the foregoing current audio frame), and the foregoing first history linear prediction excitation is linear prediction excitation of the history audio frame of the foregoing current audio frame (for example, the foregoing first history linear prediction excitation may be linear prediction excitation of a history audio frame that is of the foregoing current audio frame and whose duration is the same as or similar to that of the foregoing current audio frame, or the foregoing first history linear prediction excitation may be linear prediction excitation of some consecutive audio signals of two adjacent history audio frames that are of the current audio frame and whose duration is the same as or similar to that of the foregoing current audio frame). For example, there is a mapping relationship between a correlation and long-term linear prediction efficiency of an audio frame, and the long-term linear prediction efficiency that is of the foregoing current audio frame and is in a mapping relationship with the foregoing calculated correlation may be obtained based on the mapping relationship between a correlation and long-term linear prediction efficiency of an audio frame.

The correlation between the linear-prediction residual of the foregoing current audio frame and the foregoing first history linear prediction signal may be obtained according to the linear-prediction residual of the current audio frame and the first history linear prediction signal in various manners.

For example, the obtaining a correlation between a linear-prediction residual of the current audio frame and a first history linear prediction signal according to the linear-prediction residual of the foregoing current audio frame and the foregoing first history linear prediction signal may include: calculating the correlation between the linear-prediction residual of the current audio frame and the first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the linear-prediction residual of the current audio frame by a gain factor to obtain a gained linear-prediction residual of the foregoing current audio frame, and obtaining a correlation between the gained linear-prediction residual of the foregoing current audio frame and the first history linear prediction signal by means of calculation, where the correlation, obtained by means of calculation, between the gained linear-prediction residual of the foregoing current audio frame and the foregoing first history linear prediction signal is the correlation between the linear-prediction residual of the foregoing current audio frame and the foregoing first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the first history linear prediction signal by a gain factor to obtain a gained first history linear prediction signal, and obtaining a correlation between the linear-prediction residual of the foregoing current audio frame and the foregoing gained first history linear prediction signal by means of calculation, where the correlation, obtained by means of calculation, between the linear-prediction residual of the foregoing current audio frame and the foregoing gained first history linear prediction signal is the correlation between the linear-prediction residual of the foregoing current audio frame and the foregoing first history linear prediction signal.

The foregoing first history linear prediction excitation or the foregoing first history linear-prediction residual may be determined based on a pitch of the foregoing current audio frame. For example, a time-domain correlation between the foregoing first history linear prediction excitation and the linear-prediction residual of the foregoing current audio frame is greater than or equal to a time-domain correlation between other history linear prediction excitation and the linear-prediction residual of the foregoing current audio frame, or a time-domain correlation between the foregoing first history linear prediction excitation and the linear-prediction residual of the foregoing current audio frame is greater than or equal to a time-domain correlation between at least one other history linear prediction excitation and the linear-prediction residual of the foregoing current audio frame. For example, a time-domain correlation between the foregoing first history linear-prediction residual and the linear-prediction residual of the foregoing current audio frame is greater than or equal to a time-domain correlation between another history linear-prediction residual and the linear-prediction residual of the foregoing current audio frame, or a time-domain correlation between the foregoing first history linear-prediction residual and the linear-prediction residual of the foregoing current audio frame is greater than or equal to a time-domain correlation between at least one other history linear-prediction residual and the linear-prediction residual of the foregoing current audio frame.

Generally, a larger correlation between the linear-prediction residual of the foregoing current audio frame and the foregoing first history linear prediction signal indicates higher long-term linear prediction efficiency of the foregoing current audio frame.

In some embodiments of the present disclosure, the foregoing correlation is, for example, a function value of a cross correlation in the time domain and/or a function value of a cross correlation in the frequency domain, or the foregoing correlation may be time-domain distortion and/or frequency-domain distortion (where the frequency-domain distortion may also be referred to as spectrum distortion).

In some embodiments of the present disclosure, the foregoing frequency-domain distortion may be a sum value or a weighted sum value of distortion of K1 frequency bins in the frequency domain, or the foregoing frequency-domain distortion may be a sum value or a weighted sum value of distortion of K2 sub-bands in the frequency domain, where K1 and K2 are positive integers.

Generally, a larger cross correlation function value in the time domain of the linear-prediction residual of the foregoing current audio frame and the foregoing first history linear prediction signal may indicate higher long-term linear prediction efficiency of the foregoing current audio frame. Generally, a larger cross correlation function value in the frequency domain of the linear-prediction residual of the foregoing current audio frame and the foregoing first history linear prediction signal may indicate higher long-term linear prediction efficiency of the foregoing current audio frame. Generally, smaller frequency-domain distortion between the linear-prediction residual of the foregoing current audio frame and the foregoing first history linear prediction signal indicates higher long-term linear prediction efficiency of the foregoing current audio frame. Generally, smaller time-domain distortion between the linear-prediction residual of the foregoing current audio frame and the foregoing first history linear prediction signal indicates higher long-term linear prediction efficiency of the foregoing current audio frame.

In some embodiments of the present disclosure, a weighting coefficient corresponding to the weighted sum value of the foregoing distortion is a perceptual weighting coefficient that reflects a psychoacoustic model. Certainly, the weighting coefficient corresponding to the weighted sum value of the foregoing distortion may also be another weighting coefficient that is set based on an actual requirement. It is found, by means of testing, that using the perceptual weighting coefficient helps make the calculated distortion better meet subjective quality, thereby helping improve performance.

In some embodiments of the present disclosure, the foregoing first history linear prediction excitation may be linear prediction excitation generated by performing audio coding on the history audio frame of the foregoing current audio frame by using a linear prediction based coding scheme.

In some embodiments of the present disclosure, the foregoing first history linear-prediction residual may be obtained based on a time-domain signal of a first history audio frame of the foregoing current audio frame and a linear prediction coefficient of the foregoing first history audio frame, where a linear prediction coefficient of the foregoing first history audio frame is a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the linear-prediction residual of the foregoing current audio frame may be obtained based on a time-domain signal of the foregoing current audio frame and a linear prediction coefficient of the foregoing current audio frame, where the linear prediction coefficient of the foregoing current audio frame may be a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the foregoing first history linear prediction excitation may be superposed excitation of adaptive codebook excitation and fixed codebook excitation, or the foregoing first history linear prediction excitation may be adaptive codebook excitation, or the foregoing first history linear prediction excitation may be another type of codebook excitation.

It may be understood that in the embodiments of the present disclosure, a history audio frame of an audio frame (for example, a current audio frame or an audio frame preceding or following a current audio frame in the time domain) refers to an audio frame preceding the audio frame in the time domain in a same audio stream. It can be learned that a history audio frame is a relative concept. For example, assuming that a time-domain sequence of four audio frames included in a same audio stream is an audio frame y1->an audio frame y2->an audio frame y3->an audio frame y4, the audio frame y1, the audio frame y2, and the audio frame y3 are history audio frames of the audio frame 4, the audio frame y1 and the audio frame y2 are history audio frames of the audio frame y3, and the audio frame y1 is a history audio frame of the audio frame y2 . It may be understood that the audio frame y4 is not a history audio frame of the audio frame y3, the audio frame y4 is not a history audio frame of the audio frame y2 or the audio frame y1, and another scenario may be deduced from this.

To help better understand the foregoing technical aspects in this embodiment of the present disclosure, some specific application scenarios are used as examples to perform description in the following.

Figure 2:
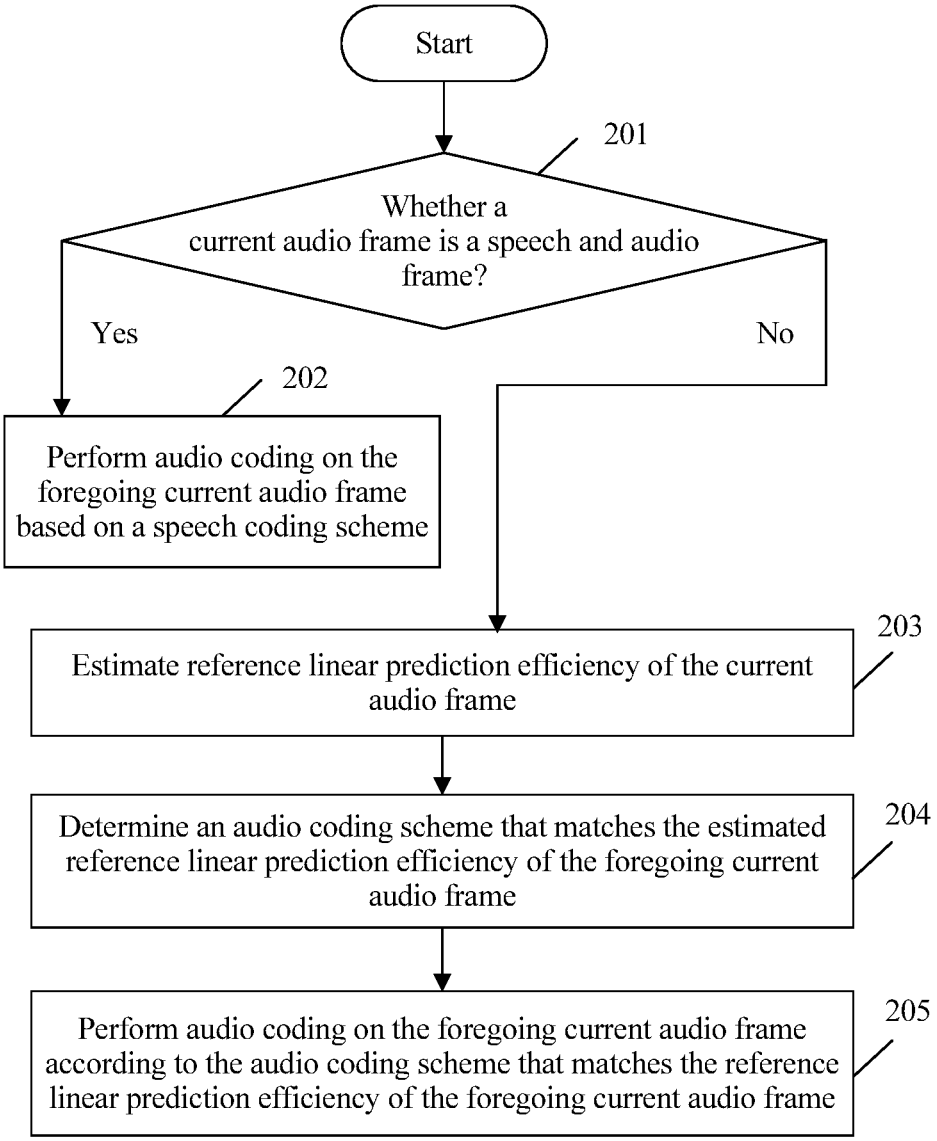
FIG. 2 is a schematic flowchart of another audio coding method according to another embodiment of the present disclosure.

First, referring to FIG. 2, FIG. 2 is a schematic flowchart of an audio coding method according to an embodiment of the present disclosure. As shown in FIG. 2, the audio coding method provided in this embodiment of the present disclosure may include the following content:

201. Determine whether a current audio frame is a speech and audio frame.

If yes, step 202 is executed.

If no, step 203 is executed.

202. Perform audio coding on the foregoing current audio frame based on a speech coding scheme.

In some embodiments of the present disclosure, if the current audio frame is a speech and audio frame, audio coding may be performed on the foregoing current audio frame based on algebraic code excited linear prediction (ACELP, Algebraic Code Excited Linear Prediction) coding. For example, if the current audio frame is a speech and audio frame, the current audio frame may be input into an ACELP sub-coder for audio coding, where the ACELP sub-coder is a sub-coder that uses ACELP coding.

203. Estimate reference linear prediction efficiency of the current audio frame.

The reference linear prediction efficiency of the current audio frame may be estimated by using multiple algorithms.

In the embodiments of the present disclosure, reference linear prediction efficiency of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher reference linear prediction efficiency of an audio frame (for example, a current audio frame or a history audio frame of a current audio frame) indicates a larger extent to which linear prediction can be performed on the audio frame.

In some embodiments of the present disclosure, the foregoing reference linear prediction efficiency includes at least one of the following linear prediction efficiency: reference long-term linear prediction efficiency, reference short-term linear prediction efficiency, and reference integrated linear prediction efficiency, where the foregoing reference integrated linear prediction efficiency is obtained based on the foregoing reference long-term linear prediction efficiency and the foregoing reference short-term linear prediction efficiency.

Reference long-term linear prediction efficiency of the current audio frame may be obtained based on long-term linear prediction efficiency of the current audio frame, reference short-term linear prediction efficiency of the current audio frame may be obtained based on short-term linear prediction efficiency of the current audio frame, and reference integrated linear prediction efficiency of the current audio frame may be obtained, for example, based on long-term linear prediction efficiency and short-term linear prediction efficiency of the current audio frame.

It may be understood that, a value range of the reference linear prediction efficiency may be 0-1 (that is, 0-100%), or a value range may be 0-x1 (where x1 is a positive number); a value range of the reference long-term linear prediction efficiency may be 0-1 (that is, 0-100%), or a value range may be 0-x2 (where x2 is a positive number); a value range of the reference short-term linear prediction efficiency may be 0-1 (that is, 0-100%), or a value range may be 0-x3 (where x3 is a positive number); a value range of the reference integrated linear prediction efficiency may be 0-1 (that is, 0-100%), or a value range may be 0-x4 (where x4 is a positive number); a value range of the long-term linear prediction efficiency may be 0-1 (that is, 0-100%), or a value range may be 0-x5 (where x5 is a positive number); and a value range of the short-term linear prediction efficiency may be 0-1 (that is, 0-100%), or a value range may be 0-x6 (where x6 is a positive number), where x1, x2, x3, x4, x5, or x6 may be, for example, 0.5, 0.8, 1.5, 2, 5, 10, 50, 100, or another positive number.

204. Determine an audio coding scheme that matches the estimated reference linear prediction efficiency of the foregoing current audio frame.

In some embodiments of the present disclosure, there may be a mapping relationship between an audio coding scheme and reference linear prediction efficiency of an audio frame. For example, different audio coding schemes may be corresponding to different reference linear prediction efficiency. For example, the audio coding scheme that matches the estimated reference linear prediction efficiency of the foregoing current audio frame may be determined from at least two audio coding schemes.

The audio coding scheme that matches the estimated reference linear prediction efficiency of the foregoing current audio frame may be transform coded excitation (TCX, Transform Coded Excitation), or may be generic audio coding (GAC, Generic Audio Coding), where the GAC may be, for example, modified discrete cosine transform (Modified Discrete Cosine Transform) coding.

205. Perform audio coding on the foregoing current audio frame according to the foregoing determined audio coding scheme.

It can be learned that in the technical solution in this embodiment, it is first determined whether a current audio frame is a speech and audio frame; and if the current audio frame is a speech and audio frame, audio coding is performed on the foregoing current audio frame based on a speech coding scheme; or if the current audio frame is a non-speech and audio frame, reference linear prediction efficiency of the current audio frame is first estimated, an audio coding scheme that matches the estimated reference linear prediction efficiency is determined by using the estimated reference linear prediction efficiency of the foregoing current audio frame, and audio coding is performed on the foregoing current audio frame according to the determined audio coding scheme that matches the estimated reference linear prediction efficiency. In a process of determining the audio coding scheme in the foregoing solution, an operation, required to be executed in an existing closed-loop selection mode, of performing complete coding on the current audio frame by using each audio coding scheme does not need to be executed; instead, the audio coding scheme that needs to be selected is determined by using the reference linear prediction efficiency of the current audio frame. Calculation complexity of estimating the reference linear prediction efficiency of the current audio frame is generally far less than calculation complexity of performing complete coding on the current audio frame by using each audio coding scheme. Therefore, compared with an existing mechanism, the foregoing solution in this embodiment of the present disclosure helps reduce operation complexity of audio coding, and further reduce overheads of audio coding.

In some embodiments of the present disclosure, the reference integrated linear prediction efficiency of the foregoing current audio frame may be, for example, a sum value, a weighted sum value (where a weighted value corresponding to the weighted sum value herein may be set according to an actual requirement, and a weighted value may be, for example, 0.5, 1, 2, 3, 5, 10, or another value), or an average value of the reference long-term linear prediction efficiency of the foregoing current audio frame and the reference short-term linear prediction efficiency of the current audio frame.

It may be understood that because the reference linear prediction efficiency of the foregoing current audio frame includes different types of linear prediction efficiency, there may be different specific manners of determining the audio coding scheme that matches the reference linear prediction efficiency of the foregoing current audio frame. The following illustrates some possible embodiment manners by using examples.

For example, in some embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining an audio coding scheme that matches the reference linear prediction efficiency of the foregoing current audio frame may include: if the reference long-term linear prediction efficiency of the foregoing current audio frame is less than a first threshold and/or the reference short-term linear prediction efficiency of the foregoing current audio frame is less than a second threshold, determining that the audio coding scheme that matches the reference linear prediction efficiency of the foregoing current audio frame is an audio coding scheme not based on linear prediction.

For another example, in still other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining an audio coding scheme that matches the reference linear prediction efficiency of the foregoing current audio frame may include: if the reference long-term linear prediction efficiency of the foregoing current audio frame is greater than or equal to a first threshold and/or the reference short-term linear prediction efficiency of the foregoing current audio frame is greater than or equal to a second threshold, determining that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining an audio coding scheme that matches the reference linear prediction efficiency of the foregoing current audio frame may include: if the reference long-term linear prediction efficiency of the foregoing current audio frame is less than a first threshold and/or the reference short-term linear prediction efficiency of the foregoing current audio frame is less than a second threshold, determining that the audio coding scheme that matches the reference linear prediction efficiency of the foregoing current audio frame is an audio coding scheme not based on linear prediction; or if the reference long-term linear prediction efficiency of the foregoing current audio frame is greater than or equal to a first threshold and/or the reference short-term linear prediction efficiency of the foregoing current audio frame is greater than or equal to a second threshold, determining that the audio coding scheme that matches the reference linear prediction efficiency of the foregoing current audio frame is a linear prediction based audio coding scheme.

For another example, in some embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: if the reference long-term linear prediction efficiency of the foregoing current audio frame is greater than or equal to a third threshold, determining that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: if the reference long-term linear prediction efficiency of the foregoing current audio frame is less than a fourth threshold, determining that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: if the reference long-term linear prediction efficiency of the foregoing current audio frame is greater than or equal to a third threshold, determining that the audio coding scheme that matches the reference linear prediction efficiency of the foregoing current audio frame is a linear prediction based audio coding scheme; or if the reference long-term linear prediction efficiency of the foregoing current audio frame is less than a fourth threshold, determining that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference long-term linear prediction efficiency of the foregoing current audio frame, the determining an audio coding scheme that matches the reference linear prediction efficiency of the foregoing current audio frame includes: determining a first linear prediction efficiency interval within which the reference long-term linear prediction efficiency of the foregoing current audio frame falls, and determining, according to a mapping relationship between a linear prediction efficiency interval and a linear prediction based audio coding scheme, a first audio coding scheme that is in a mapping relationship with the foregoing first linear prediction efficiency interval, where the foregoing first audio coding scheme is an audio coding scheme that matches the reference linear prediction efficiency of the foregoing current audio frame, and the foregoing first audio coding scheme is a linear prediction based audio coding scheme or an audio coding scheme not based on linear prediction. Different linear prediction efficiency intervals are corresponding to different audio coding schemes. For example, it is assumed that there are three linear prediction efficiency intervals, which may be 0-30%, 30-70%, and 70-100% respectively. If the reference long-term linear prediction efficiency of the foregoing current audio frame falls within the linear prediction efficiency interval 0-30% (that is, the first linear prediction efficiency interval is the linear prediction efficiency interval 0-30%), it may be determined that an audio coding scheme corresponding to the linear prediction efficiency interval 0-30% is the audio coding scheme that matches the reference linear prediction efficiency of the foregoing current audio frame. If the reference long-term linear prediction efficiency of the foregoing current audio frame falls within the linear prediction efficiency interval 30-70% (that is, the first linear prediction efficiency interval is the linear prediction efficiency interval 30-70%), it may be determined that an audio coding scheme corresponding to the linear prediction efficiency interval 30-70% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame may include: if the reference short-term linear prediction efficiency of the foregoing current audio frame is greater than or equal to a fifth threshold, determining that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame may include: if the reference short-term linear prediction efficiency of the foregoing current audio frame is less than a fifth threshold, determining that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame may include: if the reference short-term linear prediction efficiency of the foregoing current audio frame is greater than or equal to a fifth threshold, determining that the audio coding scheme that matches the reference linear prediction efficiency of the foregoing current audio frame is a linear prediction based audio coding scheme; or if the reference short-term linear prediction efficiency of the foregoing current audio frame is less than a fifth threshold, determining that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference short-term linear prediction efficiency of the foregoing current audio frame, the determining an audio coding scheme that matches the reference linear prediction efficiency of the foregoing current audio frame includes: determining a second linear prediction efficiency interval within which the reference short-term linear prediction efficiency of the foregoing current audio frame falls, and determining, according to a mapping relationship between a linear prediction efficiency interval and a linear prediction based audio coding scheme, a second audio coding scheme that is in a mapping relationship with the foregoing second linear prediction efficiency interval, where the foregoing second audio coding scheme is an audio coding scheme that matches the reference linear prediction efficiency of the foregoing current audio frame, and the foregoing second audio coding scheme is a linear prediction based audio coding scheme or an audio coding scheme not based on linear prediction. For example, it is assumed that there are three linear prediction efficiency intervals, which may be 0-40%, 40-60%, and 60-100% respectively. If the reference long-term linear prediction efficiency of the foregoing current audio frame falls within the linear prediction efficiency interval 0-40% (that is, the second linear prediction efficiency interval is the linear prediction efficiency interval 0-40%), it may be determined that an audio coding scheme corresponding to the linear prediction efficiency interval 0-40% is the audio coding scheme that matches the reference linear prediction efficiency of the foregoing current audio frame. If the reference long-term linear prediction efficiency of the foregoing current audio frame falls within the linear prediction efficiency interval 40-60% (that is, the second linear prediction efficiency interval is the linear prediction efficiency interval 40-60%), it is determined that an audio coding scheme corresponding to the linear prediction efficiency interval 40-60% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame may include: if the reference integrated linear prediction efficiency of the foregoing current audio frame is greater than or equal to a sixth threshold, determining that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame may include: if the reference integrated linear prediction efficiency of the foregoing current audio frame is less than a sixth threshold, determining that the audio coding scheme that matches the reference linear prediction efficiency of the foregoing current audio frame is an audio coding scheme not based on linear prediction.

For another example, in still other embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame may include: if the reference integrated linear prediction efficiency of the foregoing current audio frame is greater than or equal to a sixth threshold, determining that the audio coding scheme that matches the reference linear prediction efficiency of the foregoing current audio frame is a linear prediction based audio coding scheme; or if the reference integrated linear prediction efficiency of the foregoing current audio frame is less than a sixth threshold, determining that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference integrated linear prediction efficiency of the foregoing current audio frame, the determining an audio coding scheme that matches the reference linear prediction efficiency of the foregoing current audio frame includes: determining a third linear prediction efficiency interval within which the reference integrated linear prediction efficiency of the foregoing current audio frame falls, and determining, according to a mapping relationship between a linear prediction efficiency interval and a linear prediction based audio coding scheme, a third audio coding scheme that is in a mapping relationship with the foregoing third linear prediction efficiency interval, where the foregoing third audio coding scheme is an audio coding scheme that matches the reference linear prediction efficiency of the foregoing current audio frame, and the foregoing third audio coding scheme is a linear prediction based audio coding scheme or an audio coding scheme not based on linear prediction. For example, it is assumed that there are three linear prediction efficiency intervals, which may be 0-50%, 50-80%, and 80-100% respectively. If the reference long-term linear prediction efficiency of the foregoing current audio frame falls within the linear prediction efficiency interval 0-50% (that is, the third linear prediction efficiency interval is the linear prediction efficiency interval 0-50%), it may be determined that an audio coding scheme corresponding to the linear prediction efficiency interval 0-50% is the audio coding scheme that matches the reference linear prediction efficiency of the foregoing current audio frame. If the reference long-term linear prediction efficiency of the foregoing current audio frame falls within the linear prediction efficiency interval 50-80% (that is, the third linear prediction efficiency interval is the linear prediction efficiency interval 50-80%), it is determined that an audio coding scheme corresponding to the linear prediction efficiency interval 50-80% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

It may be understood that different types of linear prediction efficiency included in the reference linear prediction efficiency of the foregoing current audio frame may be specifically estimated in different manners. The following uses some possible embodiment manners as examples to perform description.

For example, in some embodiments of the present disclosure, the reference long-term linear prediction efficiency of the current audio frame may be obtained by means of estimation in the following manner: estimating the long-term linear prediction efficiency of the current audio frame, where the long-term linear prediction efficiency of the foregoing current audio frame is the reference long-term linear prediction efficiency of the foregoing current audio frame.

Alternatively, the reference long-term linear prediction efficiency of the foregoing current audio frame is obtained by means of estimation in the following manner: obtaining the long-term linear prediction efficiency of the current audio frame by means of estimation; acquiring linear prediction efficiency of N1 history audio frames of the foregoing current audio frame; and calculating a first statistical value of the linear prediction efficiency of the foregoing N1 history audio frames and the long-term linear prediction efficiency of the foregoing current audio frame, where N1 is a positive integer, the foregoing first statistical value is the reference long-term linear prediction efficiency of the foregoing current audio frame, linear prediction efficiency of each history audio frame of N11 history audio frames is at least one of the following linear prediction efficiency of each history audio frame: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N11 history audio frames are a subset of the foregoing N1 history audio frames. The first statistical value, obtained by means of calculation, of the linear prediction efficiency of the foregoing N1 history audio frames and the long-term linear prediction efficiency of the foregoing current audio frame may be, for example, a sum value, a weighted sum value, a geometric average value, an arithmetic average value, a moving average value, or a weighted average value of the linear prediction efficiency of the foregoing N1 history audio frames and the long-term linear prediction efficiency of the foregoing current audio frame.

Alternatively, the reference long-term linear prediction efficiency of the foregoing current audio frame may be obtained by means of estimation, for example, in the following manner: obtaining the long-term linear prediction efficiency of the current audio frame by means of estimation; acquiring reference linear prediction efficiency of N2 history audio frames of the foregoing current audio frame; and calculating a second statistical value of the reference linear prediction efficiency of the foregoing N2 history audio frames and the long-term linear prediction efficiency of the foregoing current audio frame, where N2 is a positive integer, the foregoing second statistical value is the reference long-term linear prediction efficiency of the foregoing current audio frame, reference linear prediction efficiency of each history audio frame of N21 history audio frames is at least one of the following linear prediction efficiency of each history audio frame: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N21 history audio frames are a subset of the foregoing N2 history audio frames. The second statistical value, obtained by means of calculation, of the reference linear prediction efficiency of the foregoing N2 history audio frames and the long-term linear prediction efficiency of the foregoing current audio frame is, for example, a sum value, a weighted sum value, a geometric average value, an arithmetic average value, a moving average value, or a weighted average value of the reference linear prediction efficiency of the foregoing N2 history audio frames and the long-term linear prediction efficiency of the foregoing current audio frame.

Alternatively, the reference long-term linear prediction efficiency of the foregoing current audio frame may be obtained by means of estimation, for example, in the following manner: obtaining the long-term linear prediction efficiency of the current audio frame by means of estimation; acquiring reference linear prediction efficiency of N4 history audio frames of the foregoing current audio frame; acquiring linear prediction efficiency of N3 history audio frames of the foregoing current audio frame; and calculating a third statistical value of the linear prediction efficiency of the foregoing N3 history audio frames, the reference linear prediction efficiency of the foregoing N4 history audio frames, and the long-term linear prediction efficiency of the foregoing current audio frame, where N3 and N4 are positive integers, the foregoing third statistical value is the reference long-term linear prediction efficiency of the foregoing current audio frame, linear prediction efficiency of each history audio frame of N31 history audio frames is at least one of the following linear prediction efficiency of each history audio frame: long-term linear prediction efficiency, short-term linear prediction efficiency, and integrated linear prediction efficiency, reference linear prediction efficiency of each history audio frame of N41 history audio frames is at least one of the following linear prediction efficiency of each history audio frame: reference long-term linear prediction efficiency, reference short-term linear prediction efficiency, and reference integrated linear prediction efficiency, the foregoing N31 history audio frames are a subset of the foregoing N3 history audio frames, the foregoing N41 history audio frames are a subset of the foregoing N4 history audio frames, integrated linear prediction efficiency of each history audio frame is obtained based on long-term linear prediction efficiency and short-term linear prediction efficiency of each history audio frame, and reference integrated linear prediction efficiency of each history audio frame is obtained based on reference long-term linear prediction efficiency and reference short-term linear prediction efficiency of each history audio frame. An intersection set of the foregoing N3 history audio frames and the foregoing N4 history audio frames may be an empty set or may not be an empty set. The third statistical value, obtained by means of calculation, of the linear prediction efficiency of the foregoing N3 history audio frames, the reference linear prediction efficiency of the foregoing N4 history audio frames, and the long-term linear prediction efficiency of the foregoing current audio frame is, for example, a sum value, a weighted sum value, a geometric average value, an arithmetic average value, a moving average value, or a weighted average value of the linear prediction efficiency of the foregoing N3 history audio frames, the reference linear prediction efficiency of the foregoing N4 history audio frames, and the long-term linear prediction efficiency of the foregoing current audio frame.

For example, in some embodiments of the present disclosure, the reference short-term linear prediction efficiency of the foregoing current audio frame is obtained by means of estimation, for example, in the following manner: estimating the short-term linear prediction efficiency of the current audio frame, where the short-term linear prediction efficiency of the foregoing current audio frame is the reference short-term linear prediction efficiency of the foregoing current audio frame.

Alternatively, the reference short-term linear prediction efficiency of the foregoing current audio frame may be obtained by means of estimation in the following manner: obtaining the short-term linear prediction efficiency of the current audio frame by means of estimation; acquiring linear prediction efficiency of N5 history audio frames of the foregoing current audio frame; and calculating a fourth statistical value of the linear prediction efficiency of the foregoing N5 history audio frames and the short-term linear prediction efficiency of the foregoing current audio frame, where N5 is a positive integer, the foregoing fourth statistical value is the reference short-term linear prediction efficiency of the foregoing current audio frame, linear prediction efficiency of each history audio frame of N51 history audio frames is at least one of the following linear prediction efficiency of each history audio frame: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N51 history audio frames are a subset of the foregoing N5 history audio frames. The fourth statistical value, obtained by means of calculation, of the linear prediction efficiency of the foregoing N5 history audio frames and the short-term linear prediction efficiency of the foregoing current audio frame may be a sum value, a weighted sum value, a geometric average value, an arithmetic average value, a moving average value, or a weighted average value of the linear prediction efficiency of the foregoing N5 history audio frames and the short-term linear prediction efficiency of the foregoing current audio frame.

Alternatively, the reference short-term linear prediction efficiency of the foregoing current audio frame may be obtained by means of estimation in the following manner: obtaining the short-term linear prediction efficiency of the current audio frame by means of estimation; acquiring reference linear prediction efficiency of N6 history audio frames of the foregoing current audio frame; and calculating a fifth statistical value of the reference linear prediction efficiency of the foregoing N6 history audio frames and the short-term linear prediction efficiency of the foregoing current audio frame, where N6 is a positive integer, the foregoing fifth statistical value is the reference short-term linear prediction efficiency of the foregoing current audio frame, reference linear prediction efficiency of each history audio frame of N61 history audio frames is at least one of the following linear prediction efficiency of each history audio frame: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N61 history audio frames are a subset of the foregoing N6 history audio frames. The fifth statistical value, obtained by means of calculation, of the reference linear prediction efficiency of the foregoing N6 history audio frames and the short-term linear prediction efficiency of the foregoing current audio frame may be a sum value, a weighted sum value, a geometric average value, an arithmetic average value, a moving average value, or a weighted average value of the reference linear prediction efficiency of the foregoing N6 history audio frames and the short-term linear prediction efficiency of the foregoing current audio frame.

Alternatively, the reference short-term linear prediction efficiency of the foregoing current audio frame may be obtained by means of estimation in the following manner: obtaining the short-term linear prediction efficiency of the current audio frame by means of estimation; acquiring reference linear prediction efficiency of N8 history audio frames of the foregoing current audio frame; acquiring linear prediction efficiency of N7 history audio frames of the foregoing current audio frame; and calculating a sixth statistical value of the linear prediction efficiency of the foregoing N7 history audio frames, the reference linear prediction efficiency of the foregoing N8 history audio frames, and the short-term linear prediction efficiency of the foregoing current audio frame, where N7 and N8 are positive integers, the foregoing sixth statistical value is the reference short-term linear prediction efficiency of the foregoing current audio frame, linear prediction efficiency of each history audio frame of N71 history audio frames is at least one of the following linear prediction efficiency of each history audio frame: long-term linear prediction efficiency, short-term linear prediction efficiency, and integrated linear prediction efficiency, reference linear prediction efficiency of each history audio frame of N81 history audio frames is at least one of the following linear prediction efficiency of each history audio frame: reference long-term linear prediction efficiency, reference short-term linear prediction efficiency, and reference integrated linear prediction efficiency, integrated linear prediction efficiency of each history audio frame is obtained based on long-term linear prediction efficiency and short-term linear prediction efficiency of each history audio frame, reference integrated linear prediction efficiency of each history audio frame is obtained based on reference long-term linear prediction efficiency and reference short-term linear prediction efficiency of each history audio frame, the foregoing N71 history audio frames are a subset of the foregoing N7 history audio frames, and the foregoing N81 history audio frames are a subset of the foregoing N8 history audio frames. An intersection set of the foregoing N7 history audio frames and the foregoing N8 history audio frames may be an empty set or may not be an empty set. The sixth statistical value, obtained by means of calculation, of the linear prediction efficiency of the foregoing N7 history audio frames, the reference linear prediction efficiency of the foregoing N8 history audio frames, and the short-term linear prediction efficiency of the foregoing current audio frame may be a sum value, a weighted sum value, a geometric average value, an arithmetic average value, a moving average value, or a weighted average value of the linear prediction efficiency of the foregoing N7 history audio frames, the reference linear prediction efficiency of the foregoing N8 history audio frames, and the short-term linear prediction efficiency of the foregoing current audio frame.

In some embodiments of the present disclosure, linear prediction efficiency (for example, long-term linear prediction efficiency or short-term linear prediction efficiency) of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher linear prediction efficiency (for example, long-term linear prediction efficiency or short-term linear prediction efficiency) of an audio frame (for example, a current audio frame or a history audio frame of a current audio frame) indicates a larger extent to which linear prediction can be performed on the audio frame.

In some embodiments of the present disclosure, the obtaining the short-term linear prediction efficiency of the current audio frame by means of estimation may include: obtaining the short-term linear prediction efficiency of the current audio frame based on a linear-prediction residual of the current audio frame.

In some embodiments of the present disclosure, for example, the obtaining the short-term linear prediction efficiency of the current audio frame based on a linear-prediction residual of the current audio frame includes: calculating a change rate of energy that are of the current audio frame and obtained before and after short-term linear prediction is performed on the current audio frame, where the foregoing calculated energy change rate is the short-term linear prediction efficiency of the current audio frame, or the short-term linear prediction efficiency of the current audio frame is obtained by means of transformation based on the foregoing calculated energy change rate, and the energy that is of the foregoing current audio frame and obtained after the short-term linear prediction is performed on the current audio frame is energy of the linear-prediction residual of the foregoing current audio frame. For example, there may be a mapping relationship between the energy change rate and the short-term linear prediction efficiency of the current audio frame, and the short-term linear prediction efficiency that is of the current audio frame and is in the mapping relationship with the foregoing calculated energy change rate may be obtained based on the mapping relationship between the energy change rate and the short-term linear prediction efficiency of the current audio frame. Generally, a larger change rate of the energy that are of the current audio frame and obtained before and after the short-term linear prediction is performed on the current audio frame indicates higher short-term linear prediction efficiency of the current audio frame.

For example, the change rate of the energy that are of the foregoing current audio frame and obtained before and after the short-term linear prediction is performed on the current audio frame may be a ratio or a reciprocal of a ratio of the energy that is of the foregoing current audio frame and obtained before the short-term linear prediction is performed on the current audio frame to the energy of the linear-prediction residual of the foregoing current audio frame. Generally, a larger ratio obtained by dividing the energy that is of the foregoing current audio frame and obtained before the short-term linear prediction is performed on the current audio frame by the energy of the linear-prediction residual of the foregoing current audio frame indicates higher short-term linear prediction efficiency of the current audio frame.

In some embodiments of the present disclosure, the obtaining the long-term linear prediction efficiency of the current audio frame by means of estimation may include: obtaining a correlation between a linear-prediction residual of the current audio frame and a first history linear prediction signal according to the linear-prediction residual of the foregoing current audio frame and the foregoing first history linear prediction signal, where the foregoing correlation is the long-term linear prediction efficiency of the current audio frame, or the long-term linear prediction efficiency of the current audio frame is obtained based on the foregoing correlation. The foregoing first history linear prediction signal is first history linear prediction excitation or a first history linear-prediction residual, the foregoing first history linear-prediction residual is a linear-prediction residual of a history audio frame of the foregoing current audio frame, and the foregoing first history linear prediction excitation is linear prediction excitation of the history audio frame of the foregoing current audio frame. For example, there is a mapping relationship between a correlation and long-term linear prediction efficiency of an audio frame, and the long-term linear prediction efficiency that is of the foregoing current audio frame and is in a mapping relationship with the foregoing calculated correlation may be obtained based on the mapping relationship between a correlation and long-term linear prediction efficiency of an audio frame.

In some embodiments of the present disclosure, a time-domain signal of the current audio frame may be filtered by using an analysis filter A (Z), to obtain the linear-prediction residual R of the current audio frame, where a filter coefficient of the filter A (Z) is a linear prediction coefficient of the current audio frame.

For details, refer to the following Formula 1:

$$R(i) = \sum_{k=1}^{M-1} [S(i) + a(k) \cdot S(i-k)],\ i = 0, 1, \ldots N-1,$$

where

S(i) in Formula 1 indicates a signal of the $i^{th}$ time-domain sampling point of the current audio frame, a(k) indicates a linear prediction coefficient of the $k^{th}$ order of the current audio frame, M is a total quantity of orders of the filter, N is a time-domain length of the current audio frame, and R(i) indicates a linear-prediction residual of the $i^{th}$ time-domain sampling point of the current audio frame.

It may be understood that a linear-prediction residual of any audio frame (for example, a current audio frame or a history audio frame of a current audio frame) may be obtained in the manner of the foregoing example.

For example, linear prediction excitation or linear-prediction residuals of all audio frames or some audio frames may be cached, so that the linear prediction excitation or the linear-prediction residuals are used as history linear prediction excitation or history linear-prediction residuals that may be used in a possible next audio frame, to calculate a correlation between the history linear prediction excitation or the history linear-prediction residuals and a linear-prediction residual of the next audio frame.

The correlation between the linear-prediction residual of the foregoing current audio frame and the foregoing first history linear prediction signal may be obtained according to the linear-prediction residual of the current audio frame and the first history linear prediction signal in various manners.

For example, the obtaining a correlation between a linear-prediction residual of the current audio frame and a first history linear prediction signal according to the linear-prediction residual of the foregoing current audio frame and the foregoing first history linear prediction signal may include: calculating the correlation between the linear-prediction residual of the current audio frame and the first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the linear-prediction residual of the current audio frame by a gain factor to obtain a gained linear-prediction residual of the foregoing current audio frame, and obtaining a correlation between the gained linear-prediction residual of the foregoing current audio frame and the first history linear prediction signal by means of calculation, where the correlation, obtained by means of calculation, between the gained linear-prediction residual of the foregoing current audio frame and the foregoing first history linear prediction signal is the correlation between the linear-prediction residual of the foregoing current audio frame and the foregoing first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the first history linear prediction signal by a gain factor to obtain a gained first history linear prediction signal, and obtaining a correlation between the linear-prediction residual of the foregoing current audio frame and the foregoing gained first history linear prediction signal by means of calculation, where the correlation, obtained by means of calculation, between the linear-prediction residual of the foregoing current audio frame and the foregoing gained first history linear prediction signal is the correlation between the linear-prediction residual of the foregoing current audio frame and the foregoing first history linear prediction signal.

The foregoing first history linear prediction excitation or the foregoing first history linear-prediction residual may be determined based on a pitch of the foregoing current audio frame. For example, a time-domain correlation between the foregoing first history linear prediction excitation and the linear-prediction residual of the foregoing current audio frame is greater than or equal to a time-domain correlation between other history linear prediction excitation and the linear-prediction residual of the foregoing current audio frame, or a time-domain correlation between the foregoing first history linear prediction excitation and the linear-prediction residual of the foregoing current audio frame is greater than or equal to a time-domain correlation between at least one other history linear prediction excitation and the linear-prediction residual of the foregoing current audio frame. For example, a time-domain correlation between the foregoing first history linear-prediction residual and the linear-prediction residual of the foregoing current audio frame is greater than or equal to a time-domain correlation between another history linear-prediction residual and the linear-prediction residual of the foregoing current audio frame, or a time-domain correlation between the foregoing first history linear-prediction residual and the linear-prediction residual of the foregoing current audio frame is greater than or equal to a time-domain correlation between at least one other history linear-prediction residual and the linear-prediction residual of the foregoing current audio frame.

In some embodiments of the present disclosure, the foregoing correlation is, for example, a function value of a cross correlation in the time domain and/or a function value of a cross correlation in the frequency domain.

In an optional implementation manner of the present disclosure, when the function value of the cross correlation in the frequency domain is being calculated, time-frequency transformation (for example, discrete fourier transform (DFT, Discrete Fourier Transform) or discrete cosine transform (DCT, discrete Cosine Transform)) may be performed on the linear-prediction residual of the current audio frame to obtain a frequency-domain signal of the linear-prediction residual of the current audio frame, and time-frequency transformation (for example, DFT or DCT) may be performed on the first history linear prediction signal to obtain a frequency-domain signal of the first history linear prediction signal. The following lists a correlation calculation formula, which is shown in Formula 2:

$$C = \frac{\sum_{i=0}^{N-1} R(i) \cdot E(i)}{\sqrt{\sum_{i=0}^{N-1} R(i) \cdot R(i) \times \sum_{i=0}^{N-1} E(i) \cdot E(i)}} \quad \text{(Formula 2)}$$

where C in the foregoing Formula 2 indicates a function value of a cross correlation, in the time domain, of the linear-prediction residual of the current audio frame and the first history linear prediction signal, R(i) indicates a linear-prediction residual of the $i^{th}$ time-domain sampling point of the current audio frame, E(i) indicates a signal of the $i^{th}$ time-domain sampling point of the first history linear prediction signal, and N indicates a total quantity of time-domain sampling points of an audio frame; or C in the foregoing Formula 2 indicates a function value of a cross correlation, in the frequency domain, of the linear-prediction residual of the current audio frame and the first history linear prediction signal, R(i) indicates the $i^{th}$ spectral envelope of the linear-prediction residual of the current audio frame, E(i) indicates a signal of the $i^{th}$ spectral envelope of the first history linear prediction signal, and N indicates a total quantity of spectral envelopes of an audio frame. Certainly, another correlation calculation method is not limited in the present disclosure.

In another embodiment of calculating a frequency-domain correlation in the present disclosure, to better overcome a pitch jitter, shift processing may be first performed on a signal of R(i) or E(i) before a function value of a cross correlation is calculated, which is shown, for example, in Formula 3:

$$C = \frac{\sum_{i=0}^{N-1-j} R(i) \cdot E(i+j)}{\sqrt{\sum_{i=0}^{N-1-j} R(i) \cdot R(i) \times \sum_{i=0}^{N-1-j} E(i+j) \cdot E(i+j)}} \quad \text{(Formula 3)}$$

where on the basis of Formula 2, shift processing is further performed on E (i) in the foregoing Formula 3, j indicates a shift amount and j may be an integer, and a manner of performing shift processing on R(i) is similar to that of performing shift processing on E (i).

In other embodiments of the present disclosure, the foregoing correlation may be, for example, time-domain distortion and/or frequency-domain distortion.

In an optional implementation manner of the present disclosure, when the frequency-domain distortion is being calculated, time-frequency transformation (for example, DFT or DCT) may be performed on the linear-prediction residual of the current audio frame to obtain a frequency-domain signal of the linear-prediction residual of the current audio frame, and time-frequency transformation (for example, DFT or DCT) may be performed on the first history linear prediction signal to obtain a frequency-domain signal of the first history linear prediction signal. Distortion D between the frequency-domain signal of the linear-prediction residual of the current audio frame and the frequency-domain signal of the first history linear prediction signal is calculated.

Smaller distortion D indicates a stronger correlation and higher long-time linear prediction efficiency. The following lists a calculation formula of distortion D, which is shown in Formula 4:

$$D = \sum_{k=0}^{N-1} |R(k) - E(k)| \quad \text{(Formula 4)}$$

where N in Formula 4 may indicate a total quantity of time-domain sampling points of an audio frame, R(k) indicates a linear-prediction residual of the $k^{th}$ time-domain sampling point of the current audio frame, and E(k) indicates a signal of the $k^{th}$ time-domain sampling point of the first history linear prediction signal; or N in Formula 4 may indicate a total quantity of spectral envelopes of an audio frame, R(k) indicates the $k^{th}$ spectral envelope of the linear-prediction residual of the current audio frame, and E(k) indicates the $k^{th}$ spectral envelope of the first history linear prediction signal.

The following lists two other calculation formulas of distortion D, which are shown in Formula 5 or Formula 6:

$$D = \sum_{k=0}^{N-1} |R(k) - E(k) \cdot G| \quad \text{(Formula 5)}$$

-continued $$D = \sum_{k=0}^{N-1} |R(k) \cdot G - E(k)| \quad \text{(Formula 6)}$$

where N in Formula 5 and Formula 6 may indicate a total quantity of time-domain sampling points of an audio frame, R(k) indicates a linear-prediction residual of the $k^{th}$ time-domain sampling point of the current audio frame, and E(k) indicates a signal of the $k^{th}$ time-domain sampling point of the first history linear prediction signal; or N in Formula 5 and Formula 6 may indicate a total quantity of spectral envelopes of an audio frame, R(k) indicates the $k^{th}$ spectral envelope of the linear-prediction residual of the current audio frame, and E(k) indicates the $k^{th}$ spectral envelope of the first history linear prediction signal.

G in Formula 5 and Formula 6 indicates a gain factor, and smallest distortion D can be obtained by selecting a proper value of G. In formula 4, the gain factor G is applied to E(k), and in Formula 5, the gain factor G is applied to R(k).

In some embodiments of the present disclosure, the foregoing frequency-domain distortion may be a sum value or a weighted sum value of distortion of K1 frequency bins in the frequency domain, or the foregoing frequency-domain distortion may be a sum value or a weighted sum value of distortion of K2 sub-bands in the frequency domain, where K1 and K2 are positive integers.

The following further lists three calculation formulas of distortion D, which are shown in Formula 7 or Formula 8 or Formula 9:

$$D = \sum_{k=0}^{N-1} |R(k) - E(k)| \cdot P(k) \quad \text{(Formula 7)}$$

$$D = \sum_{k=0}^{N-1} |R(k) \cdot G - E(k)| \cdot P(k) \quad \text{(Formula 8)}$$

$$D = \sum_{k=0}^{N-1} |R(k) - G \cdot E(k)| \cdot P(k) \quad \text{(Formula 9)}$$

where in Formula 7 to Formula 9, P(k) is a group of weighting coefficients, and P(k) may be a group of perceptual weighting coefficients that reflect a psychoacoustic model or other weighting coefficients.

Meanings of N, R(k), E(k), and G in Formula 7 to Formula 9 are the same as those in Formula 5.

In some embodiments of the present disclosure, the foregoing first history linear prediction excitation may be linear prediction excitation generated by performing audio coding on the history audio frame of the foregoing current audio frame by using a linear prediction based coding scheme.

In some embodiments of the present disclosure, the foregoing first history linear-prediction residual may be obtained based on a time-domain signal of a first history audio frame of the foregoing current audio frame and a linear prediction coefficient of the foregoing first history audio frame, where a linear prediction coefficient of the foregoing first history audio frame is a quantized linear prediction coefficient or an unquantized linear prediction coefficient.

In some embodiments of the present disclosure, the linear-prediction residual of the foregoing current audio frame may be obtained based on a time-domain signal of the foregoing current audio frame and a linear prediction coefficient of the foregoing current audio frame, where the linear prediction coefficient of the foregoing current audio frame may be a quantized linear prediction coefficient or an unquantized linear prediction coefficient.

In some embodiments of the present disclosure, the foregoing first history linear prediction excitation may be superposed excitation of adaptive codebook excitation and fixed codebook excitation, or the foregoing first history linear prediction excitation may be adaptive codebook excitation.

The following further provides related apparatuses for implementing the foregoing solutions.

Referring to FIG. 3-*a*, FIG. 3-*a* is a schematic structural diagram of an audio coder 300 according to another embodiment of the present disclosure.

A time-domain audio signal may be input, in units of frames, to the audio coder 300 provided in this embodiment of the present disclosure, after having undergone coding processing performed by the audio coder 300, the input audio frame may be compressed into a relatively small bitstream. The bitstream may be used for storage or transmission, and the original time-domain audio frame may be restored by using an audio decoder.

The audio coder 300 in this embodiment may include multiple sub-coders, and may specifically include at least one linear prediction based sub-coder (for ease of description, a linear prediction based sub-coder may be referred to as a type-A sub-coder in the following description) and at least one sub-coder which is a sub-code not based on linear prediction (for ease of description, a sub-coder which is not based on linear prediction may be referred to as a type-B sub-coder in the following description).

As shown in FIG. 3-*a*, the audio coder 300 includes a selector 301, a type-A sub-coder 302, a type-B sub-coder 303, and a controlled router 304.

The selector 301 is configured to: estimate reference linear prediction efficiency of a current audio frame; determine an audio coder that matches the reference linear prediction efficiency of the foregoing current audio frame; and send a routing control signal to the controlled router 304, to control the controlled router 304 to output the current audio frame that is input to the controlled router 304 to the audio coder (for example, the A-type sub-coder 302 or the B-type sub-coder 303) that matches the reference linear prediction efficiency of the foregoing current audio frame. The A-type sub-coder 302 or the B-type sub-coder 303 is configured to: perform audio coding on the input current audio frame, and output a coded audio signal. For example, the A-type sub-coder 302 may be a TCX coder, and the B-type sub-coder 303 may be a GAC coder, where for example, the B-type sub-coder 302 may be an MDCT coder.

In some embodiments of the present disclosure, as shown in FIG. 3-*b*, on the basis of the audio coder 300 with an architecture shown in FIG. 3-*a*, a classifier 305 and a sub-coder 306 may be further added.

The classifier 305 is configured to: determine whether the current audio frame is a speech and audio frame; and if the audio frame is a speech and audio frame, send the routing control signal to the controlled router 304, to control the controlled router 304 to output the current audio frame that is input to the controlled router 304 to the sub-coder 306, where the sub-coder 306 is a sub-coder suitable for coding a speech and audio frame, for example, the sub-coder 306 is an ACELP coder. The sub-coder 306 is configured to: perform audio coding on the input current audio frame, and output the coded audio signal.

In some embodiments of the present disclosure, as shown in FIG. 3-*c*, the selector 301 may include a judging unit 3013, a first estimation unit 3011, and a second estimation unit 3022. Reference linear prediction efficiency of an audio frame includes reference long-term linear prediction efficiency and reference short-term linear prediction efficiency of the audio frame.

The first estimation unit 3011 is configured to estimate reference long-term linear prediction efficiency of the current audio frame.

The second estimation unit 3012 is configured to estimate reference short-term linear prediction efficiency of the current audio frame.

The judging unit 3013 is configured to: if the reference long-term linear prediction efficiency of the foregoing current audio frame that is estimated by the first estimation unit 3011 is less than a first threshold and/or the reference short-term linear prediction efficiency of the foregoing current audio frame that is estimated by the second estimation unit 3012 is less than a second threshold, determine that an audio coding scheme that matches the reference linear prediction efficiency of the foregoing current audio frame is an audio coding scheme not based on linear prediction, and send the routing control signal to the controlled router 304, to control the controlled router 304 to output the current audio frame that is input to the controlled router 304 to the B-type sub-coder 303; or if the reference long-term linear prediction efficiency of the foregoing current audio frame that is estimated by the first estimation unit 3011 is greater than or equal to a first threshold and/or the reference short-term linear prediction efficiency of the foregoing current audio frame that is estimated by the second estimation unit 3012 is greater than or equal to a second threshold, determine that an audio coding scheme that matches the reference linear prediction efficiency of the foregoing current audio frame is a linear prediction based audio coding scheme, and send the routing control signal to the controlled router 304, to control the controlled router 304 to output the current audio frame that is input to the controlled router 304 to the A-type sub-coder 302.

In some embodiments of the present disclosure, as shown in FIG. 3-*d* and FIG. 3-*e*, the selector 301 does not include the first estimation unit 3011 or does not include the second estimation unit 3012.

In an architecture shown in FIG. 3-*d*, the judging unit 3013 may be configured to: if the reference long-term linear prediction efficiency of the foregoing current audio frame that is estimated by the first estimation unit 3011 is less than a first threshold, determine that an audio coding scheme that matches the reference linear prediction efficiency of the foregoing current audio frame is an audio coding scheme not based on linear prediction, and send the routing control signal to the controlled router 304, to control the controlled router 304 to output the current audio frame that is input to the controlled router 304 to the B-type sub-coder 303; or if the reference long-term linear prediction efficiency of the foregoing current audio frame that is estimated by the first estimation unit 3011 is greater than or equal to a first threshold, determine that an audio coding scheme that matches the reference linear prediction efficiency of the foregoing current audio frame is a linear prediction based audio coding scheme, and send the routing control signal to the controlled router 304, to control the controlled router 304 to output the current audio frame that is input to the controlled router 304 to the A-type sub-coder 302.

In an architecture shown in FIG. 3-*e*, the judging unit 3013 may be configured to: if the reference short-term linear prediction efficiency of the foregoing current audio frame that is estimated by the second estimation unit 3012 is less than a second threshold, determine that an audio coding scheme that matches the reference linear prediction efficiency of the foregoing current audio frame is an audio coding scheme not based on linear prediction, and send the routing control signal to the controlled router 304, to control the controlled router 304 to output the current audio frame that is input to the controlled router 304 to the B-type sub-coder 303; or if the reference short-term linear prediction efficiency of the foregoing current audio frame that is estimated by the second estimation unit 3012 is greater than or equal to a second threshold, determine that an audio coding scheme that matches the reference linear prediction efficiency of the foregoing current audio frame is a linear prediction based audio coding scheme, and send the routing control signal to the controlled router 304, to control the controlled router 304 to output the current audio frame that is input to the controlled router 304 to the A-type sub-coder 302.

In some embodiments of the present disclosure, as shown in FIG. 3-*f*, on the basis of the audio coder 300 with an architecture shown in FIG. 3-*c*, the audio coder 300 may further include a preprocessor 3014, configured to obtain a linear-prediction residual of the current audio frame, where the preprocessor 3014 may be specifically configured to filter a time-domain signal of the current audio frame by using an analysis filter A (Z), to obtain the linear-prediction residual R of the current audio frame, where a filter coefficient of the filter A (Z) is a linear prediction coefficient of the current audio frame.

The first estimation unit 3011 is specifically configured to: obtain a correlation between the linear-prediction residual of the current audio frame and a first history linear prediction signal according to the linear-prediction residual of the foregoing current audio frame and the foregoing first history linear prediction signal, and obtain, based on a mapping relationship between the correlation and long-term linear prediction efficiency of the current audio frame, the long-term linear prediction efficiency that is of the foregoing current audio frame and is in the mapping relationship with the foregoing calculated correlation, where the foregoing first history linear prediction signal is first history linear prediction excitation or a first history linear-prediction residual, the foregoing first history linear-prediction residual is a linear-prediction residual of a history audio frame of the foregoing current audio frame (for example, the foregoing first history linear-prediction residual may be a linear-prediction residual of a history audio frame that is of the current audio frame and whose duration is the same as or similar to that of the foregoing current audio frame, or the foregoing first history linear-prediction residual may be linear-prediction residuals of some consecutive audio signals of two adjacent history audio frames that are of the foregoing current audio frame and whose duration is the same as or similar to that of the foregoing current audio frame), and the foregoing first history linear prediction excitation is linear prediction excitation of the history audio frame of the foregoing current audio frame (for example, the foregoing first history linear prediction excitation may be linear prediction excitation of a history audio frame that is of the foregoing current audio frame and whose duration is the same as or similar to that of the foregoing current audio frame, or the foregoing first history linear prediction excitation may be linear prediction excitation of some consecutive audio signals of two adjacent history audio frames that are of the current audio frame and whose duration is the same as or similar to that of the foregoing current audio frame).

In some embodiments of the present disclosure, as shown in FIG. 3-*g*, on the basis of the audio coder 300 with an architecture shown in FIG. 3-*f*, the audio coder 300 may further include a cache 308, where the cache 308 may cache linear prediction excitation or linear-prediction residuals of all audio frames or some audio frames, so that the linear prediction excitation or the linear-prediction residuals are used as history linear prediction excitation or history linear-prediction residuals that may be used in a possible next audio frame, to calculate a correlation between the history linear prediction excitation or the history linear-prediction residuals and a linear-prediction residual of the next audio frame. The first estimation unit 3011 may obtain the first history linear prediction signal from the cache 308.

In some embodiments of the present disclosure, as shown in FIG. 3-*h*, history linear prediction excitation or a history linear-prediction residual cached by the cache 308 may be from a local audio decoder 311. The local audio decoder 311 may perform decoding processing on a coded audio frame that is output after being obtained by coding by the A-type sub-coder 302 and the B-type sub-coder 303 and output a decoded audio frame, and a linear predictor 312 may perform linear prediction on a time-domain audio frame output by the local audio decoder 311, to obtain a linear-prediction residual or linear prediction excitation of the audio frame.

In some embodiments of the present disclosure, as shown in FIG. 3-*i*, history linear prediction excitation cached by the cache 308 may also be from the A-type sub-coder 302, where the A-type sub-coder 302 obtains linear prediction excitation of an audio frame in a process of coding the audio frame, and the A-type sub-coder 302 may output the obtained linear prediction excitation of the audio frame to the cache 308 for caching.

In some embodiments of the present disclosure, the first history linear prediction excitation or the foregoing first history linear-prediction residual used by the first estimation unit 3011 to estimate the long-term linear prediction efficiency of the current audio frame may be determined based on a pitch of the foregoing current audio frame. For example, a time-domain correlation between the foregoing first history linear prediction excitation and the linear-prediction residual of the foregoing current audio frame is greater than or equal to a time-domain correlation between other history linear prediction excitation cached by the cache 308 and the linear-prediction residual of the foregoing current audio frame; or a time-domain correlation between the foregoing first history linear prediction excitation and the linear-prediction residual of the foregoing current audio frame is greater than or equal to a time-domain correlation between at least one other history linear prediction excitation cached by the cache 308 and the linear-prediction residual of the foregoing current audio frame. For example, a time-domain correlation between the foregoing first history linear-prediction residual and the linear-prediction residual of the foregoing current audio frame is greater than or equal to a time-domain correlation between another history linear-prediction residual cached by the cache 308 and the linear-prediction residual of the foregoing current audio frame; or a time-domain correlation between the foregoing first history linear-prediction residual and the linear-prediction residual of the foregoing current audio frame is greater than or equal to a time-domain correlation between at least one other history linear-prediction residual cached by the cache 308 and the linear-prediction residual of the foregoing current audio frame.

The audio coder 300 may be any apparatus that needs to collect, store, or transmit outwards an audio signal, for example, a mobile phone, a tablet computer, a personal computer, or a notebook computer.

Figure 4:
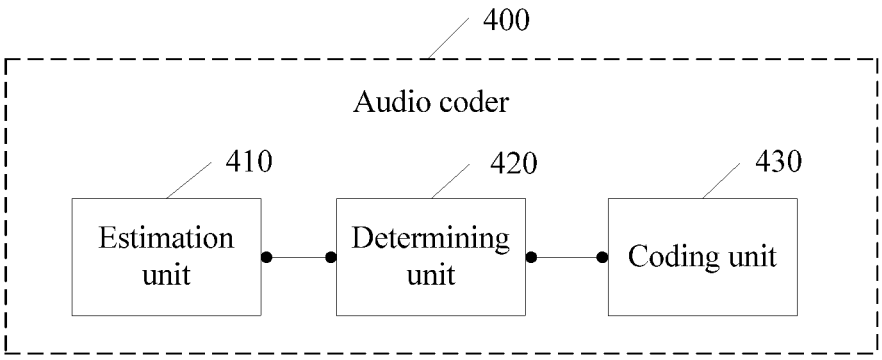
FIG. 4 is a schematic structural diagram of another audio coder according to another embodiment of the present disclosure.

Referring to FIG. 4, FIG. 4 is a schematic structural diagram of an audio coder 400 according to another embodiment of the present disclosure. The audio coder 400 may include an estimation unit 410, a determining unit 420, and a coding unit 430.

The estimation unit 410 is configured to estimate reference linear prediction efficiency of a current audio frame.

The determining unit 420 is configured to determine an audio coding scheme that matches the reference linear prediction efficiency of the foregoing current audio frame that is estimated by the estimation unit 410.

The coding unit 430 is configured to perform audio coding on the foregoing current audio frame according to the audio coding scheme that matches the reference linear prediction efficiency of the foregoing current audio frame and that is determined by the determining unit 420.

In the embodiments of the present disclosure, reference linear prediction efficiency of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher reference linear prediction efficiency of an audio frame (for example, a current audio frame or a history audio frame of a current audio frame) indicates a larger extent to which linear prediction can be performed on the audio frame.

In some embodiments of the present disclosure, the foregoing reference linear prediction efficiency includes at least one of the following linear prediction efficiency: reference long-term linear prediction efficiency, reference short-term linear prediction efficiency, and reference integrated linear prediction efficiency, where the foregoing reference integrated linear prediction efficiency is obtained based on the foregoing reference long-term linear prediction efficiency and the foregoing reference short-term linear prediction efficiency.

For example, reference long-term linear prediction efficiency of the current audio frame may be obtained based on long-term linear prediction efficiency of the current audio frame, reference short-term linear prediction efficiency of the current audio frame may be obtained based on short-term linear prediction efficiency of the current audio frame, and reference integrated linear prediction efficiency of the current audio frame may be obtained, for example, based on long-term linear prediction efficiency and short-term linear prediction efficiency of the current audio frame.

It may be understood that, a value range of the reference linear prediction efficiency may be 0-1 (that is, 0-100%), or a value range may be 0-x1 (where x1 is a positive number); a value range of the reference long-term linear prediction efficiency may be 0-1 (that is, 0-100%), or a value range may be 0-x2 (where x2 is a positive number); a value range of the reference short-term linear prediction efficiency may be 0-1 (that is, 0-100%), or a value range may be 0-x3 (where x3 is a positive number); a value range of the reference integrated linear prediction efficiency may be 0-1 (that is, 0-100%), or a value range may be 0-x4 (where x4 is a positive number); a value range of the long-term linear prediction efficiency may be 0-1 (that is, 0-100%), or a value range may be 0-x5 (where x5 is a positive number); and a value range of the short-term linear prediction efficiency may be 0-1 (that is, 0-100%), or a value range may be 0-x6 (where x6 is a positive number), where x1, x2, x3, x4, x5, or x6 may be, for example, 0.5, 0.8, 1.5, 2, 5, 10, 50, 100, or another positive number.

In some embodiments of the present disclosure, the estimation unit may be specifically configured to estimate the reference linear prediction efficiency of the foregoing current audio frame when the current audio frame is a non-speech and audio frame.

In some embodiments of the present disclosure, reference integrated linear prediction efficiency of an audio frame (for example, a current audio frame or another audio frame) is obtained based on reference long-term linear prediction efficiency of the audio frame and reference short-term linear prediction efficiency of the audio frame. The reference integrated linear prediction efficiency of the foregoing current audio frame may be, for example, a sum value, a weighted sum value (where a weighted value corresponding to the weighted sum value herein may be set according to an actual requirement, and a weighted value may be, for example, 0.5, 1, 2, 3, 5, 10, or another value), or an average value of the reference long-term linear prediction efficiency of the foregoing current audio frame and the reference short-term linear prediction efficiency of the current audio frame. Certainly, the reference integrated linear prediction efficiency of the foregoing current audio frame may also be obtained, by using another algorithm, based on the reference long-term linear prediction efficiency of the foregoing current audio frame and the reference short-term linear prediction efficiency of the current audio frame.

It may be understood that because the reference linear prediction efficiency of the foregoing current audio frame includes different types of linear prediction efficiency, there may be different specific manners of determining, by the determining unit 420, the audio coding scheme that matches the reference linear prediction efficiency of the foregoing current audio frame.

The following illustrates some possible embodiment manners by using examples.

In some embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining unit 420 may be specifically configured to: if the reference long-term linear prediction efficiency of the foregoing current audio frame is less than a first threshold and/or the reference short-term linear prediction efficiency of the foregoing current audio frame is less than a second threshold, determine that the audio coding scheme that matches the reference linear prediction efficiency of the foregoing current audio frame is an audio coding scheme not based on linear prediction.

In still other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining unit 420 may be specifically configured to: if the reference long-term linear prediction efficiency of the foregoing current audio frame is greater than or equal to a first threshold and/or the reference short-term linear prediction efficiency of the foregoing current audio frame is greater than or equal to a second threshold, determine that the audio coding scheme that matches the reference linear prediction efficiency of the foregoing current audio frame is a linear prediction based audio coding scheme.

In other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, the determining unit 420 may be specifically configured to: if the reference long-term linear prediction efficiency of the foregoing current audio frame is less than a first threshold and/or the reference short-term linear prediction efficiency of the foregoing current audio frame is less than a second threshold, determine that the audio coding scheme that matches the reference linear prediction efficiency of the foregoing current audio frame is an audio coding scheme not based on linear prediction; or if the reference long-term linear prediction efficiency of the foregoing current audio frame is greater than or equal to a first threshold and/or the reference short-term linear prediction efficiency of the foregoing current audio frame is greater than or equal to a second threshold, determine that the audio coding scheme that matches the reference linear prediction efficiency of the foregoing current audio frame is a linear prediction based audio coding scheme.

In some embodiments of the present disclosure, if the reference linear prediction efficiency of the foregoing current audio frame includes the reference long-term linear prediction efficiency of the foregoing current audio frame, the determining unit 420 may be specifically configured to: if the reference long-term linear prediction efficiency of the foregoing current audio frame is greater than or equal to a third threshold, determine that the audio coding scheme that matches the reference linear prediction efficiency of the foregoing current audio frame is a linear prediction based audio coding scheme.

In still other embodiments of the present disclosure, if the reference linear prediction efficiency of the foregoing current audio frame includes the reference long-term linear prediction efficiency of the foregoing current audio frame, the determining unit 420 may be specifically configured to: if the reference long-term linear prediction efficiency of the foregoing current audio frame is less than a fourth threshold, determine that the audio coding scheme that matches the reference linear prediction efficiency of the foregoing current audio frame is an audio coding scheme not based on linear prediction.

In other embodiments of the present disclosure, if the reference linear prediction efficiency of the foregoing current audio frame includes the reference long-term linear prediction efficiency of the foregoing current audio frame, the determining unit 420 may be specifically configured to: if the reference long-term linear prediction efficiency of the foregoing current audio frame is greater than or equal to a third threshold, determine that the audio coding scheme that matches the reference linear prediction efficiency of the foregoing current audio frame is a linear prediction based audio coding scheme; or if the reference long-term linear prediction efficiency of the foregoing current audio frame is less than a fourth threshold, determine that the audio coding scheme that matches the reference linear prediction efficiency of the foregoing current audio frame is an audio coding scheme not based on linear prediction.

In other embodiments of the present disclosure, if the reference linear prediction efficiency of the foregoing current audio frame includes the reference long-term linear prediction efficiency of the foregoing current audio frame, the determining unit 420 is specifically configured to: determine a first linear prediction efficiency interval within which the reference long-term linear prediction efficiency of the foregoing current audio frame falls, and determine, according to a mapping relationship between a linear prediction efficiency interval and a linear prediction based audio coding scheme, a first audio coding scheme that is in a mapping relationship with the foregoing first linear prediction efficiency interval, where the foregoing first audio coding scheme is an audio coding scheme that matches the reference linear prediction efficiency of the foregoing current audio frame, and the foregoing first audio coding scheme is a linear prediction based audio coding scheme or an audio coding scheme not based on linear prediction.

In other embodiments of the present disclosure, if the reference linear prediction efficiency of the foregoing current audio frame includes the reference short-term linear prediction efficiency of the foregoing current audio frame, the foregoing determining unit 420 is specifically configured to: if the reference short-term linear prediction efficiency of the foregoing current audio frame is greater than or equal to a fifth threshold, determine that the audio coding scheme that matches the reference linear prediction efficiency of the foregoing current audio frame is a linear prediction based audio coding scheme.

In other embodiments of the present disclosure, if the reference linear prediction efficiency of the foregoing current audio frame includes the reference short-term linear prediction efficiency of the foregoing current audio frame, the foregoing determining unit 420 is specifically configured to: if the reference short-term linear prediction efficiency of the foregoing current audio frame is less than a fifth threshold, determine that the audio coding scheme that matches the reference linear prediction efficiency of the foregoing current audio frame is an audio coding scheme not based on linear prediction.

In other embodiments of the present disclosure, if the reference linear prediction efficiency of the foregoing current audio frame includes the reference short-term linear prediction efficiency of the foregoing current audio frame, the determining unit 420 is specifically configured to: if the reference short-term linear prediction efficiency of the foregoing current audio frame is greater than or equal to a fifth threshold, determine that the audio coding scheme that matches the reference linear prediction efficiency of the foregoing current audio frame is a linear prediction based audio coding scheme; or if the reference short-term linear prediction efficiency of the foregoing current audio frame is less than a fifth threshold, determine that the audio coding scheme that matches the reference linear prediction efficiency of the foregoing current audio frame is an audio coding scheme not based on linear prediction.

In other embodiments of the present disclosure, if the reference linear prediction efficiency of the foregoing current audio frame includes the reference short-term linear prediction efficiency of the foregoing current audio frame, the determining unit 420 is specifically configured to: determine a second linear prediction efficiency interval within which the reference short-term linear prediction efficiency of the foregoing current audio frame falls, and determine, according to a mapping relationship between a linear prediction efficiency interval and a linear prediction based audio coding scheme, a second audio coding scheme that is in a mapping relationship with the foregoing second linear prediction efficiency interval, where the foregoing second audio coding scheme is an audio coding scheme that matches the reference linear prediction efficiency of the foregoing current audio frame, and the foregoing second audio coding scheme is a linear prediction based audio coding scheme or an audio coding scheme not based on linear prediction.

In other embodiments of the present disclosure, if the reference linear prediction efficiency of the foregoing current audio frame includes the reference integrated linear prediction efficiency of the foregoing current audio frame, the foregoing determining unit 420 is specifically configured to: if the reference integrated linear prediction efficiency of the foregoing current audio frame is greater than or equal to a sixth threshold, determine that the audio coding scheme that matches the reference linear prediction efficiency of the foregoing current audio frame is a linear prediction based audio coding scheme.

In other embodiments of the present disclosure, if the reference linear prediction efficiency of the foregoing current audio frame includes the reference integrated linear prediction efficiency of the foregoing current audio frame, the foregoing determining unit 420 is specifically configured to: if the reference integrated linear prediction efficiency of the foregoing current audio frame is less than a sixth threshold, determine that the audio coding scheme that matches the reference linear prediction efficiency of the foregoing current audio frame is an audio coding scheme not based on linear prediction.

In other embodiments of the present disclosure, if the reference linear prediction efficiency of the foregoing current audio frame includes the reference integrated linear prediction efficiency of the foregoing current audio frame, the foregoing determining unit 420 is specifically configured to: if the reference integrated linear prediction efficiency of the foregoing current audio frame is greater than or equal to a sixth threshold, determine that the audio coding scheme that matches the reference linear prediction efficiency of the foregoing current audio frame is a linear prediction based audio coding scheme; or if the reference integrated linear prediction efficiency of the foregoing current audio frame is less than a sixth threshold, determine that the audio coding scheme that matches the reference linear prediction efficiency of the foregoing current audio frame is an audio coding scheme not based on linear prediction.

In other embodiments of the present disclosure, if the reference linear prediction efficiency of the foregoing current audio frame includes the reference integrated linear prediction efficiency of the foregoing current audio frame, the determining unit 420 is specifically configured to: determine a third linear prediction efficiency interval within which the reference integrated linear prediction efficiency of the foregoing current audio frame falls, and determine, according to a mapping relationship between a linear prediction efficiency interval and a linear prediction based audio coding scheme, a third audio coding scheme that is in a mapping relationship with the foregoing third linear prediction efficiency interval, where the foregoing third audio coding scheme is an audio coding scheme that matches the reference linear prediction efficiency of the foregoing current audio frame, and the foregoing third audio coding scheme is a linear prediction based audio coding scheme or an audio coding scheme not based on linear prediction.

In some embodiments of the present disclosure, the linear prediction based audio coding scheme may include ACELP coding, TCX, and the like; the non-linear prediction based audio coding scheme may include GAC, where the GAC may include, for example, MDCT coding or DCT coding.

It may be understood that specific values of the thresholds (for example, the first threshold, the second threshold, the third threshold, the fourth threshold, the fifth threshold, and the sixth threshold) mentioned in the foregoing examples may be set according to a requirement or according to an application environment and an application scenario. For example, if a value range of the reference long-term linear prediction efficiency of the foregoing current audio frame is 0-1, a value of the first threshold may be 0.2, 0.5, 0.6, 0.8, or the like, if a value range of the reference short-term linear prediction efficiency of the foregoing current audio frame is 0-1, a value of the second threshold may be 0.3, 0.3, 0.6, 0.8, or the like, and another scenario is deduced from this. Further, values of the thresholds may further be adjusted in a dynamic and adaptive manner according to a requirement.

It may be understood that different types of linear prediction efficiency included in the reference linear prediction efficiency of the foregoing current audio frame may be specifically estimated by the estimation unit 410 in different manners. The following uses some possible embodiment manners as examples to perform description.

In some embodiments of the present disclosure, in an aspect of estimating the reference long-term linear prediction efficiency of the current audio frame, the estimation unit 410 is specifically configured to estimate the long-term linear prediction efficiency of the current audio frame, where the long-term linear prediction efficiency of the foregoing current audio frame is the reference long-term linear prediction efficiency of the foregoing current audio frame.

In other embodiments of the present disclosure, in an aspect of estimating the reference long-term linear prediction efficiency of the foregoing current audio frame, the estimation unit 410 is specifically configured to: obtain the long-term linear prediction efficiency of the current audio frame by means of estimation; acquire linear prediction efficiency of N1 history audio frames of the foregoing current audio frame; and calculate a first statistical value of the linear prediction efficiency of the foregoing N1 history audio frames and the long-term linear prediction efficiency of the foregoing current audio frame, where N1 is a positive integer, the foregoing first statistical value is the reference long-term linear prediction efficiency of the foregoing current audio frame, linear prediction efficiency of each history audio frame of N11 history audio frames is at least one of the following linear prediction efficiency: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N11 history audio frames are a subset of the foregoing N1 history audio frames. The first statistical value, obtained by means of calculation, of the linear prediction efficiency of the foregoing N1 history audio frames and the long-term linear prediction efficiency of the foregoing current audio frame may be, for example, a sum value, a weighted sum value, a geometric average value, an arithmetic average value, a moving average value, or a weighted average value of the linear prediction efficiency of the foregoing N1 history audio frames and the long-term linear prediction efficiency of the foregoing current audio frame.

In other embodiments of the present disclosure, in an aspect of estimating the reference long-term linear prediction efficiency of the foregoing current audio frame, the estimation unit 410 is specifically configured to: obtain the long-term linear prediction efficiency of the current audio frame by means of estimation; acquire reference linear prediction efficiency of N2 history audio frames of the foregoing current audio frame; and calculate a second statistical value of the reference linear prediction efficiency of the foregoing N2 history audio frames and the long-term linear prediction efficiency of the foregoing current audio frame, where N2 is a positive integer, the foregoing second statistical value is the reference long-term linear prediction efficiency of the foregoing current audio frame, reference linear prediction efficiency of each history audio frame of N21 history audio frames is at least one of the following linear prediction efficiency: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N21 history audio frames are a subset of the foregoing N2 history audio frames. The second statistical value, obtained by means of calculation, of the reference linear prediction efficiency of the foregoing N2 history audio frames and the long-term linear prediction efficiency of the foregoing current audio frame is, for example, a sum value, a weighted sum value, a geometric average value, an arithmetic average value, a moving average value, or a weighted average value of the reference linear prediction efficiency of the foregoing N2 history audio frames and the long-term linear prediction efficiency of the foregoing current audio frame.

In other embodiments of the present disclosure, in an aspect of estimating the reference long-term linear prediction efficiency of the foregoing current audio frame, the estimation unit 410 is specifically configured to: obtain the long-term linear prediction efficiency of the current audio frame by means of estimation; acquire reference linear prediction efficiency of N4 history audio frames of the foregoing current audio frame; acquire linear prediction efficiency of N3 history audio frames of the foregoing current audio frame; and calculate a third statistical value of the linear prediction efficiency of the foregoing N3 history audio frames, the reference linear prediction efficiency of the foregoing N4 history audio frames, and the long-term linear prediction efficiency of the foregoing current audio frame, where N3 and N4 are positive integers, the foregoing third statistical value is the reference long-term linear prediction efficiency of the foregoing current audio frame, linear prediction efficiency of each history audio frame of N31 history audio frames is at least one of the following linear prediction efficiency: long-term linear prediction efficiency, short-term linear prediction efficiency, and integrated linear prediction efficiency, reference linear prediction efficiency of each history audio frame of N41 history audio frames is at least one of the following linear prediction efficiency: reference long-term linear prediction efficiency, reference short-term linear prediction efficiency, and reference integrated linear prediction efficiency, the foregoing N31 history audio frames are a subset of the foregoing N3 history audio frames, the foregoing N41 history audio frames are a subset of the foregoing N4 history audio frames, integrated linear prediction efficiency of each history audio frame is obtained based on long-term linear prediction efficiency and short-term linear prediction efficiency of each history audio frame, and reference integrated linear prediction efficiency of each history audio frame is obtained based on reference long-term linear prediction efficiency and reference short-term linear prediction efficiency of each history audio frame. The third statistical value, obtained by means of calculation, of the linear prediction efficiency of the foregoing N3 history audio frames, the reference linear prediction efficiency of the foregoing N4 history audio frames, and the long-term linear prediction efficiency of the foregoing current audio frame is, for example, a sum value, a weighted sum value, a geometric average value, an arithmetic average value, a moving average value, or a weighted average value of the linear prediction efficiency of the foregoing N3 history audio frames, the reference linear prediction efficiency of the foregoing N4 history audio frames, and the long-term linear prediction efficiency of the foregoing current audio frame.

In some embodiments of the present disclosure, in an aspect of estimating the reference short-term linear prediction efficiency of the foregoing current audio frame, the foregoing estimation unit 410 may be specifically configured to estimate short-term linear prediction efficiency of the current audio frame, where the short-term linear prediction efficiency of the foregoing current audio frame is the reference short-term linear prediction efficiency of the foregoing current audio frame.

In other embodiments of the present disclosure, in an aspect of estimating the reference short-term linear prediction efficiency of the foregoing current audio frame, the foregoing estimation unit 410 may be specifically configured to: obtain the short-term linear prediction efficiency of the current audio frame by means of estimation; acquire linear prediction efficiency of N5 history audio frames of the foregoing current audio frame; and calculate a fourth statistical value of the linear prediction efficiency of the foregoing N5 history audio frames and the short-term linear prediction efficiency of the foregoing current audio frame, where N5 is a positive integer, the foregoing fourth statistical value is the reference short-term linear prediction efficiency of the foregoing current audio frame, linear prediction efficiency of each history audio frame of N51 history audio frames is at least one of the following linear prediction efficiency: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N51 history audio frames are a subset of the foregoing N5 history audio frames. The fourth statistical value, obtained by means of calculation, of the linear prediction efficiency of the foregoing N5 history audio frames and the short-term linear prediction efficiency of the foregoing current audio frame may be a sum value, a weighted sum value, a geometric average value, an arithmetic average value, a moving average value, or a weighted average value of the linear prediction efficiency of the foregoing N5 history audio frames and the short-term linear prediction efficiency of the foregoing current audio frame.

In other embodiments of the present disclosure, in an aspect of estimating the reference short-term linear prediction efficiency of the foregoing current audio frame, the foregoing estimation unit 410 may be specifically configured to: obtain the short-term linear prediction efficiency of the current audio frame by means of estimation; acquire reference linear prediction efficiency of N6 history audio frames of the foregoing current audio frame; and calculate a fifth statistical value of the reference linear prediction efficiency of the foregoing N6 history audio frames and the short-term linear prediction efficiency of the foregoing current audio frame, where N6 is a positive integer, the foregoing fifth statistical value is the reference short-term linear prediction efficiency of the foregoing current audio frame, reference linear prediction efficiency of each history audio frame of N61 history audio frames is at least one of the following linear prediction efficiency: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N61 history audio frames are a subset of the foregoing N6 history audio frames. The fifth statistical value, obtained by the estimation unit 410 by means of calculation, of the reference linear prediction efficiency of the foregoing N6 history audio frames and the short-term linear prediction efficiency of the foregoing current audio frame may be a sum value, a weighted sum value, a geometric average value, an arithmetic average value, a moving average value, or a weighted average value of the reference linear prediction efficiency of the foregoing N6 history audio frames and the short-term linear prediction efficiency of the foregoing current audio frame.

In other embodiments of the present disclosure, in an aspect of estimating the reference short-term linear prediction efficiency of the foregoing current audio frame, the foregoing estimation unit 410 may be specifically configured to: obtain the short-term linear prediction efficiency of the current audio frame by means of estimation; acquire reference linear prediction efficiency of N8 history audio frames of the foregoing current audio frame; acquire linear prediction efficiency of N7 history audio frames of the foregoing current audio frame; and calculate a sixth statistical value of the linear prediction efficiency of the foregoing N7 history audio frames, the reference linear prediction efficiency of the foregoing N8 history audio frames, and the short-term linear prediction efficiency of the foregoing current audio frame, where N7 and N8 are positive integers, the foregoing sixth statistical value is the reference short-term linear prediction efficiency of the foregoing current audio frame, linear prediction efficiency of each history audio frame of N71 history audio frames is at least one of the following linear prediction efficiency: long-term linear prediction efficiency, short-term linear prediction efficiency, and integrated linear prediction efficiency, reference linear prediction efficiency of each history audio frame of N81 history audio frames is at least one of the following linear prediction efficiency: reference long-term linear prediction efficiency, reference short-term linear prediction efficiency, and reference integrated linear prediction efficiency, integrated linear prediction efficiency of each history audio frame is obtained based on long-term linear prediction efficiency and short-term linear prediction efficiency of each history audio frame, reference integrated linear prediction efficiency of each history audio frame is obtained based on reference long-term linear prediction efficiency and reference short-term linear prediction efficiency of each history audio frame, the foregoing N71 history audio frames are a subset of the foregoing N7 history audio frames, and the foregoing N81 history audio frames are a subset of the foregoing N8 history audio frames. The sixth statistical value, obtained by means of calculation, of the linear prediction efficiency of the foregoing N7 history audio frames, the reference linear prediction efficiency of the foregoing N8 history audio frames, and the short-term linear prediction efficiency of the foregoing current audio frame may be a sum value, a weighted sum value, a geometric average value, an arithmetic average value, a moving average value, or a weighted average value of the linear prediction efficiency of the foregoing N7 history audio frames, the reference linear prediction efficiency of the foregoing N8 history audio frames, and the short-term linear prediction efficiency of the foregoing current audio frame.

In some embodiments of the present disclosure, linear prediction efficiency (for example, long-term linear prediction efficiency or short-term linear prediction efficiency) of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher linear prediction efficiency (for example, long-term linear prediction efficiency or short-term linear prediction efficiency) of an audio frame (for example, a current audio frame or a history audio frame of a current audio frame) indicates a larger extent to which linear prediction can be performed on the audio frame.

In some embodiments of the present disclosure, in the aspect of obtaining the short-term linear prediction efficiency of the current audio frame by means of estimation, the estimation unit 410 is specifically configured to obtain the short-term linear prediction efficiency of the current audio frame based on a linear-prediction residual of the current audio frame.

In some embodiments of the present disclosure, in the aspect of obtaining the short-term linear prediction efficiency of the current audio frame based on a linear-prediction residual of the current audio frame, the estimation unit 410 may be specifically configured to calculate a change rate of energy that are of the current audio frame and obtained before and after short-term linear prediction is performed on the current audio frame, where the foregoing energy change rate is the short-term linear prediction efficiency of the foregoing current audio frame, or the short-term linear prediction efficiency of the foregoing current audio frame is obtained by means of transformation based on the foregoing energy change rate, and the energy that is of the foregoing current audio frame and obtained after the short-term linear prediction is performed on the current audio frame is energy of the linear-prediction residual of the foregoing current audio frame. For example, there may be a mapping relationship between the energy change rate and the short-term linear prediction efficiency of the current audio frame, and the short-term linear prediction efficiency that is of the current audio frame and is in the mapping relationship with the foregoing calculated energy change rate may be obtained based on the mapping relationship between the energy change rate and the short-term linear prediction efficiency of the current audio frame. Generally, a larger change rate of the energy that are of the current audio frame and obtained before and after the short-term linear prediction is performed on the current audio frame indicates higher short-term linear prediction efficiency of the current audio frame.

In some embodiments of the present disclosure, the change rate of the energy that are of the foregoing current audio frame and obtained before and after the short-term linear prediction is performed on the current audio frame is a ratio of the energy that is of the foregoing current audio frame and obtained before the short-term linear prediction is performed on the current audio frame to the energy of the linear-prediction residual of the foregoing current audio frame. Generally, a larger ratio obtained by dividing the energy that is of the foregoing current audio frame and obtained before the short-term linear prediction is performed on the current audio frame by the energy of the linear-prediction residual of the foregoing current audio frame indicates higher short-term linear prediction efficiency of the current audio frame.

In some embodiments of the present disclosure, in the aspect of obtaining the long-term linear prediction efficiency of the current audio frame by means of estimation, the foregoing estimation unit 410 may be specifically configured to obtain a correlation between a linear-prediction residual of the current audio frame and a first history linear prediction signal according to calculating the linear-prediction residual of the current audio frame and the first history linear prediction signal, where the foregoing correlation is the long-term linear prediction efficiency of the foregoing current audio frame, or the long-term linear prediction efficiency of the foregoing current audio frame is obtained based on the foregoing correlation, the foregoing first history linear prediction signal is first history linear prediction excitation or a first history linear-prediction residual, the first history linear-prediction residual is a linear-prediction residual of a history audio frame of the foregoing current audio frame (for example, the foregoing first history linear-prediction residual may be a linear-prediction residual of a history audio frame that is of the current audio frame and whose duration is the same as or similar to that of the foregoing current audio frame, or the foregoing first history linear-prediction residual may be linear-prediction residuals of some consecutive audio signals of two adjacent history audio frames that are of the foregoing current audio frame and whose duration is the same as or similar to that of the foregoing current audio frame), and the foregoing first history linear prediction excitation is linear prediction excitation of the history audio frame of the foregoing current audio frame (for example, the foregoing first history linear prediction excitation may be linear prediction excitation of a history audio frame that is of the foregoing current audio frame and whose duration is the same as or similar to that of the foregoing current audio frame, or the foregoing first history linear prediction excitation may be linear prediction excitation of some consecutive audio signals of two adjacent history audio frames that are of the current audio frame and whose duration is the same as or similar to that of the foregoing current audio frame).

The correlation between the linear-prediction residual of the foregoing current audio frame and the foregoing first history linear prediction signal may be obtained by the estimation unit 410 according to the linear-prediction residual of the current audio frame and the first history linear prediction signal in various manners.

In some embodiments of the present disclosure, in the aspect of obtaining a correlation between a linear-prediction residual of the current audio frame and a first history linear prediction signal according to calculating the linear-prediction residual of the current audio frame and the first history linear prediction signal, the foregoing estimation unit 410 may be specifically configured to: calculate the correlation between the linear-prediction residual of the current audio frame and the first history linear prediction signal; or multiply the linear-prediction residual of the current audio frame by a gain factor to obtain a gained linear-prediction residual of the foregoing current audio frame, and obtain a correlation between the gained linear-prediction residual of the foregoing current audio frame and the first history linear prediction signal by means of calculation, where the correlation, obtained by means of calculation, between the gained linear-prediction residual of the foregoing current audio frame and the foregoing first history linear prediction signal is the correlation between the linear-prediction residual of the foregoing current audio frame and the foregoing first history linear prediction signal;

or multiply the first history linear prediction signal by a gain factor to obtain a gained first history linear prediction signal, and obtain a correlation between the linear-prediction residual of the foregoing current audio frame and the foregoing gained first history linear prediction signal by means of calculation, where the correlation, obtained by means of calculation, between the linear-prediction residual of the foregoing current audio frame and the foregoing gained first history linear prediction signal is the correlation between the linear-prediction residual of the foregoing current audio frame and the foregoing first history linear prediction signal.

Generally, a larger correlation between the linear-prediction residual of the foregoing current audio frame and the foregoing first history linear prediction signal indicates higher long-term linear prediction efficiency of the foregoing current audio frame.

In some embodiments of the present disclosure, the foregoing first history linear prediction excitation or the foregoing first history linear-prediction residual may be determined based on a pitch of the foregoing current audio frame. For example, a time-domain correlation between the foregoing first history linear prediction excitation and the linear-prediction residual of the foregoing current audio frame is greater than or equal to a time-domain correlation between other history linear prediction excitation and the linear-prediction residual of the foregoing current audio frame, or a time-domain correlation between the foregoing first history linear prediction excitation and the linear-prediction residual of the foregoing current audio frame is greater than or equal to a time-domain correlation between at least one other history linear prediction excitation and the linear-prediction residual of the foregoing current audio frame. For example, a time-domain correlation between the foregoing first history linear-prediction residual and the linear-prediction residual of the foregoing current audio frame is greater than or equal to a time-domain correlation between another history linear-prediction residual and the linear-prediction residual of the foregoing current audio frame, or a time-domain correlation between the foregoing first history linear-prediction residual and the linear-prediction residual of the foregoing current audio frame is greater than or equal to a time-domain correlation between at least one other history linear-prediction residual and the linear-prediction residual of the foregoing current audio frame.

In some embodiments of the present disclosure, the correlation between the linear-prediction residual of the current audio frame and the first history linear prediction signal is, for example, a function value of a cross correlation in the time domain and/or a function value of a cross correlation in the frequency domain, or the correlation between the linear-prediction residual of the current audio frame and the first history linear prediction signal may be time-domain distortion and/or frequency-domain distortion. In some embodiments of the present disclosure, the foregoing frequency-domain distortion may be a sum value or a weighted sum value of distortion of K1 frequency bins in the frequency domain, or the foregoing frequency-domain distortion may be a sum value or a weighted sum value of distortion of K2 sub-bands in the frequency domain, where K1 and K2 are positive integers. In some embodiments of the present disclosure, a weighting coefficient corresponding to the weighted sum value of the foregoing distortion is a perceptual weighting coefficient that reflects a psychoacoustic model. Certainly, the weighting coefficient corresponding to the weighted sum value of the foregoing distortion may also be another weighting coefficient that is set based on an actual requirement. It is found, by means of testing, that using the perceptual weighting coefficient helps make the calculated distortion better meet subjective quality, thereby helping improve performance.

Generally, a larger cross correlation function value in the time domain between the linear-prediction residual of the foregoing current audio frame and the foregoing first history linear prediction signal may indicate higher long-term linear prediction efficiency of the foregoing current audio frame. Generally, a larger cross correlation function value in the frequency domain of the linear-prediction residual of the foregoing current audio frame and the foregoing first history linear prediction signal may indicate higher long-term linear prediction efficiency of the foregoing current audio frame. Generally, smaller frequency-domain distortion between the linear-prediction residual of the foregoing current audio frame and the foregoing first history linear prediction signal indicates higher long-term linear prediction efficiency of the foregoing current audio frame. Generally, smaller time-domain distortion between the linear-prediction residual of the foregoing current audio frame and the foregoing first history linear prediction signal indicates higher long-term linear prediction efficiency of the foregoing current audio frame.

In some embodiments of the present disclosure, the foregoing first history linear prediction excitation is linear prediction excitation generated by performing audio coding on the history audio frame of the foregoing current audio frame by using a linear prediction based coding scheme.

In some embodiments of the present disclosure, the foregoing first history linear-prediction residual is obtained based on a time-domain signal of a first history audio frame of the foregoing current audio frame and a linear prediction coefficient of the foregoing first history audio frame, where a linear prediction coefficient of the foregoing first history audio frame is a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the linear-prediction residual of the foregoing current audio frame is obtained based on a time-domain signal of the foregoing current audio frame and a linear prediction coefficient of the foregoing current audio frame, where the linear prediction coefficient of the foregoing current audio frame is a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the foregoing first history linear prediction excitation is superposed excitation of adaptive codebook excitation and fixed codebook excitation, or the foregoing first history linear prediction excitation is adaptive codebook excitation.

It may be understood that functions of function modules of the audio coder 400 in this embodiment may be specifically implemented according to the method in the foregoing method embodiment. For a specific implementation process, refer to related descriptions of the foregoing method embodiment. Details are not described herein again. The audio coder 400 may be any apparatus that needs to collect, store, or may transmit outwards an audio signal, for example, a mobile phone, a tablet computer, a personal computer, or a notebook computer.

For examples of values of the thresholds (for example, the first threshold and the second threshold) and the other parameters (for example, N1, N11, N21, and N2) involved in this apparatus embodiment, refer to related examples of values in the foregoing method embodiment. Details are not described herein again.

It can be learned that in the technical solution in this embodiment, the audio coder 400 first estimates reference linear prediction efficiency of a current audio frame; determines, by using the estimated reference linear prediction efficiency of the foregoing current audio frame, an audio coding scheme that matches the estimated reference linear prediction efficiency; and performs audio coding on the foregoing current audio frame according to the determined audio coding scheme that matches the estimated reference linear prediction efficiency. In a process of determining the audio coding scheme in the foregoing solution, an operation, required to be executed in an existing closed-loop selection mode, of performing complete coding on the current audio frame by using each audio coding scheme does not need to be executed; instead, the audio coding scheme that needs to be selected is determined by using the reference linear prediction efficiency of the current audio frame. Calculation complexity of estimating the reference linear prediction efficiency of the current audio frame is generally far less than calculation complexity of performing complete coding on the current audio frame by using each audio coding scheme. Therefore, compared with an existing mechanism, the foregoing solution in this embodiment of the present disclosure helps reduce operation complexity of audio coding, and further reduce overheads of audio coding.

Figure 5:
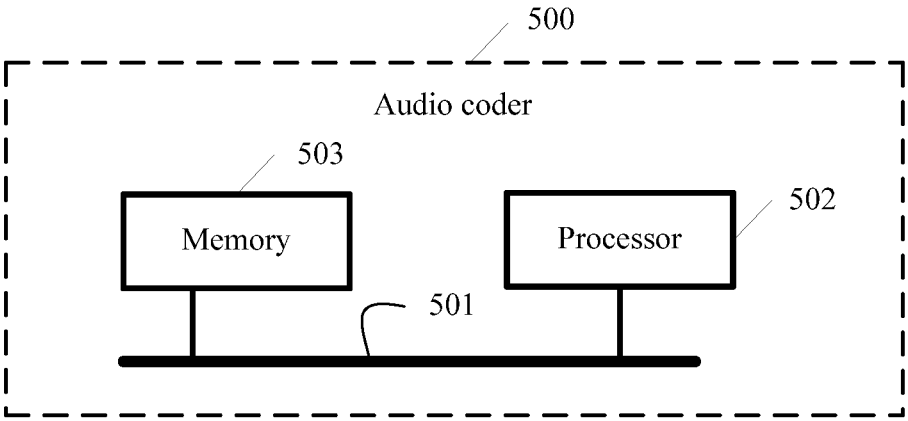
FIG. 5 is a schematic structural diagram of another audio coder according to another embodiment of the present disclosure.

Referring to FIG. 5, FIG. 5 describes a structure of a coder for coding a speech audio bitstream according to another embodiment of the present disclosure, where the coder includes: at least one bus 501, at least one processor 502 connected to the bus 501, and at least one memory 503 connected to the bus 501.

By invoking, by using the bus 501, code stored in the memory 503, the processor 502 is configured to: estimate reference linear prediction efficiency of a current audio frame; determine an audio coding scheme that matches the reference linear prediction efficiency of the foregoing current audio frame; and perform audio coding on the foregoing current audio frame according to the audio coding scheme that matches the reference linear prediction efficiency of the foregoing current audio frame.

In the embodiments of the present disclosure, reference linear prediction efficiency of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher reference linear prediction efficiency of an audio frame (for example, a current audio frame or a history audio frame of a current audio frame) indicates a larger extent to which linear prediction can be performed on the audio frame.

In some embodiments of the present disclosure, the foregoing reference linear prediction efficiency includes at least one of the following linear prediction efficiency: reference long-term linear prediction efficiency, reference short-term linear prediction efficiency, and reference integrated linear prediction efficiency, where the foregoing reference integrated linear prediction efficiency is obtained based on the foregoing reference long-term linear prediction efficiency and the foregoing reference short-term linear prediction efficiency.

Reference long-term linear prediction efficiency of the current audio frame may be obtained based on long-term linear prediction efficiency of the current audio frame, reference short-term linear prediction efficiency of the current audio frame may be obtained based on short-term linear prediction efficiency of the current audio frame, and reference integrated linear prediction efficiency of the current audio frame may be obtained, for example, based on long-term linear prediction efficiency and short-term linear prediction efficiency of the current audio frame.

It may be understood that, a value range of the reference linear prediction efficiency may be 0-1 (that is, 0-100%), or a value range may be 0-x1 (where x1 is a positive number); a value range of the reference long-term linear prediction efficiency may be 0-1 (that is, 0-100%), or a value range may be 0-x2 (where x2 is a positive number); a value range of the reference short-term linear prediction efficiency may be 0-1 (that is, 0-100%), or a value range may be 0-x3 (where x3 is a positive number); a value range of the reference integrated linear prediction efficiency may be 0-1 (that is, 0-100%), or a value range may be 0-x4 (where x4 is a positive number); a value range of the long-term linear prediction efficiency may be 0-1 (that is, 0-100%), or a value range may be 0-x5 (where x5 is a positive number); and a value range of the short-term linear prediction efficiency may be 0-1 (that is, 0-100%), or a value range may be 0-x6 (where x6 is a positive number), where x1, x2, x3, x4, x5, or x6 may be, for example, 0.5, 0.8, 1.5, 2, 5, 10, 50, 100, or another positive number.

In some embodiments of the present disclosure, there may be a set mapping relationship between an audio coding scheme and reference linear prediction efficiency of an audio frame. For example, different audio coding schemes may be corresponding to different reference linear prediction efficiency, or different audio coding schemes may be corresponding to different reference linear prediction efficiency intervals. For example, the audio coding scheme that matches the estimated reference linear prediction efficiency of the foregoing current audio frame may be determined from at least two audio coding schemes.

In some embodiments of the present disclosure, before estimating the reference linear prediction efficiency of the current audio frame, by invoking, by using the bus 501, the code stored in the memory 503, the processor 502 may be further configured to first determine whether the current audio frame is a speech and audio frame. For example, the estimating reference linear prediction efficiency of a current audio frame may include: estimating the reference linear prediction efficiency of the foregoing current audio frame when the current audio frame is a non-speech and audio frame. In addition, before the reference linear prediction efficiency of the current audio frame is estimated, whether the current audio frame is a speech and audio frame may not be distinguished.

In some embodiments of the present disclosure, the reference integrated linear prediction efficiency of the foregoing current audio frame may be, for example, a sum value, a weighted sum value (where a weighted value corresponding to the weighted sum value herein may be set according to an actual requirement, and a weighted value may be, for example, 0.5, 1, 2, 3, 5, 10, or another value), or an average value of the reference long-term linear prediction efficiency of the foregoing current audio frame and the reference short-term linear prediction efficiency of the current audio frame. Certainly, the reference integrated linear prediction efficiency of the foregoing current audio frame may also be obtained, by using another algorithm, based on the reference long-term linear prediction efficiency of the foregoing current audio frame and the reference short-term linear prediction efficiency of the current audio frame.

It may be understood that because the reference linear prediction efficiency of the foregoing current audio frame includes different types of linear prediction efficiency, there may be different specific manners of determining, by the processor 502, the audio coding scheme that matches the reference linear prediction efficiency of the foregoing current audio frame. The following illustrates some possible embodiment manners by using examples.

For example, in some embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference long-term linear prediction efficiency of the foregoing current audio frame is less than a first threshold and/or the reference short-term linear prediction efficiency of the foregoing current audio frame is less than a second threshold, determine that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference long-term linear prediction efficiency of the foregoing current audio frame is greater than or equal to a first threshold and/or the reference short-term linear prediction efficiency of the foregoing current audio frame is greater than or equal to a second threshold, determine that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference long-term linear prediction efficiency of the foregoing current audio frame is less than a first threshold and/or the reference short-term linear prediction efficiency of the foregoing current audio frame is less than a second threshold, determine that the audio coding scheme that matches the reference linear prediction efficiency of the foregoing current audio frame is an audio coding scheme not based on linear prediction; or if the reference long-term linear prediction efficiency of the foregoing current audio frame is greater than or equal to a first threshold and/or the reference short-term linear prediction efficiency of the foregoing current audio frame is greater than or equal to a second threshold, determine that the audio coding scheme that matches the reference linear prediction efficiency of the foregoing current audio frame is a linear prediction based audio coding scheme.

For another example, in some embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference long-term linear prediction efficiency of the foregoing current audio frame is greater than or equal to a third threshold, determine that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference long-term linear prediction efficiency of the foregoing current audio frame is less than a fourth threshold, determine that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference long-term linear prediction efficiency of the foregoing current audio frame is greater than or equal to a third threshold, determine that the audio coding scheme that matches the reference linear prediction efficiency of the foregoing current audio frame is a linear prediction based audio coding scheme; or if the reference long-term linear prediction efficiency of the foregoing current audio frame is less than a fourth threshold, determine that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: determine a first linear prediction efficiency interval within which the reference long-term linear prediction efficiency of the foregoing current audio frame falls, and determine, according to a mapping relationship between a linear prediction efficiency interval and a linear prediction based audio coding scheme, a first audio coding scheme that is in a mapping relationship with the foregoing first linear prediction efficiency interval, where the foregoing first audio coding scheme is an audio coding scheme that matches the reference linear prediction efficiency of the foregoing current audio frame, and the foregoing first audio coding scheme is a linear prediction based audio coding scheme or an audio coding scheme not based on linear prediction. Different linear prediction efficiency intervals are corresponding to different audio coding schemes. For example, it is assumed that there are three linear prediction efficiency intervals, which may be 0-30%, 30-70%, and 70-100% respectively. If the reference long-term linear prediction efficiency of the foregoing current audio frame falls within the linear prediction efficiency interval 0-30% (that is, the first linear prediction efficiency interval is the linear prediction efficiency interval 0-30%), it may be determined that an audio coding scheme corresponding to the linear prediction efficiency interval 0-30% is the audio coding scheme that matches the reference linear prediction efficiency of the foregoing current audio frame. If the reference long-term linear prediction efficiency of the foregoing current audio frame falls within the linear prediction efficiency interval 30-70% (that is, the first linear prediction efficiency interval is the linear prediction efficiency interval 30-70%), it may be determined that an audio coding scheme corresponding to the linear prediction efficiency interval 30-70% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference short-term linear prediction efficiency of the foregoing current audio frame is greater than or equal to a fifth threshold, determine that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference short-term linear prediction efficiency of the foregoing current audio frame is less than a fifth threshold, determine that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference short-term linear prediction efficiency of the foregoing current audio frame is greater than or equal to a fifth threshold, determine that the audio coding scheme that matches the reference linear prediction efficiency of the foregoing current audio frame is a linear prediction based audio coding scheme; or if the reference short-term linear prediction efficiency of the foregoing current audio frame is less than a fifth threshold, determine that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: determine a second linear prediction efficiency interval within which the reference short-term linear prediction efficiency of the foregoing current audio frame falls, and determine, according to a mapping relationship between a linear prediction efficiency interval and a linear prediction based audio coding scheme, a second audio coding scheme that is in a mapping relationship with the foregoing second linear prediction efficiency interval or an audio coding scheme not based on linear prediction, where the foregoing second audio coding scheme is an audio coding scheme that matches the reference linear prediction efficiency of the foregoing current audio frame, and the foregoing second audio coding scheme is a linear prediction based audio coding scheme. For example, it is assumed that there are three linear prediction efficiency intervals, which are 0-40%, 40-60%, and 60-100% respectively. If the reference long-term linear prediction efficiency of the foregoing current audio frame falls within the linear prediction efficiency interval 0-40% (that is, the second linear prediction efficiency interval is the linear prediction efficiency interval 0-40%), it may be determined that an audio coding scheme corresponding to the linear prediction efficiency interval 0-40% is the audio coding scheme that matches the reference linear prediction efficiency of the foregoing current audio frame. If the reference long-term linear prediction efficiency of the foregoing current audio frame falls within the linear prediction efficiency interval 40-60% (that is, the second linear prediction efficiency interval is the linear prediction efficiency interval 40-60%), it is determined that an audio coding scheme corresponding to the linear prediction efficiency interval 40-60% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference integrated linear prediction efficiency of the foregoing current audio frame is greater than or equal to a sixth threshold, determine that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference integrated linear prediction efficiency of the foregoing current audio frame is less than a sixth threshold, determine that the audio coding scheme that matches the reference linear prediction efficiency of the foregoing current audio frame is an audio coding scheme not based on linear prediction.

For another example, in still other embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: if the reference integrated linear prediction efficiency of the foregoing current audio frame is greater than or equal to a sixth threshold, determine that the audio coding scheme that matches the reference linear prediction efficiency of the foregoing current audio frame is a linear prediction based audio coding scheme; or if the reference integrated linear prediction efficiency of the foregoing current audio frame is less than a sixth threshold, determine that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking, by using the bus 501, the code stored in the memory 503, the processor 502 is specifically configured to: determine a third linear prediction efficiency interval within which the reference integrated linear prediction efficiency of the foregoing current audio frame falls, and determine, according to a mapping relationship between a linear prediction efficiency interval and a linear prediction based audio coding scheme, a third audio coding scheme that is in a mapping relationship with the foregoing third linear prediction efficiency interval or an audio coding scheme not based on linear prediction, where the foregoing third audio coding scheme is an audio coding scheme that matches the reference linear prediction efficiency of the foregoing current audio frame, and the foregoing third audio coding scheme is a linear prediction based audio coding scheme. For example, it is assumed that there are three linear prediction efficiency intervals, which may be 0-50%, 50-80%, and 80-100% respectively. If the reference long-term linear prediction efficiency of the foregoing current audio frame falls within the linear prediction efficiency interval 0-50% (that is, the third linear prediction efficiency interval is the linear prediction efficiency interval 0-50%), it may be determined that an audio coding scheme corresponding to the linear prediction efficiency interval 0-50% is the audio coding scheme that matches the reference linear prediction efficiency of the foregoing current audio frame. If the reference long-term linear prediction efficiency of the foregoing current audio frame falls within the linear prediction efficiency interval 50-80% (that is, the third linear prediction efficiency interval is the linear prediction efficiency interval 50-80%), it is determined that an audio coding scheme corresponding to the linear prediction efficiency interval 50-80% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

In some embodiments of the present disclosure, the linear prediction based audio coding scheme may include algebraic code excited linear prediction (ACELP) coding, transform coded excitation (TCX), and the like; the non-linear prediction based audio coding scheme may include generic audio coding (GAC), where the GAC may include, for example, modified discrete cosine transform (MDCT) coding or discrete cosine transform (DCT) coding.

It may be understood that specific values of the thresholds (for example, the first threshold, the second threshold, the third threshold, the fourth threshold, the fifth threshold, and the sixth threshold) mentioned in the foregoing examples may be set according to a requirement or according to an application environment and an application scenario. For example, if a value range of the reference long-term linear prediction efficiency of the foregoing current audio frame is 0-1, a value of the first threshold may be 0.2, 0.5, 0.6, 0.8, or the like, if a value range of the reference short-term linear prediction efficiency of the foregoing current audio frame is 0-1, a value of the second threshold may be 0.3, 0.3, 0.6, 0.8, or the like, and another scenario is deduced from this. Further, values of the thresholds may further be adjusted in a dynamic and adaptive manner according to a requirement.

It may be understood that different types of linear prediction efficiency included in the reference linear prediction efficiency of the foregoing current audio frame may be specifically estimated in different manners. The following uses some possible embodiment manners as examples to perform description.

For example, in some embodiments of the present disclosure, by invoking, by using the bus 501, the code stored in the memory 503, the processor 502 is specifically configured to obtain the reference long-term linear prediction efficiency of the current audio frame by means of estimation in the following manner: estimating the long-term linear prediction efficiency of the current audio frame, where the long-term linear prediction efficiency of the foregoing current audio frame is the reference long-term linear prediction efficiency of the foregoing current audio frame.

Alternatively, by invoking, by using the bus 501, the code stored in the memory 503, the processor 502 is specifically configured to obtain the reference long-term linear prediction efficiency of the current audio frame by means of estimation in the following manner: obtaining the long-term linear prediction efficiency of the current audio frame by means of estimation; acquiring linear prediction efficiency of N1 history audio frames of the foregoing current audio frame; and calculating a first statistical value of the linear prediction efficiency of the foregoing N1 history audio frames and the long-term linear prediction efficiency of the foregoing current audio frame, where N1 is a positive integer, the foregoing first statistical value is the reference long-term linear prediction efficiency of the foregoing current audio frame, linear prediction efficiency of each history audio frame of N11 history audio frames is at least one of the following linear prediction efficiency of each history audio frame: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N11 history audio frames are a subset of the foregoing N1 history audio frames. The first statistical value, obtained by means of calculation, of the linear prediction efficiency of the foregoing N1 history audio frames and the long-term linear prediction efficiency of the foregoing current audio frame may be, for example, a sum value, a weighted sum value, a geometric average value, an arithmetic average value, a moving average value, or a weighted average value of the linear prediction efficiency of the foregoing N1 history audio frames and the long-term linear prediction efficiency of the foregoing current audio frame.

Alternatively, by invoking, by using the bus 501, the code stored in the memory 503, the processor 502 is specifically configured to obtain the reference long-term linear prediction efficiency of the current audio frame by means of estimation in the following manner: obtaining the long-term linear prediction efficiency of the current audio frame by means of estimation; acquiring reference linear prediction efficiency of N2 history audio frames of the foregoing current audio frame; and calculating a second statistical value of the reference linear prediction efficiency of the foregoing N2 history audio frames and the long-term linear prediction efficiency of the foregoing current audio frame, where N2 is a positive integer, the foregoing second statistical value is the reference long-term linear prediction efficiency of the foregoing current audio frame, reference linear prediction efficiency of each history audio frame of N21 history audio frames is at least one of the following linear prediction efficiency of each history audio frame: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N21 history audio frames are a subset of the foregoing N2 history audio frames. The second statistical value, obtained by means of calculation, of the reference linear prediction efficiency of the foregoing N2 history audio frames and the long-term linear prediction efficiency of the foregoing current audio frame is, for example, a sum value, a weighted sum value, a geometric average value, an arithmetic average value, a moving average value, or a weighted average value of the reference linear prediction efficiency of the foregoing N2 history audio frames and the long-term linear prediction efficiency of the foregoing current audio frame.

Alternatively, by invoking, by using the bus 501, the code stored in the memory 503, the processor 502 is specifically configured to obtain the reference long-term linear prediction efficiency of the current audio frame by means of estimation in the following manner: obtaining the long-term linear prediction efficiency of the current audio frame by means of estimation; acquiring reference linear prediction efficiency of N4 history audio frames of the foregoing current audio frame; acquiring linear prediction efficiency of N3 history audio frames of the foregoing current audio frame; and calculating a third statistical value of the linear prediction efficiency of the foregoing N3 history audio frames, the reference linear prediction efficiency of the foregoing N4 history audio frames, and the long-term linear prediction efficiency of the foregoing current audio frame, where N3 and N4 are positive integers, the foregoing third statistical value is the reference long-term linear prediction efficiency of the foregoing current audio frame, linear prediction efficiency of each history audio frame of N31 history audio frames is at least one of the following linear prediction efficiency of each history audio frame: long-term linear prediction efficiency, short-term linear prediction efficiency, and integrated linear prediction efficiency, reference linear prediction efficiency of each history audio frame of N41 history audio frames is at least one of the following linear prediction efficiency of each history audio frame: reference long-term linear prediction efficiency, reference short-term linear prediction efficiency, and reference integrated linear prediction efficiency, the foregoing N31 history audio frames are a subset of the foregoing N3 history audio frames, the foregoing N41 history audio frames are a subset of the foregoing N4 history audio frames, integrated linear prediction efficiency of each history audio frame is obtained based on long-term linear prediction efficiency and short-term linear prediction efficiency of each history audio frame, and reference integrated linear prediction efficiency of each history audio frame is obtained based on reference long-term linear prediction efficiency and reference short-term linear prediction efficiency of each history audio frame. An intersection set of the foregoing N3 history audio frames and the foregoing N4 history audio frames may be an empty set or may not be an empty set. The third statistical value, obtained by means of calculation, of the linear prediction efficiency of the foregoing N3 history audio frames, the reference linear prediction efficiency of the foregoing N4 history audio frames, and the long-term linear prediction efficiency of the foregoing current audio frame is, for example, a sum value, a weighted sum value, a geometric average value, an arithmetic average value, a moving average value, or a weighted average value of the linear prediction efficiency of the foregoing N3 history audio frames, the reference linear prediction efficiency of the foregoing N4 history audio frames, and the long-term linear prediction efficiency of the foregoing current audio frame.

For example, in some embodiments of the present disclosure, by invoking, by using the bus 501, the code stored in the memory 503, the processor 502 is specifically configured to obtain the reference short-term linear prediction efficiency of the current audio frame by means of estimation in the following manner: estimating the short-term linear prediction efficiency of the current audio frame, where the short-term linear prediction efficiency of the foregoing current audio frame is the reference short-term linear prediction efficiency of the foregoing current audio frame.

Alternatively, by invoking, by using the bus 501, the code stored in the memory 503, the processor 502 is specifically configured to obtain the reference short-term linear prediction efficiency of the current audio frame by means of estimation in the following manner: obtaining the short-term linear prediction efficiency of the current audio frame by means of estimation; acquiring linear prediction efficiency of N5 history audio frames of the foregoing current audio frame; and calculating a fourth statistical value of the linear prediction efficiency of the foregoing N5 history audio frames and the short-term linear prediction efficiency of the foregoing current audio frame, where N5 is a positive integer, the foregoing fourth statistical value is the reference short-term linear prediction efficiency of the foregoing current audio frame, linear prediction efficiency of each history audio frame of N51 history audio frames is at least one of the following linear prediction efficiency of each history audio frame: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N51 history audio frames are a subset of the foregoing N5 history audio frames. The fourth statistical value, obtained by means of calculation, of the linear prediction efficiency of the foregoing N5 history audio frames and the short-term linear prediction efficiency of the foregoing current audio frame may be a sum value, a weighted sum value, a geometric average value, an arithmetic average value, a moving average value, or a weighted average value of the linear prediction efficiency of the foregoing N5 history audio frames and the short-term linear prediction efficiency of the foregoing current audio frame.

Alternatively, by invoking, by using the bus 501, the code stored in the memory 503, the processor 502 is specifically configured to obtain the reference short-term linear prediction efficiency of the current audio frame by means of estimation in the following manner: obtaining the short-term linear prediction efficiency of the current audio frame by means of estimation; acquiring reference linear prediction efficiency of N6 history audio frames of the foregoing current audio frame; and calculating a fifth statistical value of the reference linear prediction efficiency of the foregoing N6 history audio frames and the short-term linear prediction efficiency of the foregoing current audio frame, where N6 is a positive integer, the foregoing fifth statistical value is the reference short-term linear prediction efficiency of the foregoing current audio frame, reference linear prediction efficiency of each history audio frame of N61 history audio frames is at least one of the following linear prediction efficiency of each history audio frame: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N61 history audio frames are a subset of the foregoing N6 history audio frames. The fifth statistical value, obtained by means of calculation, of the reference linear prediction efficiency of the foregoing N6 history audio frames and the short-term linear prediction efficiency of the foregoing current audio frame may be a sum value, a weighted sum value, a geometric average value, an arithmetic average value, a moving average value, or a weighted average value of the reference linear prediction efficiency of the foregoing N6 history audio frames and the short-term linear prediction efficiency of the foregoing current audio frame.

Alternatively, by invoking, by using the bus 501, the code stored in the memory 503, the processor 502 is specifically configured to obtain the reference short-term linear prediction efficiency of the current audio frame by means of estimation in the following manner: obtaining the short-term linear prediction efficiency of the current audio frame by means of estimation; acquiring reference linear prediction efficiency of N8 history audio frames of the foregoing current audio frame; acquiring linear prediction efficiency of N7 history audio frames of the foregoing current audio frame; and calculating a sixth statistical value of the linear prediction efficiency of the foregoing N7 history audio frames, the reference linear prediction efficiency of the foregoing N8 history audio frames, and the short-term linear prediction efficiency of the foregoing current audio frame, where N7 and N8 are positive integers, the foregoing sixth statistical value is the reference short-term linear prediction efficiency of the foregoing current audio frame, linear prediction efficiency of each history audio frame of N71 history audio frames is at least one of the following linear prediction efficiency of each history audio frame: long-term linear prediction efficiency, short-term linear prediction efficiency, and integrated linear prediction efficiency, reference linear prediction efficiency of each history audio frame of N81 history audio frames is at least one of the following linear prediction efficiency of each history audio frame: reference long-term linear prediction efficiency, reference short-term linear prediction efficiency, and reference integrated linear prediction efficiency, integrated linear prediction efficiency of each history audio frame is obtained based on long-term linear prediction efficiency and short-term linear prediction efficiency of each history audio frame, reference integrated linear prediction efficiency of each history audio frame is obtained based on reference long-term linear prediction efficiency and reference short-term linear prediction efficiency of each history audio frame, the foregoing N71 history audio frames are a subset of the foregoing N7 history audio frames, and the foregoing N81 history audio frames are a subset of the foregoing N8 history audio frames. An intersection set of the foregoing N7 history audio frames and the foregoing N8 history audio frames may be an empty set or may not be an empty set. The sixth statistical value, obtained by means of calculation, of the linear prediction efficiency of the foregoing N7 history audio frames, the reference linear prediction efficiency of the foregoing N8 history audio frames, and the short-term linear prediction efficiency of the foregoing current audio frame may be a sum value, a weighted sum value, a geometric average value, an arithmetic average value, a moving average value, or a weighted average value of the linear prediction efficiency of the foregoing N7 history audio frames, the reference linear prediction efficiency of the foregoing N8 history audio frames, and the short-term linear prediction efficiency of the foregoing current audio frame.

In some embodiments of the present disclosure, linear prediction efficiency (for example, long-term linear prediction efficiency or short-term linear prediction efficiency) of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher linear prediction efficiency (for example, long-term linear prediction efficiency or short-term linear prediction efficiency) of an audio frame (for example, a current audio frame or a history audio frame of a current audio frame) indicates a larger extent to which linear prediction can be performed on the audio frame.

In some embodiments of the present disclosure, in the aspect of obtaining the short-term linear prediction efficiency of the current audio frame based on a linear-prediction residual of the current audio frame, by invoking, by using the bus 501, the code stored in the memory 503, the processor 502 may be specifically configured to calculate a change rate of energy that are of the current audio frame and obtained before and after short-term linear prediction is performed on the current audio frame, where the foregoing calculated energy change rate is the short-term linear prediction efficiency of the current audio frame, or the short-term linear prediction efficiency of the current audio frame is obtained by means of transformation based on the foregoing calculated energy change rate, and the energy that is of the foregoing current audio frame and obtained after the short-term linear prediction is performed on the current audio frame is energy of the linear-prediction residual of the foregoing current audio frame. For example, there may be a mapping relationship between the energy change rate and the short-term linear prediction efficiency of the current audio frame, and the short-term linear prediction efficiency that is of the current audio frame and is in the mapping relationship with the foregoing calculated energy change rate may be obtained based on the mapping relationship between the energy change rate and the short-term linear prediction efficiency of the current audio frame. Generally, a larger change rate of the energy that are of the current audio frame and obtained before and after the short-term linear prediction is performed on the current audio frame indicates higher short-term linear prediction efficiency of the current audio frame.

For example, the change rate of the energy that are of the foregoing current audio frame and obtained before and after the short-term linear prediction is performed on the current audio frame may be a ratio or a reciprocal of a ratio of the energy that is of the foregoing current audio frame and obtained before the short-term linear prediction is performed on the current audio frame to the energy of the linear-prediction residual of the foregoing current audio frame. Generally, a larger ratio obtained by dividing the energy that is of the foregoing current audio frame and obtained before the short-term linear prediction is performed on the current audio frame by the energy of the linear-prediction residual of the foregoing current audio frame indicates higher short-term linear prediction efficiency of the current audio frame.

In some embodiments of the present disclosure, in the aspect of obtaining the long-term linear prediction efficiency of the current audio frame by means of estimation, by invoking, by using the bus 501, the code stored in the memory 503, the processor 502 may be specifically configured to obtain a correlation between a linear-prediction residual of the current audio frame and a first history linear prediction signal according to the linear-prediction residual of the foregoing current audio frame and the foregoing first history linear prediction signal, where the foregoing correlation is the long-term linear prediction efficiency of the current audio frame, or the long-term linear prediction efficiency of the current audio frame is obtained based on the foregoing correlation. The foregoing first history linear prediction signal is first history linear prediction excitation or a first history linear-prediction residual, the foregoing first history linear-prediction residual is a linear-prediction residual of a history audio frame of the foregoing current audio frame (for example, the foregoing first history linear-prediction residual may be a linear-prediction residual of a history audio frame that is of the current audio frame and whose duration is the same as or similar to that of the foregoing current audio frame, or the foregoing first history linear-prediction residual may be linear-prediction residuals of some consecutive audio signals of two adjacent history audio frames that are of the foregoing current audio frame and whose duration is the same as or similar to that of the foregoing current audio frame), and the foregoing first history linear prediction excitation is linear prediction excitation of the history audio frame of the foregoing current audio frame (for example, the foregoing first history linear prediction excitation may be linear prediction excitation of a history audio frame that is of the foregoing current audio frame and whose duration is the same as or similar to that of the foregoing current audio frame, or the foregoing first history linear prediction excitation may be linear prediction excitation of some consecutive audio signals of two adjacent history audio frames that are of the current audio frame and whose duration is the same as or similar to that of the foregoing current audio frame). For example, there is a mapping relationship between a correlation and long-term linear prediction efficiency of an audio frame, and the long-term linear prediction efficiency that is of the foregoing current audio frame and is in a mapping relationship with the foregoing calculated correlation may be obtained based on the mapping relationship between a correlation and long-term linear prediction efficiency of an audio frame.

The correlation between the linear-prediction residual of the foregoing current audio frame and the foregoing first history linear prediction signal may be obtained according to the linear-prediction residual of the current audio frame and the first history linear prediction signal in various manners.

For example, in the aspect of obtaining a correlation between a linear-prediction residual of the current audio frame and a first history linear prediction signal according to the linear-prediction residual of the foregoing current audio frame and the foregoing first history linear prediction signal, by invoking, by using the bus 501, the code stored in the memory 503, the processor 502 may be specifically configured to calculate the correlation between the linear-prediction residual of the current audio frame and the first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the linear-prediction residual of the current audio frame by a gain factor to obtain a gained linear-prediction residual of the foregoing current audio frame, and obtaining a correlation between the gained linear-prediction residual of the foregoing current audio frame and the first history linear prediction signal by means of calculation, where the correlation, obtained by means of calculation, between the gained linear-prediction residual of the foregoing current audio frame and the foregoing first history linear prediction signal is the correlation between the linear-prediction residual of the foregoing current audio frame and the foregoing first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the first history linear prediction signal by a gain factor to obtain a gained first history linear prediction signal, and obtaining a correlation between the linear-prediction residual of the foregoing current audio frame and the foregoing gained first history linear prediction signal by means of calculation, where the correlation, obtained by means of calculation, between the linear-prediction residual of the foregoing current audio frame and the foregoing gained first history linear prediction signal is the correlation between the linear-prediction residual of the foregoing current audio frame and the foregoing first history linear prediction signal.

The foregoing first history linear prediction excitation or the foregoing first history linear-prediction residual may be determined based on a pitch of the foregoing current audio frame. For example, a time-domain correlation between the foregoing first history linear prediction excitation and the linear-prediction residual of the foregoing current audio frame is greater than or equal to a time-domain correlation between other history linear prediction excitation and the linear-prediction residual of the foregoing current audio frame, or a time-domain correlation between the foregoing first history linear prediction excitation and the linear-prediction residual of the foregoing current audio frame is greater than or equal to a time-domain correlation between at least one other history linear prediction excitation and the linear-prediction residual of the foregoing current audio frame. For example, a time-domain correlation between the foregoing first history linear-prediction residual and the linear-prediction residual of the foregoing current audio frame is greater than or equal to a time-domain correlation between another history linear-prediction residual and the linear-prediction residual of the foregoing current audio frame, or a time-domain correlation between the foregoing first history linear-prediction residual and the linear-prediction residual of the foregoing current audio frame is greater than or equal to a time-domain correlation between at least one other history linear-prediction residual and the linear-prediction residual of the foregoing current audio frame.

Generally, a larger correlation between the linear-prediction residual of the foregoing current audio frame and the foregoing first history linear prediction signal indicates higher long-term linear prediction efficiency of the foregoing current audio frame.

In some embodiments of the present disclosure, the foregoing correlation is, for example, a function value of a cross correlation in the time domain and/or a function value of a cross correlation in the frequency domain, or the foregoing correlation may be time-domain distortion and/or frequency-domain distortion (where the frequency-domain distortion may also be referred to as spectrum distortion).

In some embodiments of the present disclosure, the foregoing frequency-domain distortion may be a sum value or a weighted sum value of distortion of K1 frequency bins in the frequency domain, or the foregoing frequency-domain distortion may be a sum value or a weighted sum value of distortion of K2 sub-bands in the frequency domain, where K1 and K2 are positive integers.

Generally, a larger cross correlation function value in the time domain of the linear-prediction residual of the foregoing current audio frame and the foregoing first history linear prediction signal may indicate higher long-term linear prediction efficiency of the foregoing current audio frame. Generally, a larger cross correlation function value in the frequency domain of the linear-prediction residual of the foregoing current audio frame and the foregoing first history linear prediction signal may indicate higher long-term linear prediction efficiency of the foregoing current audio frame. Generally, smaller frequency-domain distortion between the linear-prediction residual of the foregoing current audio frame and the foregoing first history linear prediction signal indicates higher long-term linear prediction efficiency of the foregoing current audio frame. Generally, smaller time-domain distortion between the linear-prediction residual of the foregoing current audio frame and the foregoing first history linear prediction signal indicates higher long-term linear prediction efficiency of the foregoing current audio frame.

In some embodiments of the present disclosure, a weighting coefficient corresponding to the weighted sum value of the foregoing distortion is a perceptual weighting coefficient that reflects a psychoacoustic model. Certainly, the weighting coefficient corresponding to the weighted sum value of the foregoing distortion may also be another weighting coefficient that is set based on an actual requirement. It is found, by means of testing, that using the perceptual weighting coefficient helps make the calculated distortion better meet subjective quality, thereby helping improve performance.

In some embodiments of the present disclosure, the foregoing first history linear prediction excitation may be linear prediction excitation generated by performing audio coding on the history audio frame of the foregoing current audio frame by using a linear prediction based coding scheme.

In some embodiments of the present disclosure, the foregoing first history linear-prediction residual may be obtained based on a time-domain signal of a first history audio frame of the foregoing current audio frame and a linear prediction coefficient of the foregoing first history audio frame, where a linear prediction coefficient of the foregoing first history audio frame is a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the linear-prediction residual of the foregoing current audio frame may be obtained based on a time-domain signal of the foregoing current audio frame and a linear prediction coefficient of the foregoing current audio frame, where the linear prediction coefficient of the foregoing current audio frame may be a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the foregoing first history linear prediction excitation may be superposed excitation of adaptive codebook excitation and fixed codebook excitation, or the foregoing first history linear prediction excitation may be adaptive codebook excitation, or the foregoing first history linear prediction excitation may be another type of codebook excitation.

It may be understood that functions of function modules of the audio coder 500 in this embodiment may be specifically implemented according to the method in the foregoing method embodiment. For a specific implementation process, refer to related descriptions of the foregoing method embodiment. Details are not described herein again. The audio coder 500 may be any apparatus that needs to collect, store, or may transmit outwards an audio signal may be, for example, a mobile phone, a tablet computer, a personal computer, or a notebook computer.

For examples of values of the thresholds (for example, the first threshold and the second threshold) and the other parameters (for example, N1, N11, N21, and N2) involved in this apparatus embodiment, refer to related examples of values in the foregoing method embodiment. Details are not described herein again.

It can be learned that in the technical solution in this embodiment, the audio coder 500 first estimates reference linear prediction efficiency of a current audio frame; determines, by using the estimated reference linear prediction efficiency of the foregoing current audio frame, an audio coding scheme that matches the estimated reference linear prediction efficiency; and performs audio coding on the foregoing current audio frame according to the determined audio coding scheme that matches the estimated reference linear prediction efficiency. In a process of determining the audio coding scheme in the foregoing solution, an operation, required to be executed in an existing closed-loop selection mode, of performing complete coding on the current audio frame by using each audio coding scheme does not need to be executed; instead, the audio coding scheme that needs to be selected is determined by using the reference linear prediction efficiency of the current audio frame. Calculation complexity of estimating the reference linear prediction efficiency of the current audio frame is generally far less than calculation complexity of performing complete coding on the current audio frame by using each audio coding scheme. Therefore, compared with an existing mechanism, the foregoing solution in this embodiment of the present disclosure helps reduce operation complexity of audio coding, and further reduce overheads of audio coding.

Figure 6:
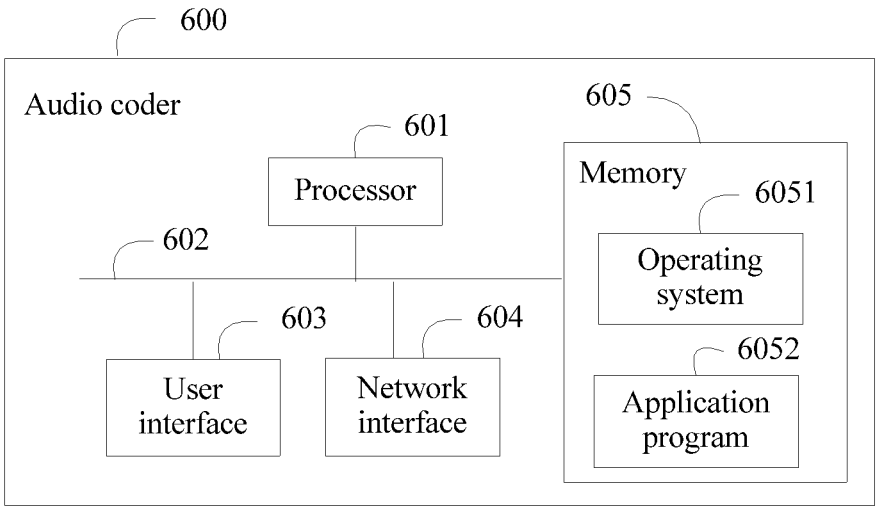
FIG. 6 is a schematic structural diagram of another audio coder according to another embodiment of the present disclosure.

Referring to FIG. 6, FIG. 6 is a structural block diagram of an audio coder 600 according to another embodiment of the present disclosure. The audio coder 600 may include at least one processor 601, at least one network interface 604 or another user interface 603, a memory 605, and at least one communications bus 602. The communications bus 602 is configured to implement connection and communication between these components. The audio coder 600 optionally includes the user interface 603, which includes a display (for example, a touchscreen, an LCD, a CRT, holographic device, or a projector), a click device (for example, a mouse, a trackball, a touchpad, or a touchscreen), a camera and/or a pickup apparatus, and the like.

The memory 605 may include a read-only memory and a random access memory, and provide an instruction and data for the processor 601. A part of the memory 602 may further include a nonvolatile random access memory (NVRAM).

In some implementation manners, the memory 605 stores the following elements, an executable module or a data structure, or a subset thereof, or an extension set thereof:

an operating system 6051, including various system programs, and configured to implement various basic services and process hardware-based tasks; and an application program module 6052, including various application programs, and configured to implement various application services.

The application program module 6052 includes but is not limited to an estimation unit 410, a determining unit 420, a coding unit 430, and the like.

In this embodiment of the present disclosure, by invoking the program or the instruction stored in the memory 605, the processor 601 is configured to: estimate reference linear prediction efficiency of a current audio frame; determine an audio coding scheme that matches the reference linear prediction efficiency of the foregoing current audio frame; and perform audio coding on the foregoing current audio frame according to the audio coding scheme that matches the reference linear prediction efficiency of the foregoing current audio frame.

In the embodiments of the present disclosure, reference linear prediction efficiency of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher reference linear prediction efficiency of an audio frame (for example, a current audio frame or a history audio frame of a current audio frame) indicates a larger extent to which linear prediction can be performed on the audio frame.

In some embodiments of the present disclosure, the foregoing reference linear prediction efficiency includes at least one of the following linear prediction efficiency: reference long-term linear prediction efficiency, reference short-term linear prediction efficiency, and reference integrated linear prediction efficiency, where the foregoing reference integrated linear prediction efficiency is obtained based on the foregoing reference long-term linear prediction efficiency and the foregoing reference short-term linear prediction efficiency.

Reference long-term linear prediction efficiency of the current audio frame may be obtained based on long-term linear prediction efficiency of the current audio frame, reference short-term linear prediction efficiency of the current audio frame may be obtained based on short-term linear prediction efficiency of the current audio frame, and reference integrated linear prediction efficiency of the current audio frame may be obtained, for example, based on long-term linear prediction efficiency and short-term linear prediction efficiency of the current audio frame.

It may be understood that, a value range of the reference linear prediction efficiency may be 0-1 (that is, 0-100%), or a value range may be 0-x1 (where x1 is a positive number); a value range of the reference long-term linear prediction efficiency may be 0-1 (that is, 0-100%), or a value range may be 0-x2 (where x2 is a positive number); a value range of the reference short-term linear prediction efficiency may be 0-1 (that is, 0-100%), or a value range may be 0-x3 (where x3 is a positive number); a value range of the reference integrated linear prediction efficiency may be 0-1 (that is, 0-100%), or a value range may be 0-x4 (where x4 is a positive number); a value range of the long-term linear prediction efficiency may be 0-1 (that is, 0-100%), or a value range may be 0-x5 (where x5 is a positive number); and a value range of the short-term linear prediction efficiency may be 0-1 (that is, 0-100%), or a value range may be 0-x6 (where x6 is a positive number), where x1, x2, x3, x4, x5, or x6 may be, for example, 0.5, 0.8, 1.5, 2, 5, 10, 50, 100, or another positive number.

In some embodiments of the present disclosure, there may be a set mapping relationship between an audio coding scheme and reference linear prediction efficiency of an audio frame. For example, different audio coding schemes may be corresponding to different reference linear prediction efficiency, or different audio coding schemes may be corresponding to different reference linear prediction efficiency intervals. For example, the audio coding scheme that matches the estimated reference linear prediction efficiency of the foregoing current audio frame may be determined from at least two audio coding schemes.

In some embodiments of the present disclosure, before estimating the reference linear prediction efficiency of the current audio frame, by invoking the program or the instruction stored in the memory 605, the processor 601 may be further configured to first determine whether the current audio frame is a speech and audio frame. For example, the estimating reference linear prediction efficiency of a current audio frame may include: estimating the reference linear prediction efficiency of the foregoing current audio frame when the current audio frame is a non-speech and audio frame. In addition, before the reference linear prediction efficiency of the current audio frame is estimated, whether the current audio frame is a speech and audio frame may not be distinguished.

In some embodiments of the present disclosure, the reference integrated linear prediction efficiency of the foregoing current audio frame may be, for example, a sum value, a weighted sum value (where a weighted value corresponding to the weighted sum value herein may be set according to an actual requirement, and a weighted value may be, for example, 0.5, 1, 2, 3, 5, 10, or another value), or an average value of the reference long-term linear prediction efficiency of the foregoing current audio frame and the reference short-term linear prediction efficiency of the current audio frame. Certainly, the reference integrated linear prediction efficiency of the foregoing current audio frame may also be obtained, by using another algorithm, based on the reference long-term linear prediction efficiency of the foregoing current audio frame and the reference short-term linear prediction efficiency of the current audio frame.

It may be understood that because the reference linear prediction efficiency of the foregoing current audio frame includes different types of linear prediction efficiency, there may be different specific manners of determining, by the processor 601, the audio coding scheme that matches the reference linear prediction efficiency of the foregoing current audio frame. The following illustrates some possible embodiment manners by using examples.

For example, in some embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference long-term linear prediction efficiency of the foregoing current audio frame is less than a first threshold and/or the reference short-term linear prediction efficiency of the foregoing current audio frame is less than a second threshold, determine that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference long-term linear prediction efficiency of the foregoing current audio frame is greater than or equal to a first threshold and/or the reference short-term linear prediction efficiency of the foregoing current audio frame is greater than or equal to a second threshold, determine that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference long-term linear prediction efficiency of the foregoing current audio frame and the reference short-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference long-term linear prediction efficiency of the foregoing current audio frame is less than a first threshold and/or the reference short-term linear prediction efficiency of the foregoing current audio frame is less than a second threshold, determine that the audio coding scheme that matches the reference linear prediction efficiency of the foregoing current audio frame is an audio coding scheme not based on linear prediction; or if the reference long-term linear prediction efficiency of the foregoing current audio frame is greater than or equal to a first threshold and/or the reference short-term linear prediction efficiency of the foregoing current audio frame is greater than or equal to a second threshold, determine that the audio coding scheme that matches the reference linear prediction efficiency of the foregoing current audio frame is a linear prediction based audio coding scheme.

For another example, in some embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference long-term linear prediction efficiency of the foregoing current audio frame is greater than or equal to a third threshold, determine that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference long-term linear prediction efficiency of the foregoing current audio frame is less than a fourth threshold, determine that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference long-term linear prediction efficiency of the foregoing current audio frame is greater than or equal to a third threshold, determine that the audio coding scheme that matches the reference linear prediction efficiency of the foregoing current audio frame is a linear prediction based audio coding scheme; or if the reference long-term linear prediction efficiency of the foregoing current audio frame is less than a fourth threshold, determine that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference long-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: determine a first linear prediction efficiency interval within which the reference long-term linear prediction efficiency of the foregoing current audio frame falls, and determine, according to a mapping relationship between a linear prediction efficiency interval and a linear prediction based audio coding scheme, a first audio coding scheme that is in a mapping relationship with the foregoing first linear prediction efficiency interval, where the foregoing first audio coding scheme is an audio coding scheme that matches the reference linear prediction efficiency of the foregoing current audio frame, and the foregoing first audio coding scheme is a linear prediction based audio coding scheme or an audio coding scheme not based on linear prediction. Different linear prediction efficiency intervals are corresponding to different audio coding schemes. For example, it is assumed that there are three linear prediction efficiency intervals, which may be 0-30%, 30-70%, and 70-100% respectively. If the reference long-term linear prediction efficiency of the foregoing current audio frame falls within the linear prediction efficiency interval 0-30% (that is, the first linear prediction efficiency interval is the linear prediction efficiency interval 0-30%), it may be determined that an audio coding scheme corresponding to the linear prediction efficiency interval 0-30% is the audio coding scheme that matches the reference linear prediction efficiency of the foregoing current audio frame. If the reference long-term linear prediction efficiency of the foregoing current audio frame falls within the linear prediction efficiency interval 30-70% (that is, the first linear prediction efficiency interval is the linear prediction efficiency interval 30-70%), it may be determined that an audio coding scheme corresponding to the linear prediction efficiency interval 30-70% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference short-term linear prediction efficiency of the foregoing current audio frame is greater than or equal to a fifth threshold, determine that the audio coding scheme that matches the reference linear prediction efficiency of the foregoing current audio frame is a linear prediction based audio coding scheme.

For another example, in still other embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference short-term linear prediction efficiency of the foregoing current audio frame is less than a fifth threshold, determine that the audio coding scheme that matches the reference linear prediction efficiency of the foregoing current audio frame is an audio coding scheme not based on linear prediction.

For another example, in other embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference short-term linear prediction efficiency of the foregoing current audio frame is greater than or equal to a fifth threshold, determine that the audio coding scheme that matches the reference linear prediction efficiency of the foregoing current audio frame is a linear prediction based audio coding scheme; or if the reference short-term linear prediction efficiency of the foregoing current audio frame is less than a fifth threshold, determine that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference short-term linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: determine a second linear prediction efficiency interval within which the reference short-term linear prediction efficiency of the foregoing current audio frame falls, and determine, according to a mapping relationship between a linear prediction efficiency interval and a linear prediction based audio coding scheme, a second audio coding scheme that is in a mapping relationship with the foregoing second linear prediction efficiency interval or an audio coding scheme not based on linear prediction, where the foregoing second audio coding scheme is an audio coding scheme that matches the reference linear prediction efficiency of the foregoing current audio frame, and the second audio coding scheme is a linear prediction based audio coding scheme. For example, it is assumed that there are three linear prediction efficiency intervals, which may be 0-40%, 40-60%, and 60-100% respectively. If the reference long-term linear prediction efficiency of the foregoing current audio frame falls within the linear prediction efficiency interval 0-40% (that is, the second linear prediction efficiency interval is the linear prediction efficiency interval 0-40%), it may be determined that an audio coding scheme corresponding to the linear prediction efficiency interval 0-40% is the audio coding scheme that matches the reference linear prediction efficiency of the foregoing current audio frame. If the reference long-term linear prediction efficiency of the foregoing current audio frame falls within the linear prediction efficiency interval 40-60% (that is, the second linear prediction efficiency interval is the linear prediction efficiency interval 40-60%), it is determined that an audio coding scheme corresponding to the linear prediction efficiency interval 40-60% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

For another example, in some embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference integrated linear prediction efficiency of the foregoing current audio frame is greater than or equal to a sixth threshold, determine that the audio coding scheme that matches the reference linear prediction efficiency of the foregoing current audio frame is a linear prediction based audio coding scheme.

For another example, in other embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference integrated linear prediction efficiency of the foregoing current audio frame is less than a sixth threshold, determine that the audio coding scheme that matches the reference linear prediction efficiency of the foregoing current audio frame is an audio coding scheme not based on linear prediction.

For another example, in still other embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: if the reference integrated linear prediction efficiency of the foregoing current audio frame is greater than or equal to a sixth threshold, determine that the audio coding scheme that matches the reference linear prediction efficiency of the foregoing current audio frame is a linear prediction based audio coding scheme; or if the reference integrated linear prediction efficiency of the foregoing current audio frame is less than a sixth threshold, determine that the audio coding scheme that matches the reference linear prediction efficiency of the foregoing current audio frame is an audio coding scheme not based on linear prediction.

For another example, in some embodiments of the present disclosure, if the reference linear prediction efficiency of the foregoing current audio frame includes the reference integrated linear prediction efficiency of the foregoing current audio frame, in the aspect of determining an audio coding scheme that matches the reference linear prediction efficiency of the foregoing current audio frame, by invoking the program or the instruction stored in the memory 605, the processor 601 may be specifically configured to: determine a third linear prediction efficiency interval within which the reference integrated linear prediction efficiency of the foregoing current audio frame falls, and determine, according to a mapping relationship between a linear prediction efficiency interval and a linear prediction based audio coding scheme, a third audio coding scheme that is in a mapping relationship with the foregoing third linear prediction efficiency interval or an audio coding scheme not based on linear prediction, where the foregoing third audio coding scheme is an audio coding scheme that matches the reference linear prediction efficiency of the foregoing current audio frame, and the foregoing third audio coding scheme is a linear prediction based audio coding scheme. For example, it is assumed that there are three linear prediction efficiency intervals, which may be 0-50%, 50-80%, and 80-100% respectively. If the reference long-term linear prediction efficiency of the foregoing current audio frame falls within the linear prediction efficiency interval 0-50% (that is, the third linear prediction efficiency interval is the linear prediction efficiency interval 0-50%), it may be determined that an audio coding scheme corresponding to the linear prediction efficiency interval 0-50% is the audio coding scheme that matches the reference linear prediction efficiency of the foregoing current audio frame. If the reference long-term linear prediction efficiency of the foregoing current audio frame falls within the linear prediction efficiency interval 50-80% (that is, the third linear prediction efficiency interval is the linear prediction efficiency interval 50-80%), it is determined that an audio coding scheme corresponding to the linear prediction efficiency interval 50-80% is the audio coding scheme that matches the reference linear prediction efficiency of the foregoing current audio frame, and another scenario is deduced from this. The mapping relationship between a linear prediction efficiency interval and a linear prediction based audio coding scheme may be set according to requirements of different application scenarios.

In some embodiments of the present disclosure, the linear prediction based audio coding scheme may include algebraic code excited linear prediction (ACELP) coding, transform coded excitation (TCX), and the like; the non-linear prediction based audio coding scheme may include generic audio coding (GAC), where the GAC may include, for example, modified discrete cosine transform (MDCT) coding or discrete cosine transform (DCT) coding.

It may be understood that specific values of the thresholds (for example, the first threshold, the second threshold, the third threshold, the fourth threshold, the fifth threshold, and the sixth threshold) mentioned in the foregoing examples may be set according to a requirement or according to an application environment and an application scenario. For example, if a value range of the reference long-term linear prediction efficiency of the foregoing current audio frame is 0-1, a value of the first threshold may be 0.2, 0.5, 0.6, 0.8, or the like, if a value range of the reference short-term linear prediction efficiency of the foregoing current audio frame is 0-1, a value of the second threshold may be 0.3, 0.3, 0.6, 0.8, or the like, and another scenario is deduced from this. Further, values of the thresholds may further be adjusted in a dynamic and adaptive manner according to a requirement.

It may be understood that different types of linear prediction efficiency included in the reference linear prediction efficiency of the foregoing current audio frame may be specifically estimated in different manners. The following uses some possible embodiment manners as examples to perform description.

For example, in some embodiments of the present disclosure, by invoking the program or the instruction stored in the memory 605, the processor 601 may be specifically configured to obtain the reference long-term linear prediction efficiency of the current audio frame by means of estimation in the following manner: estimating the long-term linear prediction efficiency of the current audio frame, where the long-term linear prediction efficiency of the foregoing current audio frame is the reference long-term linear prediction efficiency of the foregoing current audio frame.

Alternatively, by invoking the program or the instruction stored in the memory 605, the processor 601 may be specifically configured to obtain the reference long-term linear prediction efficiency of the current audio frame by means of estimation in the following manner: obtaining the long-term linear prediction efficiency of the current audio frame by means of estimation; acquiring linear prediction efficiency of N1 history audio frames of the foregoing current audio frame; and calculating a first statistical value of the linear prediction efficiency of the foregoing N1 history audio frames and the long-term linear prediction efficiency of the foregoing current audio frame, where N1 is a positive integer, the foregoing first statistical value is the reference long-term linear prediction efficiency of the foregoing current audio frame, linear prediction efficiency of each history audio frame of N11 history audio frames is at least one of the following linear prediction efficiency of each history audio frame: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N11 history audio frames are a subset of the foregoing N1 history audio frames. The first statistical value, obtained by means of calculation, of the linear prediction efficiency of the foregoing N1 history audio frames and the long-term linear prediction efficiency of the foregoing current audio frame may be, for example, a sum value, a weighted sum value, a geometric average value, an arithmetic average value, a moving average value, or a weighted average value of the linear prediction efficiency of the foregoing N1 history audio frames and the long-term linear prediction efficiency of the foregoing current audio frame.

Alternatively, by invoking the program or the instruction stored in the memory 605, the processor 601 may be specifically configured to obtain the reference long-term linear prediction efficiency of the current audio frame by means of estimation in the following manner: obtaining the long-term linear prediction efficiency of the current audio frame by means of estimation; acquiring reference linear prediction efficiency of N2 history audio frames of the foregoing current audio frame; and calculating a second statistical value of the reference linear prediction efficiency of the foregoing N2 history audio frames and the long-term linear prediction efficiency of the foregoing current audio frame, where N2 is a positive integer, the foregoing second statistical value is the reference long-term linear prediction efficiency of the foregoing current audio frame, reference linear prediction efficiency of each history audio frame of N21 history audio frames is at least one of the following linear prediction efficiency of each history audio frame: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N21 history audio frames are a subset of the foregoing N2 history audio frames. The second statistical value, obtained by means of calculation, of the reference linear prediction efficiency of the foregoing N2 history audio frames and the long-term linear prediction efficiency of the foregoing current audio frame is, for example, a sum value, a weighted sum value, a geometric average value, an arithmetic average value, a moving average value, or a weighted average value of the reference linear prediction efficiency of the foregoing N2 history audio frames and the long-term linear prediction efficiency of the foregoing current audio frame.

Alternatively, by invoking the program or the instruction stored in the memory 605, the processor 601 may be specifically configured to obtain the reference long-term linear prediction efficiency of the current audio frame by means of estimation in the following manner: obtaining the long-term linear prediction efficiency of the current audio frame by means of estimation; acquiring reference linear prediction efficiency of N4 history audio frames of the foregoing current audio frame; acquiring linear prediction efficiency of N3 history audio frames of the foregoing current audio frame; and calculating a third statistical value of the linear prediction efficiency of the foregoing N3 history audio frames, the reference linear prediction efficiency of the foregoing N4 history audio frames, and the long-term linear prediction efficiency of the foregoing current audio frame, where N3 and N4 are positive integers, the foregoing third statistical value is the reference long-term linear prediction efficiency of the foregoing current audio frame, linear prediction efficiency of each history audio frame of N31 history audio frames is at least one of the following linear prediction efficiency of each history audio frame: long-term linear prediction efficiency, short-term linear prediction efficiency, and integrated linear prediction efficiency, reference linear prediction efficiency of each history audio frame of N41 history audio frames is at least one of the following linear prediction efficiency of each history audio frame: reference long-term linear prediction efficiency, reference short-term linear prediction efficiency, and reference integrated linear prediction efficiency, the foregoing N31 history audio frames are a subset of the foregoing N3 history audio frames, the foregoing N41 history audio frames are a subset of the foregoing N4 history audio frames, integrated linear prediction efficiency of each history audio frame is obtained based on long-term linear prediction efficiency and short-term linear prediction efficiency of each history audio frame, and reference integrated linear prediction efficiency of each history audio frame is obtained based on reference long-term linear prediction efficiency and reference short-term linear prediction efficiency of each history audio frame. An intersection set of the foregoing N3 history audio frames and the foregoing N4 history audio frames may be an empty set or may not be an empty set. The third statistical value, obtained by means of calculation, of the linear prediction efficiency of the foregoing N3 history audio frames, the reference linear prediction efficiency of the foregoing N4 history audio frames, and the long-term linear prediction efficiency of the foregoing current audio frame is, for example, a sum value, a weighted sum value, a geometric average value, an arithmetic average value, a moving average value, or a weighted average value of the linear prediction efficiency of the foregoing N3 history audio frames, the reference linear prediction efficiency of the foregoing N4 history audio frames, and the long-term linear prediction efficiency of the foregoing current audio frame.

For example, in some embodiments of the present disclosure, by invoking the program or the instruction stored in the memory 605, the processor 601 may be specifically configured to obtain the reference short-term linear prediction efficiency of the current audio frame by means of estimation in the following manner: estimating the short-term linear prediction efficiency of the current audio frame, where the short-term linear prediction efficiency of the foregoing current audio frame is the reference short-term linear prediction efficiency of the foregoing current audio frame.

Alternatively, by invoking the program or the instruction stored in the memory 605, the processor 601 may be specifically configured to obtain the reference short-term linear prediction efficiency of the current audio frame by means of estimation in the following manner: obtaining the short-term linear prediction efficiency of the current audio frame by means of estimation; acquiring linear prediction efficiency of N5 history audio frames of the foregoing current audio frame; and calculating a fourth statistical value of the linear prediction efficiency of the foregoing N5 history audio frames and the short-term linear prediction efficiency of the foregoing current audio frame, where N5 is a positive integer, the foregoing fourth statistical value is the reference short-term linear prediction efficiency of the foregoing current audio frame, linear prediction efficiency of each history audio frame of N51 history audio frames is at least one of the following linear prediction efficiency of each history audio frame: long-term linear prediction efficiency, short-term linear prediction efficiency, and integrated linear prediction efficiency, integrated linear prediction efficiency of each history audio frame is obtained based on long-term linear prediction efficiency and short-term linear prediction efficiency of each history audio frame, and the foregoing N51 history audio frames are a subset of the foregoing N5 history audio frames. The fourth statistical value, obtained by means of calculation, of the linear prediction efficiency of the foregoing N5 history audio frames and the short-term linear prediction efficiency of the foregoing current audio frame may be a sum value, a weighted sum value, a geometric average value, an arithmetic average value, a moving average value, or a weighted average value of the linear prediction efficiency of the foregoing N5 history audio frames and the short-term linear prediction efficiency of the foregoing current audio frame.

Alternatively, by invoking the program or the instruction stored in the memory 605, the processor 601 may be specifically configured to obtain the reference short-term linear prediction efficiency of the current audio frame by means of estimation in the following manner: obtaining the short-term linear prediction efficiency of the current audio frame by means of estimation; acquiring reference linear prediction efficiency of N6 history audio frames of the foregoing current audio frame; and calculating a fifth statistical value of the reference linear prediction efficiency of the foregoing N6 history audio frames and the short-term linear prediction efficiency of the foregoing current audio frame, where N6 is a positive integer, the foregoing fifth statistical value is the reference short-term linear prediction efficiency of the foregoing current audio frame, reference linear prediction efficiency of each history audio frame of N61 history audio frames is at least one of the following linear prediction efficiency of each history audio frame: reference long-term linear prediction efficiency, reference short-term linear prediction efficiency, and reference integrated linear prediction efficiency, reference integrated linear prediction efficiency of each history audio frame is obtained based on reference long-term linear prediction efficiency and reference short-term linear prediction efficiency of each history audio frame, and the foregoing N61 history audio frames are a subset of the foregoing N6 history audio frames. The fifth statistical value, obtained by means of calculation, of the reference linear prediction efficiency of the foregoing N6 history audio frames and the short-term linear prediction efficiency of the foregoing current audio frame may be a sum value, a weighted sum value, a geometric average value, an arithmetic average value, a moving average value, or a weighted average value of the reference linear prediction efficiency of the foregoing N6 history audio frames and the short-term linear prediction efficiency of the foregoing current audio frame.

Alternatively, by invoking the program or the instruction stored in the memory 605, the processor 601 may be specifically configured to obtain the reference short-term linear prediction efficiency of the current audio frame by means of estimation in the following manner: obtaining the short-term linear prediction efficiency of the current audio frame by means of estimation; acquiring reference linear prediction efficiency of N8 history audio frames of the foregoing current audio frame; acquiring linear prediction efficiency of N7 history audio frames of the foregoing current audio frame; and calculating a sixth statistical value of the linear prediction efficiency of the foregoing N7 history audio frames, the reference linear prediction efficiency of the foregoing N8 history audio frames, and the short-term linear prediction efficiency of the foregoing current audio frame, where N7 and N8 are positive integers, the foregoing sixth statistical value is the reference short-term linear prediction efficiency of the foregoing current audio frame, linear prediction efficiency of each history audio frame of N71 history audio frames is at least one of the following linear prediction efficiency of each history audio frame: long-term linear prediction efficiency, short-term linear prediction efficiency, and integrated linear prediction efficiency, reference linear prediction efficiency of each history audio frame of N81 history audio frames is at least one of the following linear prediction efficiency of each history audio frame: reference long-term linear prediction efficiency, reference short-term linear prediction efficiency, and reference integrated linear prediction efficiency, integrated linear prediction efficiency of each history audio frame is obtained based on long-term linear prediction efficiency and short-term linear prediction efficiency of each history audio frame, reference integrated linear prediction efficiency of each history audio frame is obtained based on reference long-term linear prediction efficiency and reference short-term linear prediction efficiency of each history audio frame, the foregoing N71 history audio frames are a subset of the foregoing N7 history audio frames, and the foregoing N81 history audio frames are a subset of the foregoing N8 history audio frames. An intersection set of the foregoing N7 history audio frames and the foregoing N8 history audio frames may be an empty set or may not be an empty set. The sixth statistical value, obtained by means of calculation, of the linear prediction efficiency of the foregoing N7 history audio frames, the reference linear prediction efficiency of the foregoing N8 history audio frames, and the short-term linear prediction efficiency of the foregoing current audio frame may be a sum value, a weighted sum value, a geometric average value, an arithmetic average value, a moving average value, or a weighted average value of the linear prediction efficiency of the foregoing N7 history audio frames, the reference linear prediction efficiency of the foregoing N8 history audio frames, and the short-term linear prediction efficiency of the foregoing current audio frame.

In some embodiments of the present disclosure, linear prediction efficiency (for example, long-term linear prediction efficiency or short-term linear prediction efficiency) of an audio frame (for example, a current audio frame or a history audio frame of a current audio frame) may be used to represent an extent to which linear prediction can be performed on the audio frame. A linear prediction result of an audio frame (for example, a current audio frame or a history audio frame of a current audio frame) refers to a linear prediction value of the audio frame. Higher linear prediction efficiency (for example, long-term linear prediction efficiency or short-term linear prediction efficiency) of an audio frame (for example, a current audio frame or a history audio frame of a current audio frame) indicates a larger extent to which linear prediction can be performed on the audio frame.

In some embodiments of the present disclosure, in the aspect of obtaining the short-term linear prediction efficiency of the current audio frame based on a linear-prediction residual of the current audio frame, by invoking the program or the instruction stored in the memory 605, the processor 601 may be specifically configured to calculate a change rate of energy that are of the current audio frame and obtained before and after short-term linear prediction is performed on the current audio frame, where the foregoing calculated energy change rate is the short-term linear prediction efficiency of the current audio frame, or the short-term linear prediction efficiency of the current audio frame is obtained by means of transformation based on the foregoing calculated energy change rate, and the energy that is of the foregoing current audio frame and obtained after the short-term linear prediction is performed on the current audio frame is energy of the linear-prediction residual of the foregoing current audio frame. For example, there may be a mapping relationship between the energy change rate and the short-term linear prediction efficiency of the current audio frame, and the short-term linear prediction efficiency that is of the current audio frame and is in the mapping relationship with the foregoing calculated energy change rate may be obtained based on the mapping relationship between the energy change rate and the short-term linear prediction efficiency of the current audio frame. Generally, a larger change rate of the energy that are of the current audio frame and obtained before and after the short-term linear prediction is performed on the current audio frame indicates higher short-term linear prediction efficiency of the current audio frame.

For example, the change rate of the energy that are of the foregoing current audio frame and obtained before and after the short-term linear prediction is performed on the current audio frame may be a ratio or a reciprocal of a ratio of the energy that is of the foregoing current audio frame and obtained before the short-term linear prediction is performed on the current audio frame to the energy of the linear-prediction residual of the foregoing current audio frame. Generally, a larger ratio obtained by dividing the energy that is of the foregoing current audio frame and obtained before the short-term linear prediction is performed on the current audio frame by the energy of the linear-prediction residual of the foregoing current audio frame indicates higher short-term linear prediction efficiency of the current audio frame.

In some embodiments of the present disclosure, in the aspect of obtaining the long-term linear prediction efficiency of the current audio frame by means of estimation, by invoking the program or the instruction stored in the memory 605, the processor 601 may be specifically configured to obtain a correlation between a linear-prediction residual of the current audio frame and a first history linear prediction signal according to the linear-prediction residual of the foregoing current audio frame and the foregoing first history linear prediction signal, where the foregoing correlation is the long-term linear prediction efficiency of the current audio frame, or the long-term linear prediction efficiency of the current audio frame is obtained based on the foregoing correlation. The foregoing first history linear prediction signal is first history linear prediction excitation or a first history linear-prediction residual, the foregoing first history linear-prediction residual is a linear-prediction residual of a history audio frame of the foregoing current audio frame (for example, the foregoing first history linear-prediction residual may be a linear-prediction residual of a history audio frame that is of the current audio frame and whose duration is the same as or similar to that of the foregoing current audio frame, or the foregoing first history linear-prediction residual may be linear-prediction residuals of some consecutive audio signals of two adjacent history audio frames that are of the foregoing current audio frame and whose duration is the same as or similar to that of the foregoing current audio frame), and the foregoing first history linear prediction excitation is linear prediction excitation of the history audio frame of the foregoing current audio frame (for example, the foregoing first history linear prediction excitation may be linear prediction excitation of a history audio frame that is of the foregoing current audio frame and whose duration is the same as or similar to that of the foregoing current audio frame, or the foregoing first history linear prediction excitation may be linear prediction excitation of some consecutive audio signals of two adjacent history audio frames that are of the current audio frame and whose duration is the same as or similar to that of the foregoing current audio frame). For example, there is a mapping relationship between a correlation and long-term linear prediction efficiency of an audio frame, and the long-term linear prediction efficiency that is of the foregoing current audio frame and is in a mapping relationship with the foregoing calculated correlation may be obtained based on the mapping relationship between a correlation and long-term linear prediction efficiency of an audio frame.

The correlation between the linear-prediction residual of the foregoing current audio frame and the foregoing first history linear prediction signal may be obtained according to the linear-prediction residual of the current audio frame and the first history linear prediction signal in various manners.

For example, in the aspect of obtaining a correlation between a linear-prediction residual of the current audio frame and a first history linear prediction signal according to the linear-prediction residual of the foregoing current audio frame and the foregoing first history linear prediction signal, by invoking the program or the instruction stored in the memory 605, the processor 601 may be specifically configured to calculate the correlation between the linear-prediction residual of the current audio frame and the first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the linear-prediction residual of the current audio frame by a gain factor to obtain a gained linear-prediction residual of the foregoing current audio frame, and obtaining a correlation between the gained linear-prediction residual of the foregoing current audio frame and the first history linear prediction signal by means of calculation, where the correlation, obtained by means of calculation, between the gained linear-prediction residual of the foregoing current audio frame and the foregoing first history linear prediction signal is the correlation between the linear-prediction residual of the foregoing current audio frame and the foregoing first history linear prediction signal.

Alternatively, the obtaining a correlation between a linear-prediction residual of the current audio frame and a first history linear prediction signal according to the linear-prediction residual of the foregoing current audio frame and the foregoing first history linear prediction signal may include: multiplying the first history linear prediction signal by a gain factor to obtain a gained first history linear prediction signal, and obtaining a correlation between the linear-prediction residual of the foregoing current audio frame and the foregoing gained first history linear prediction signal by means of calculation, where the correlation, obtained by means of calculation, between the linear-prediction residual of the foregoing current audio frame and the foregoing gained first history linear prediction signal is the correlation between the linear-prediction residual of the foregoing current audio frame and the foregoing first history linear prediction signal.

The foregoing first history linear prediction excitation or the foregoing first history linear-prediction residual may be determined based on a pitch of the foregoing current audio frame. For example, a time-domain correlation between the foregoing first history linear prediction excitation and the linear-prediction residual of the foregoing current audio frame is greater than or equal to a time-domain correlation between other history linear prediction excitation and the linear-prediction residual of the foregoing current audio frame, or a time-domain correlation between the foregoing first history linear prediction excitation and the linear-prediction residual of the foregoing current audio frame is greater than or equal to a time-domain correlation between at least one other history linear prediction excitation and the linear-prediction residual of the foregoing current audio frame. For example, a time-domain correlation between the foregoing first history linear-prediction residual and the linear-prediction residual of the foregoing current audio frame is greater than or equal to a time-domain correlation between another history linear-prediction residual and the linear-prediction residual of the foregoing current audio frame, or a time-domain correlation between the foregoing first history linear-prediction residual and the linear-prediction residual of the foregoing current audio frame is greater than or equal to a time-domain correlation between at least one other history linear-prediction residual and the linear-prediction residual of the foregoing current audio frame.

Generally, a larger correlation between the linear-prediction residual of the foregoing current audio frame and the foregoing first history linear prediction signal indicates higher long-term linear prediction efficiency of the foregoing current audio frame.

In some embodiments of the present disclosure, the foregoing correlation is, for example, a function value of a cross correlation in the time domain and/or a function value of a cross correlation in the frequency domain, or the foregoing correlation may be time-domain distortion and/or frequency-domain distortion (where the frequency-domain distortion may also be referred to as spectrum distortion).

In some embodiments of the present disclosure, the foregoing frequency-domain distortion may be a sum value or a weighted sum value of distortion of K1 frequency bins in the frequency domain, or the foregoing frequency-domain distortion may be a sum value or a weighted sum value of distortion of K2 sub-bands in the frequency domain, where K1 and K2 are positive integers.

Generally, a larger cross correlation function value in the time domain of the linear-prediction residual of the foregoing current audio frame and the foregoing first history linear prediction signal may indicate higher long-term linear prediction efficiency of the foregoing current audio frame. Generally, a larger cross correlation function value in the frequency domain of the linear-prediction residual of the foregoing current audio frame and the foregoing first history linear prediction signal may indicate higher long-term linear prediction efficiency of the foregoing current audio frame. Generally, smaller frequency-domain distortion between the linear-prediction residual of the foregoing current audio frame and the foregoing first history linear prediction signal indicates higher long-term linear prediction efficiency of the foregoing current audio frame. Generally, smaller time-domain distortion between the linear-prediction residual of the foregoing current audio frame and the foregoing first history linear prediction signal indicates higher long-term linear prediction efficiency of the foregoing current audio frame.

In some embodiments of the present disclosure, a weighting coefficient corresponding to the weighted sum value of the foregoing distortion is a perceptual weighting coefficient that reflects a psychoacoustic model. Certainly, the weighting coefficient corresponding to the weighted sum value of the foregoing distortion may also be another weighting coefficient that is set based on an actual requirement. It is found, by means of testing, that using the perceptual weighting coefficient helps make the calculated distortion better meet subjective quality, thereby helping improve performance.

In some embodiments of the present disclosure, the foregoing first history linear prediction excitation may be linear prediction excitation generated by performing audio coding on the history audio frame of the foregoing current audio frame by using a linear prediction based coding scheme.

In some embodiments of the present disclosure, the foregoing first history linear-prediction residual may be obtained based on a time-domain signal of a first history audio frame of the foregoing current audio frame and a linear prediction coefficient of the foregoing first history audio frame, where a linear prediction coefficient of the foregoing first history audio frame is a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the linear-prediction residual of the foregoing current audio frame may be obtained based on a time-domain signal of the foregoing current audio frame and a linear prediction coefficient of the foregoing current audio frame, where the linear prediction coefficient of the foregoing current audio frame may be a quantized linear prediction coefficient or an unquantized linear prediction coefficient. Because the quantized linear prediction coefficient generally affects final quality in an actual coding and decoding process, using the quantized linear prediction coefficient to calculate the linear-prediction residual helps make the calculated correlation more accurate.

In some embodiments of the present disclosure, the foregoing first history linear prediction excitation may be superposed excitation of adaptive codebook excitation and fixed codebook excitation, or the foregoing first history linear prediction excitation may be adaptive codebook excitation, or the foregoing first history linear prediction excitation may be another type of codebook excitation.

It may be understood that functions of function modules of the audio coder 600 in this embodiment may be specifically implemented according to the method in the foregoing method embodiment. For a specific implementation process, refer to related descriptions of the foregoing method embodiment. Details are not described herein again. The audio coder 600 may be any apparatus that needs to collect, store, or may transmit outwards an audio signal may be, for example, a mobile phone, a tablet computer, a personal computer, or a notebook computer.

For examples of values of the thresholds (for example, the first threshold and the second threshold) and the other parameters (for example, N1, N11, N21, and N2) involved in this apparatus embodiment, refer to related examples of values in the foregoing method embodiment. Details are not described herein again.

It can be learned that in the technical solution in this embodiment, the audio coder 600 first estimates reference linear prediction efficiency of a current audio frame; determines, by using the estimated reference linear prediction efficiency of the foregoing current audio frame, an audio coding scheme that matches the estimated reference linear prediction efficiency; and performs audio coding on the foregoing current audio frame according to the determined audio coding scheme that matches the estimated reference linear prediction efficiency. In a process of determining the audio coding scheme in the foregoing solution, an operation, required to be executed in an existing closed-loop selection mode, of performing complete coding on the current audio frame by using each audio coding scheme does not need to be executed; instead, the audio coding scheme that needs to be selected is determined by using the reference linear prediction efficiency of the current audio frame. Calculation complexity of estimating the reference linear prediction efficiency of the current audio frame is generally far less than calculation complexity of performing complete coding on the current audio frame by using each audio coding scheme. Therefore, compared with an existing mechanism, the foregoing solution in this embodiment of the present disclosure helps reduce operation complexity of audio coding, and further reduce overheads of audio coding.

An embodiment of the present disclosure further provides a computer storage medium, where the computer storage medium may store a program. When being executed, the program includes some or all steps of any audio coding method described in the foregoing method embodiments.

It should be noted that, to make the description brief, the foregoing method embodiments are expressed as a series of actions. However, persons skilled in the art should appreciate that the present disclosure is not limited to the described action sequence, because according to the present disclosure, some steps may be performed in other sequences or performed simultaneously. In addition, persons skilled in the art should also appreciate that all the embodiments described in the specification are preferred embodiments, and the related actions and modules are not necessarily mandatory to the present disclosure.

In the foregoing embodiments, the description of each embodiment has respective focuses. For a part that is not described in detail in an embodiment, refer to related descriptions in other embodiments.

In the several embodiments provided in this application, it should be understood that the disclosed apparatus may be implemented in another manner. For example, the described apparatus embodiment is merely exemplary. For example, the unit division is merely logical function division and may be other division in actual implementation. For example, multiple units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic or other forms.

The units described as separate parts may or may not be physically separate, and parts displayed as units may or may not be physical units, may be located in one position, or may be distributed on multiple network units. Some or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit. The foregoing integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of the present disclosure essentially, or the part contributing to the prior art, or all or a part of the technical solutions may be implemented in the form of a software product. The software product is stored in a storage medium and includes several instructions for instructing a computer device (which may be a personal computer, a server, or a network device) to perform all or a part of the steps of the methods described in the embodiments of the present disclosure. The foregoing storage medium includes: any medium that can store program code, such as a USB flash drive, a read-only memory (ROM, Read-Only Memory), a random access memory (RAM, Random Access Memory), a removable hard disk, a magnetic disk, or an optical disc.

The foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present disclosure.

What is claimed is:

1. An audio coding method, performed by an audio encoder, comprising:

estimating a short-term linear prediction efficiency of a current audio frame, wherein, the short-term linear prediction efficiency is a change rate of energy of the current audio frame, the energy of the current audio frame is obtained before and after a short-term linear prediction of the current audio frame is performed on a current audio signal, and the energy of the current audio frame obtained after the short-term linear prediction is performed is energy of a linear-prediction residual of the current audio frame;

selecting an audio coding scheme according to the short-term linear prediction efficiency, wherein the audio coding scheme is selected from a group consisting of a linear prediction based coding scheme and a non-linear prediction based audio coding scheme; and performing audio coding on the current audio frame according to the selected audio coding scheme.

2. The method according to claim 1, wherein, the selecting comprises:

selecting the linear prediction based audio coding scheme if the short-term linear prediction efficiency of the current audio frame is greater than or equal to a threshold.

3. The method according to claim 2, wherein, the selecting comprises:

selecting the audio coding scheme not based on linear prediction if the short-term linear prediction efficiency of the current audio frame is less than a threshold.

4. The method according to claim 1, wherein, the selecting comprises:

selecting the audio coding scheme not based on linear prediction if the short-term linear prediction efficiency of the current audio frame is less than a threshold.

5. The method according to claim 1, wherein, the selecting comprises:

determining a second linear prediction efficiency interval within which the short-term linear prediction efficiency of the current audio frame falls, and selecting, according to a mapping relationship between a linear prediction efficiency interval and a linear prediction based audio coding scheme, a second audio coding scheme that is in a mapping relationship with the second linear prediction efficiency interval, wherein the second audio coding scheme is an audio coding scheme that matches the short-term linear prediction efficiency of the current audio frame, and the second audio coding scheme is a linear prediction based audio coding scheme or an audio coding scheme not based on linear prediction.

6. The method according to claim 1, wherein, the change rate is a ratio or a reciprocal of a ratio of the energy of the current audio frame obtained before the short-term linear prediction is performed on the current audio frame to the energy of the linear-prediction residual of the current audio frame.

7. An audio coder, comprising:

a memory comprising instructions; and one or more processors in communication with the memory, wherein the one or more processors execute the instructions to:

estimate a short-term linear prediction efficiency of a current audio frame, wherein, the short-term linear prediction efficiency is a change rate of energy of the current audio frame, the energy of the current audio frame is obtained before and after a short-term linear prediction of the current audio frame is performed on the current audio signal, and the energy of the current audio frame obtained after the short-term linear prediction is performed is energy of a linear-prediction residual of the current audio frame;

select an audio coding scheme between a linear prediction based coding scheme or a non-linear prediction based coding scheme according to the short-term linear prediction efficiency; and perform audio coding on the current audio frame according to the selected audio coding scheme.

8. The audio coder according to claim 7, wherein upon the one or more processors executing instructions to select the audio coding scheme, the one or more processors execute the instructions to:

select the linear prediction based audio coding scheme if the short-term linear prediction efficiency of the current audio frame is greater than or equal to a threshold.

9. The audio coder according to claim 8, wherein, upon the one or more processors executing instructions to select the audio coding scheme, the one or more processors execute further instructions to:

select the audio coding scheme not based on linear prediction if the short-term linear prediction efficiency of the current audio frame is less than a threshold.

10. The audio coder according to claim 7, wherein, the one or more processors execute the instructions to:

select the audio coding scheme not based on linear prediction if the short-term linear prediction efficiency of the current audio frame is less than a threshold.

11. The audio coder according to claim 7, wherein, upon the one or more processors executing instructions to select the audio coding scheme, the one or more processors execute instructions to:

determine a second linear prediction efficiency interval within which the short-term linear prediction efficiency of the current audio frame falls, and select, according to a mapping relationship between a linear prediction efficiency interval and a linear prediction based audio coding scheme, a second audio coding scheme that is in a mapping relationship with the second linear prediction efficiency interval, wherein the second audio coding scheme is an audio coding scheme that matches the short-term linear prediction efficiency of the current audio frame, and the second audio coding scheme is a linear prediction based audio coding scheme or an audio coding scheme not based on linear prediction.

12. The audio coder according to claim 7, wherein, the change rate is a ratio or a reciprocal of a ratio of the energy of the current audio frame obtained before the short-term linear prediction is performed on the current audio frame to the energy of the linear-prediction residual of the current audio frame.

13. An audio coding method, comprising:

estimating a short-term linear prediction efficiency of a current audio frame, wherein the short-term linear prediction efficiency is obtained by means of transformation based on a change rate of energy of the current audio frame, the energy of the current audio frame is obtained before and after a short-term linear prediction of the current audio frame is performed on a current audio signal, and the energy of the current audio frame obtained after the short-term linear prediction is performed is energy of a linear-prediction residual of the current audio frame;

selecting an audio coding scheme between a linear prediction based coding audio scheme or a non-linear prediction based audio scheme according to the short-term linear prediction efficiency; and performing audio coding on the current audio frame according to the selected audio coding scheme.

14. The method according to claim 13, wherein, the selecting comprises:

selecting the linear prediction based audio coding scheme if the short-term linear prediction efficiency of the current audio frame is greater than or equal to a threshold.

15. The method according to claim 13, wherein.

the change rate is a ratio or a reciprocal of a ratio of the energy of the current audio frame obtained before the short-term linear prediction is performed on the current audio frame to the energy of the linear-prediction residual of the current audio frame.

16. An audio coder, comprising:

a memory comprising instructions; and one or more processors in communication with the memory, wherein the one or more processors execute the instructions to:

estimate a short-term linear prediction efficiency of a current audio frame, wherein the short-term linear prediction efficiency is obtained by means of transformation based on a change rate of energy of the current audio frame, the energy of the current audio frame is obtained before and after a short-term linear prediction of the current audio frame is performed on the current audio signal, and the energy of the current audio frame obtained after the short-term linear prediction is performed is energy of a linear-prediction residual of the current audio frame;

select an audio coding scheme according to the short-term linear prediction efficiency, wherein the audio coding scheme is selected from the group consisting of a linear prediction based coding scheme and a non-linear prediction based audio scheme; and perform audio coding on the current audio frame according to the selected audio coding scheme.

17. The audio coder according to claim 16, wherein, upon the one or more processors executing instructions to select the audio coding scheme, the one or more processors execute the instructions to:

select the linear prediction based audio coding scheme if the short-term linear prediction efficiency of the current audio frame is greater than or equal to a threshold.

18. The audio coder according to claim 16, wherein, the change rate is a ratio or a reciprocal of a ratio of the energy of the current audio frame obtained before the short-term linear prediction is performed on the current audio frame to the energy of the linear-prediction residual of the current audio frame.

* * * * *